US011000117B2

(12) United States Patent
Davies-Smith et al.

(10) Patent No.: US 11,000,117 B2
(45) Date of Patent: May 11, 2021

(54) FLUID DISPENSING IMPLEMENT HAVING CURLY TUBE WITH VENT OPENINGS

(71) Applicant: Colgate-Palmolive Company, New York, NY (US)

(72) Inventors: Leighton Davies-Smith, Lebanon, NJ (US); Al Aquanza Sprosta, Maplewood, NJ (US); Shyamala Pillai, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 130 days.

(21) Appl. No.: 16/520,397

(22) Filed: Jul. 24, 2019

(65) Prior Publication Data

US 2019/0343270 A1 Nov. 14, 2019

Related U.S. Application Data

(63) Continuation-in-part of application No. 15/840,705, filed on Dec. 13, 2017, now Pat. No. 10,376,040, and (Continued)

(51) Int. Cl.

| | |
|---|---|
| ***A46B 11/04*** | (2006.01) |
| ***A46B 11/00*** | (2006.01) |
| ***A46B 9/04*** | (2006.01) |

(52) U.S. Cl.

CPC ..... *A46B 11/0086* (2013.01); *A46B 9/04* (2013.01); *A46B 11/002* (2013.01); (Continued)

(58) Field of Classification Search

CPC ..... A46B 11/002; A46B 11/0062; A46B 11/0072; A46B 11/0079; A46B 11/0082; A46B 11/0086; A46B 2200/1066

See application file for complete search history.

(56) References Cited

U.S. PATENT DOCUMENTS

| | | | |
|---|---|---|---|
| 1,973,212 | A | 9/1934 | Krueger |
| 3,741,668 | A | 6/1973 | Danizcek et al. |

(Continued)

FOREIGN PATENT DOCUMENTS

| | | |
|---|---|---|
| CN | 2382559 | 6/2000 |
| CN | 101027137 | 8/2007 |

(Continued)

OTHER PUBLICATIONS

International Search Report and Written Opinion of the International Searching Authority in International Application No. PCT/US2017/066120, dated Mar. 26, 2018.

(Continued)

*Primary Examiner* — Jennifer C Chiang

(57) ABSTRACT

A fluid supply apparatus with leakage protection. The apparatus includes a housing defining a storage cavity having a total volume including a fluid portion and a gas portion. The storage cavity extends along a cavity axis from a first end to a second end. A capillary member is fluidly coupled with the fluid. A vent tube having a primary vent passageway and a plurality of vent apertures is located in the storage cavity. The primary vent passageway forms a pathway from the vent apertures to the external atmosphere. Fluid cannot flow through the vent apertures at ambient temperature and pressure equilibrium. The vent apertures may be located and arranged on the vent tube such that irrespective of vertical and angular orientation of the housing relative to a gravitational vector at least one of the vent apertures is in spatial communication with the gas.

18 Claims, 43 Drawing Sheets

Related U.S. Application Data a continuation-in-part of application No. 15/840,825, filed on Dec. 13, 2017, now Pat. No. 10,398,216, and a continuation-in-part of application No. 15/840,766, filed on Dec. 13, 2017, now Pat. No. 10,390,607.

(60) Provisional application No. 62/436,799, filed on Dec. 20, 2016, provisional application No. 62/436,786, filed on Dec. 20, 2016, provisional application No. 62/436,793, filed on Dec. 20, 2016.

(52) U.S. Cl.
CPC ..... *A46B 11/0062* (2013.01); *A46B 11/0079* (2013.01); *A46B 11/0082* (2013.01); *A46B 2200/1066* (2013.01)

(56) References Cited

U.S. PATENT DOCUMENTS

| | | | |
|---|---|---|---|
| 3,873,218 | A | 3/1975 | Yoshida |
| 4,155,663 | A | 5/1979 | Cerquozzi |
| 4,207,012 | A | 6/1980 | Kuparinen |
| 4,530,369 | A | 7/1985 | Adams |
| 4,753,546 | A | 6/1988 | Witz et al. |
| 4,770,558 | A | 9/1988 | Frietsch |
| 4,886,389 | A | 12/1989 | Vidovic |
| 5,033,898 | A | 7/1991 | Williams |
| 5,062,728 | A | 11/1991 | Kuo |
| 5,096,319 | A | 3/1992 | Gueret |
| 5,098,297 | A | 3/1992 | Chari et al. |
| D337,659 | S | 7/1993 | Lacy |
| 5,242,233 | A | 9/1993 | Sirota |
| 5,556,215 | A | 9/1996 | Hori |
| 5,611,687 | A | 3/1997 | Wagner |
| 6,345,405 | B1 | 2/2002 | Brackin |
| 6,371,674 | B1 | 4/2002 | Lerner |
| 6,416,242 | B1 | 7/2002 | Kaufmann |
| 6,659,671 | B1 | 12/2003 | Fukami et al. |
| 6,699,038 | B2 | 3/2004 | Stewart |
| 7,143,462 | B2 | 12/2006 | Hohlbein |
| 7,331,731 | B2 | 2/2008 | Hohlbein et al. |
| 7,887,246 | B2 | 2/2011 | Hori |
| 8,109,686 | B2 | 2/2012 | Bartschi et al. |
| 8,398,326 | B2 | 3/2013 | Jimenez et al. |
| 8,529,150 | B2 | 9/2013 | Olson |
| 9,237,798 | B2 | 1/2016 | Kennedy et al. |
| 9,648,943 | B2 | 5/2017 | Jimenez et al. |
| 9,700,130 | B2 * | 7/2017 | Kennedy ..... A46B 15/0061 |
| 10,238,203 | B2 | 3/2019 | Jimenez |
| 2002/0192007 | A1 | 12/2002 | Lee |
| 2003/0004087 | A1 | 1/2003 | Goldoni et al. |
| 2004/0255416 | A1 | 12/2004 | Hohlbein |
| 2017/0215574 | A1 | 8/2017 | Jimenez et al. |
| 2019/0191860 | A1 | 6/2019 | Jimenez |

FOREIGN PATENT DOCUMENTS

| | | |
|---|---|---|
| CN | 205292011 | 6/2016 |
| DE | 2754338 | 6/1979 |
| DE | 4014642 | 4/1991 |
| DE | 10035214 | 2/2002 |
| EP | 0624483 | 11/1994 |
| EP | 1017297 | 7/2000 |
| FR | 2448982 | 9/1980 |
| GB | 801603 | 9/1958 |
| RU | 2538407 | 1/2015 |
| WO | 2003/101760 | 12/2003 |

OTHER PUBLICATIONS

International Search Report and Written Opinion of the International Searching Authority in International Application No. PCT/US2017/066135, dated Mar. 26, 2018.

International Search Report and Written Opinion of the International Searching Authority in International Application No. PCT/US2017/066148, dated Apr. 20, 2018.

* cited by examiner

FLUID DISPENSING IMPLEMENT HAVING CURLY TUBE WITH VENT OPENINGS

CROSS-REFERENCE TO RELATED APPLICATIONS

The present application is a continuation-in-part of U.S. patent application Ser. No. 15/840,825, filed Dec. 13, 2017, which claims the benefit of U.S. Provisional Patent Application Ser. No. 62/436,799, filed Dec. 20, 2016.

The present application is a continuation-in-part of U.S. patent application Ser. No. 15/840,766, filed Dec. 13, 2017, which claims the benefit of U.S. Provisional Patent Application Ser. No. 62/436,793, filed Dec. 20, 2016.

The present application is a continuation-in-part of U.S. patent application Ser. No. 15/840,705, filed Dec. 13, 2017, which claims the benefit of U.S. Provisional Patent Application Ser. No. 62/436,786, filed Dec. 20, 2016.

The entirety of each of the aforementioned patent applications is incorporated herein by reference.

BACKGROUND

Fluid supply apparatuses are used to store a fluid that is later dispensed onto a surface. Examples of fluid supply apparatuses include writing instruments, liquid dispensers, liquid applicators, and the like. Personal care implements, particularly oral care implements such as toothbrushes, are typically used by applying dentifrice or toothpaste to tooth cleaning elements such as bristles followed by brushing regions of the oral cavity, e.g., the teeth, tongue, and/or gums. Some oral care implements have been equipped with fluid reservoirs and systems for dispensing auxiliary oral care fluids before and/or during the tooth brushing regimen. An issue with existing fluid supply apparatuses and personal care implements containing the same is leakage, particularly due to air expansion as a result of temperature increases or pressure decreases which forces the liquid to leak out of the device. An improved fluid supply apparatus and personal/oral care implement containing the same is desired to address existing unwanted fluid leaks.

BRIEF SUMMARY

The present invention is directed to a fluid supply apparatus with leakage protection. The apparatus includes a housing defining a storage cavity having a total volume including a fluid portion and a gas portion. The storage cavity extends along a cavity axis from a first end to a second end. A capillary member is fluidly coupled with the fluid. A vent tube having a primary vent passageway and a plurality of vent apertures is located in the storage cavity. The primary vent passageway forms a pathway from the vent apertures to the external atmosphere. Fluid cannot flow through the vent apertures at ambient temperature and pressure equilibrium. The vent apertures may be located and arranged on the vent tube such that irrespective of vertical and angular orientation of the housing relative to a gravitational vector at least one of the vent apertures is in spatial communication with the gas.

In one aspect, the invention may be a fluid supply apparatus comprising: a housing defining a storage cavity having a total volume, the storage cavity extending along a cavity axis from a first end to a second end; a store of a fluid in the storage cavity and occupying a portion of the total volume, a remaining portion of the total volume occupied by a gas; a capillary member in fluid coupling with the store of the fluid, the capillary member extending through the housing; a vent tube comprising a primary vent passageway and a plurality of vent apertures, each of the vent apertures forming a passageway between the storage cavity and the primary vent passageway, the primary vent passageway forming a pathway between each of the vent apertures and an external atmosphere, and the vent apertures configured such that the fluid cannot flow through the vent apertures at ambient temperature and pressure equilibrium between the storage cavity and the external atmosphere; and the vent apertures located and arranged on the vent tube such that irrespective of vertical and angular orientation of the housing relative to a gravitational vector at least one of the vent apertures is in spatial communication with the gas.

In another aspect, the invention may be a fluid supply apparatus comprising: a housing defining a storage cavity extending along a cavity axis from a first end to a second end; a capillary member having a portion in the storage cavity and a portion extending through the housing; a vent tube comprising a primary vent passageway and a plurality of vent apertures, each of the vent apertures forming a passageway between the storage cavity and the primary vent passageway, the primary vent passageway forming a pathway between each of the vent apertures and an external atmosphere, the vent apertures comprising a plurality of first vent apertures radially spaced from the cavity axis and arranged in a spaced apart manner to circumferentially surround the cavity axis.

The fluid supply apparatus may be located within a handle of an oral care implement such the housing of the fluid supply apparatus forms a portion of the handle or is formed by the handle.

In another aspect, the present invention may be directed to a liquid supply apparatus with leakage protection. The apparatus includes a housing defining a storage cavity having a total volume including a liquid portion and a gas portion. The storage cavity extends along a cavity axis. A capillary member is fluidly coupled with the liquid to transport the liquid to the external atmosphere. The apparatus includes a plurality of vents that prevent liquid from flowing therethrough while permitting air to pass therethrough. A hub component is mounted within the storage cavity and it includes a plurality of radial vent passageways extending between the storage cavity and a primary vent passageway, which in turn forms a pathway to the external atmosphere. The vents may be located and arranged such that irrespective of inclination and rotational orientation of the housing relative to a gravitational vector at least one of the vents is in spatial communication with the gas.

In one aspect, the invention may be a liquid supply apparatus comprising: a housing defining a storage cavity having a total volume, the storage cavity extending along a cavity axis from a first end to a second end; a store of a liquid in the storage cavity and occupying a portion of the total volume, a remaining portion of the total volume occupied by a gas; a capillary member in liquid coupling with the store of the liquid, the capillary member extending through the housing and configured to transport the liquid from the store to an external atmosphere via capillary action; a plurality of vents, each of the vents configured such that the liquid cannot flow therethrough at ambient temperature and pressure equilibrium between the storage cavity and the external atmosphere, the vents comprising a plurality of radial vent passageways; a hub component mounted within the storage cavity; the hub component comprising the radial vent passageways, each of the radial vent passageways extending between the storage cavity and a primary vent passageway, the primary vent passageway forming a pathway between each of the radial vent passageways and the external atmosphere; and the vents located and arranged such that irrespective of inclination and rotational orientation of the housing relative to a gravitational vector at least one of the vents is in liquid communication with the gas.

In another aspect, the invention may be a liquid supply apparatus comprising: a housing defining a storage cavity extending along a cavity axis from a first end to a second end; a capillary member extending through the housing and configured to transport liquid via capillary action; a hub component mounted within the storage cavity, the hub component comprising radial vent passageways, each of the radial vent passageways extending between the storage cavity and a primary vent passageway, the primary vent passageway forming a pathway between each of the radial vent passageways and an external atmosphere; at least one upper vent adjacent the first end of the storage cavity; and at least one lower vent located adjacent the second end of the storage cavity The liquid supply apparatus may be located within a handle of a personal care implement so that an applicator of the personal care implement is fluidly coupled to the capillary member.

In another aspect, the present invention may be directed to a fluid supply apparatus with leakage protection. The apparatus includes a housing defining a storage cavity having a total volume that includes a fluid occupying a portion of the total volume and a gas occupying the remainder of the total volume. The storage cavity extends along a cavity axis from a first end to a second end. A capillary member is fluidly coupled with the fluid. A plurality of vent apertures are formed into the housing, each forming a passageway between the storage cavity and an external atmosphere and each configured such that the fluid cannot flow through the vent apertures at ambient temperature and pressure equilibrium between the storage cavity and the external atmosphere. The vent apertures may be located and arranged on the housing such that irrespective of vertical and angular orientation of the housing relative to a gravitational vector at least one of the vent apertures is in spatial communication with the gas within the storage cavity.

In one aspect, the invention may be a fluid supply apparatus comprising: a housing defining a storage cavity having a total volume, the storage cavity extending along a cavity axis from a first end to a second end; a store of a fluid in the storage cavity and occupying a portion of the total volume, a remaining portion of the total volume occupied by a gas; a capillary member in fluid coupling with the store of the fluid, the capillary member extending through the housing; a plurality of vents apertures in the housing, each of the vent apertures forming a passageway between the storage cavity and an external atmosphere and configured such that the fluid cannot flow through the vent apertures at ambient temperature and pressure equilibrium between the storage cavity and the external atmosphere; and the vent apertures located and arranged on the housing such that irrespective of vertical and angular orientation of the housing relative to a gravitational vector at least one of the vent apertures is in spatial communication with the gas.

In another aspect, the invention may be a fluid supply apparatus comprising: a housing defining a storage cavity extending along a cavity axis from a first end to a second end; a capillary member in fluid coupling with the store of the fluid, the capillary member extending through the housing; a plurality of vents apertures in the housing, the vent apertures comprising: a plurality of first vent apertures in a sidewall of the housing and arranged in a spaced apart manner to circumferentially surround the cavity axis; at least one second vent aperture located adjacent the first end of the cavity; and at least one third vent aperture located adjacent the second end of the cavity.

The fluid supply apparatus may be located within a handle cavity of a handle of an oral care implement such that a gap is formed between an outer surface of the housing of the fluid supply apparatus and an inner surface of the handle of the oral care implement. The vent apertures of the fluid supply apparatus may be in spatial communication with the gap such that at least one handle vent aperture forms a passageway between the storage cavity and an external atmosphere.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
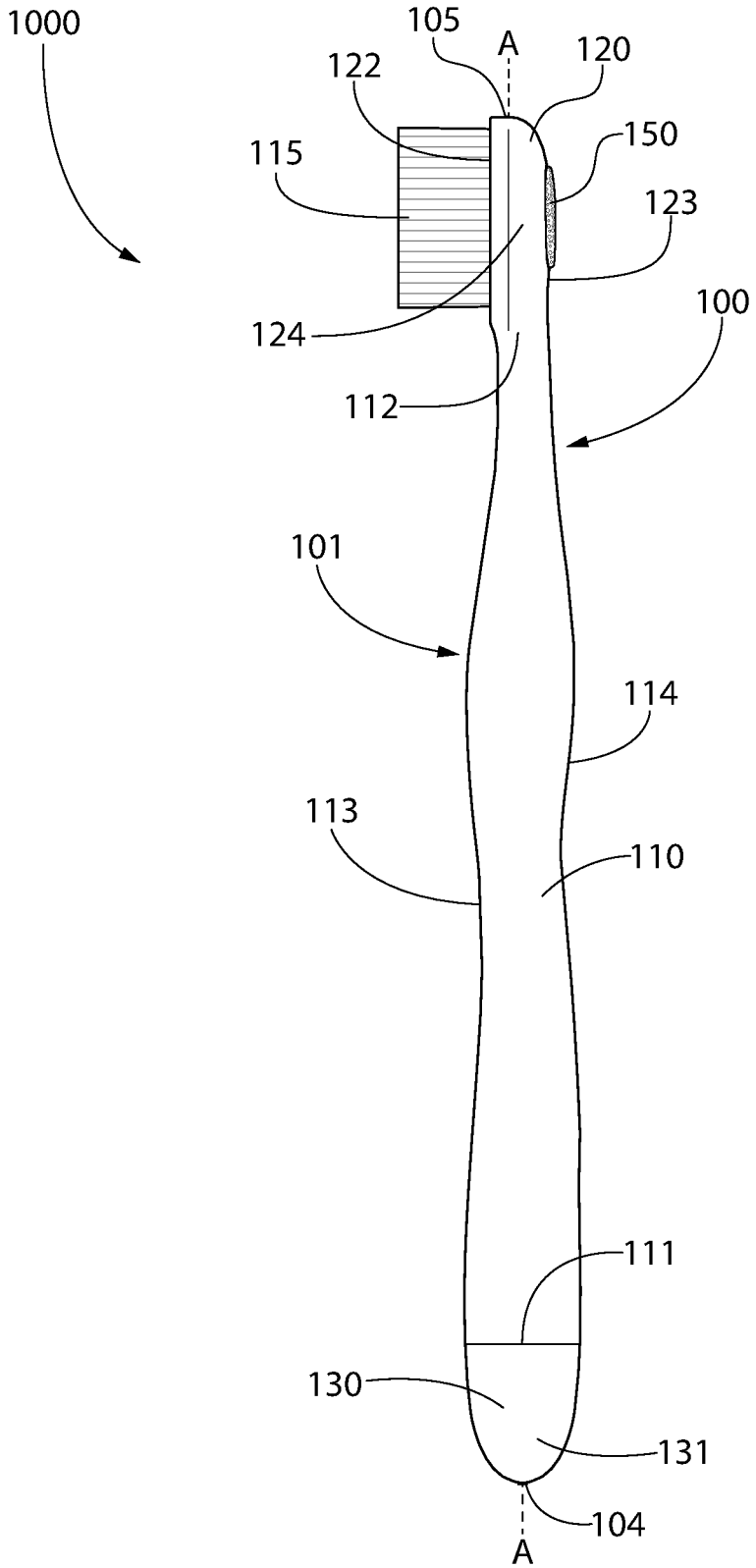
FIG. 1 is side view of a personal care implement in accordance with an embodiment of the present invention.
Figure 2:
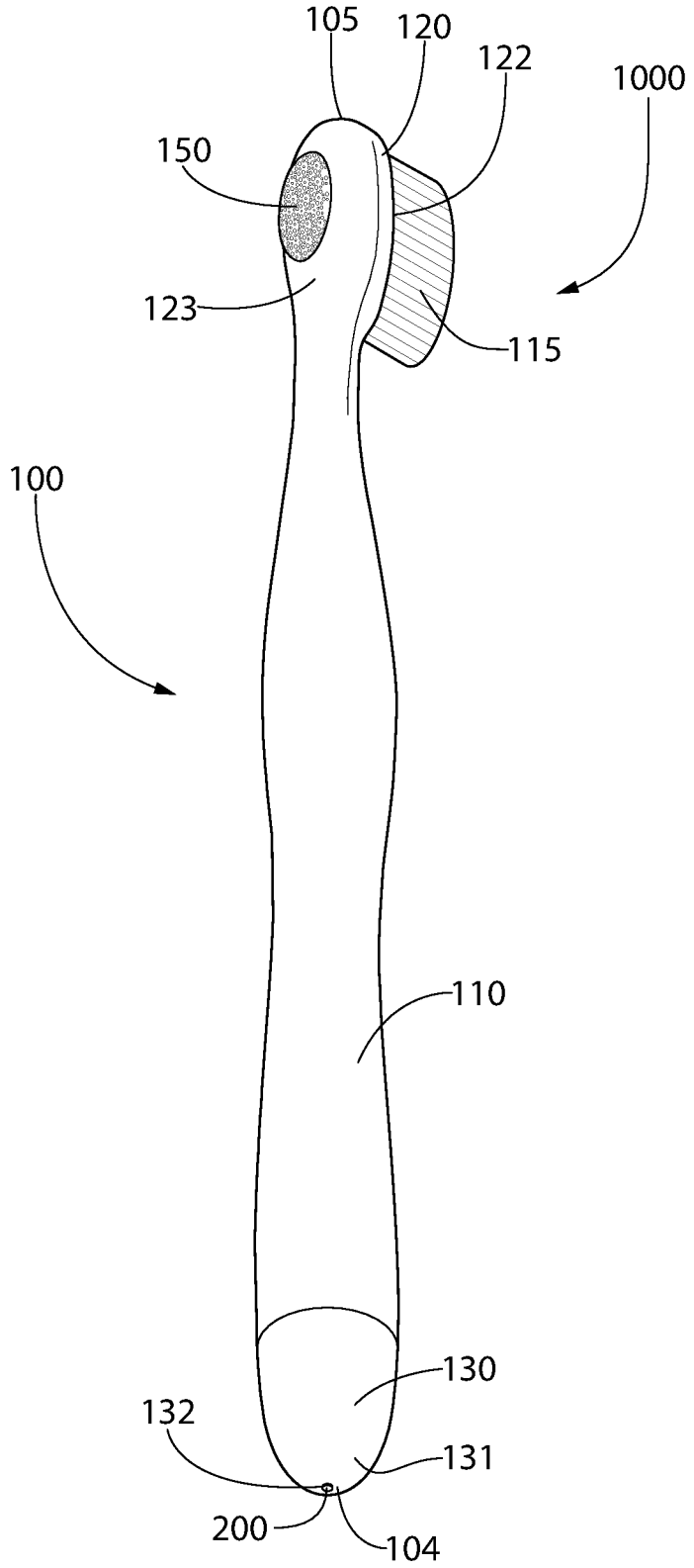
FIG. 2 is a rear perspective view of the personal care implement of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIGS. 1-5B, a fluid supply apparatus 1000 is illustrated in accordance with an embodiment of the present invention. In the exemplified embodiment, the fluid supply apparatus 1000 is in the form of a personal care implement 100, or stated another way the personal care implement 100 comprises the fluid supply apparatus 1000. The fluid supply apparatus 1000, or the personal care implement 100 comprising the same, is designed to store a fluid and to dispense the fluid onto a desired surface. As used herein, the term fluid is includes liquids and excludes gases. The fluid supply apparatus 1000 includes mechanisms that facilitate flow of the fluid from its stored location to another location at which the fluid is dispensed in a desired manner. As described more fully herein, the fluid supply apparatus 1000 is specifically configured to prevent fluid leakage regardless of the orientation at which the fluid supply apparatus 1000 is held under any normal usage and storage conditions including through changes in temperature and pressure. Although described herein as being a part of a personal care implement, the invention is not to be so limited and the fluid supply apparatus 1000 may be a stand-alone device that is not tied to a particular product type or it may be formed as a part of a different type of product.

In the exemplified embodiment, the personal care implement 100 is an oral care implement, and more specifically a manual toothbrush. Thus, the invention will be described herein with the details predominately directed to a toothbrush. However, in certain other embodiments the personal care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims. Furthermore, in some embodiments the invention is directed solely to the fluid supply apparatus 1000. Thus, the fluid supply apparatus 1000 may be included as a part of the personal care implement 100 or it may be a separate, stand-alone device. When a stand-alone device, the fluid supply apparatus 1000 may include some type of applicator so that the fluid/liquid dispensed from the fluid supply apparatus 1000 can be properly applied to a desired surface.

In the exemplified embodiment, the personal care implement 100 generally includes a body 101 comprising a handle 110 and a head 120 and an end cap 130 that is detachably coupled to the handle 110. The personal care implement 100 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. In the exemplified embodiment, the end cap 130 is detachably coupled to the proximal end 111 of the handle 120. Specifically, the handle 120 has an opening 116 at the proximal end 111 thereof and the end cap 130 is coupled to the proximal end 111 of the handle 120 and closes the opening 116. The end cap 130 may be detachable from the handle 120 so that a fluid or oral care material can be stored within the body 101 and can be refilled by detaching the end cap 130 from the handle 110 to provide access, via the opening 116, to a cavity/reservoir within the body 101 within which the fluid may be stored. Furthermore, in certain embodiments the end cap 130 may be altogether omitted and the proximal end 111 of the body 101 may form a closed bottom end of the personal care implement 100. In such embodiments, refill of the reservoir may not be possible or may occur through other mechanisms/structures as would be understood to persons skilled in the art.

The handle 110 is an elongated structure that provides the mechanism by which the user can hold and manipulate the personal care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the personal care implement 100 is coupled to the handle 110 and comprises a front surface 122, an opposing rear surface 123, and a peripheral surface 124 extending between the front and rear surfaces 122, 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the personal care implement 100 is provided with a plurality of tooth cleaning elements 115 extending from the front surface 122. Of course, depending on the particular type of device selected for the personal care implement 100, the tooth cleaning elements 115 may be replaced with some other bristle-like elements (for example when the personal care implement 100 is a hairbrush or a mascara applicator) or may be altogether omitted.

In the exemplified embodiment the tooth cleaning elements 115 are generically illustrated. In certain embodiments the exact structure, pattern, orientation and material of the tooth cleaning elements 115 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 3:
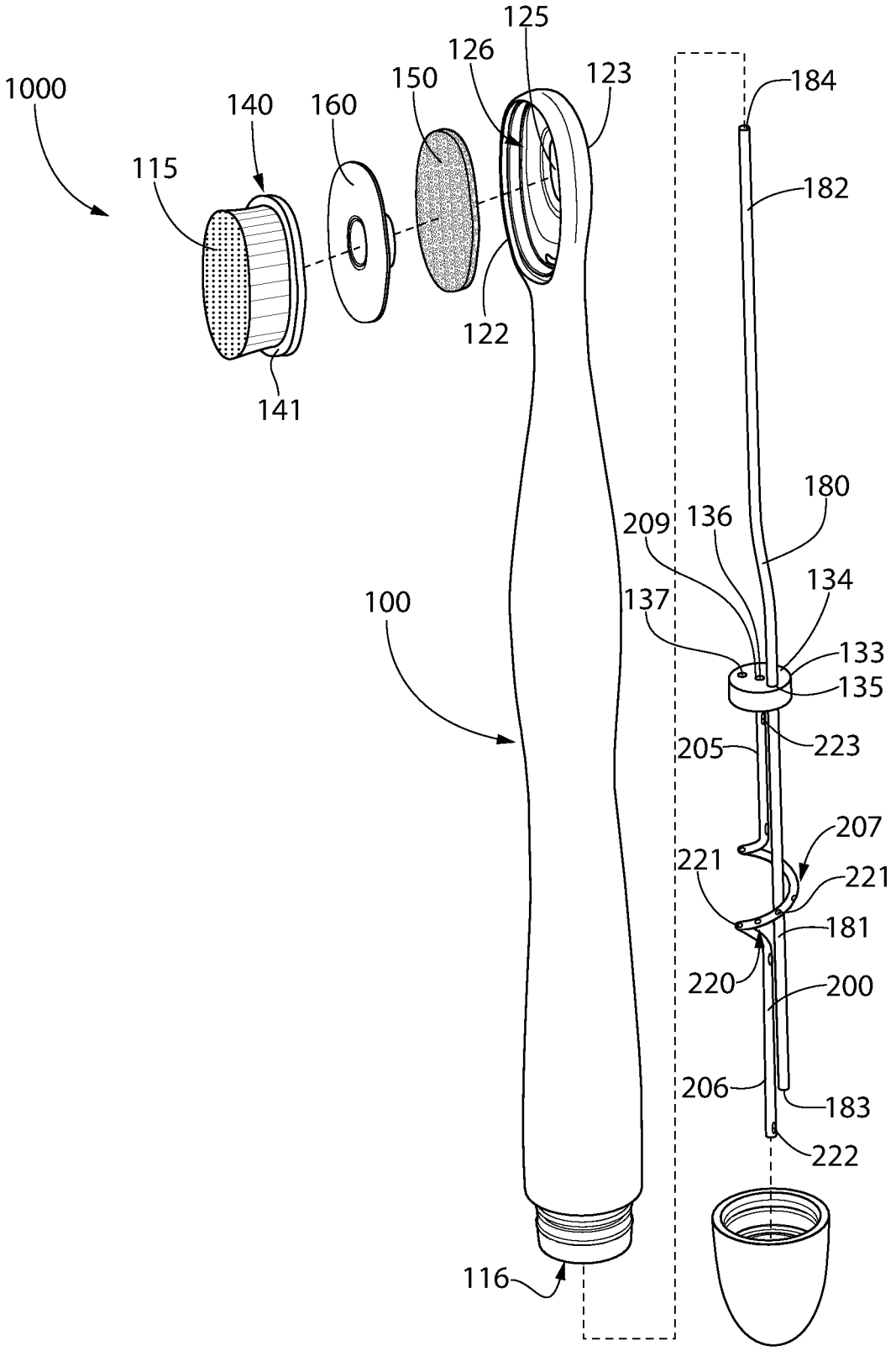
FIG. 3 is an exploded front perspective view of the personal care implement of FIG. 1.
Figure 4:
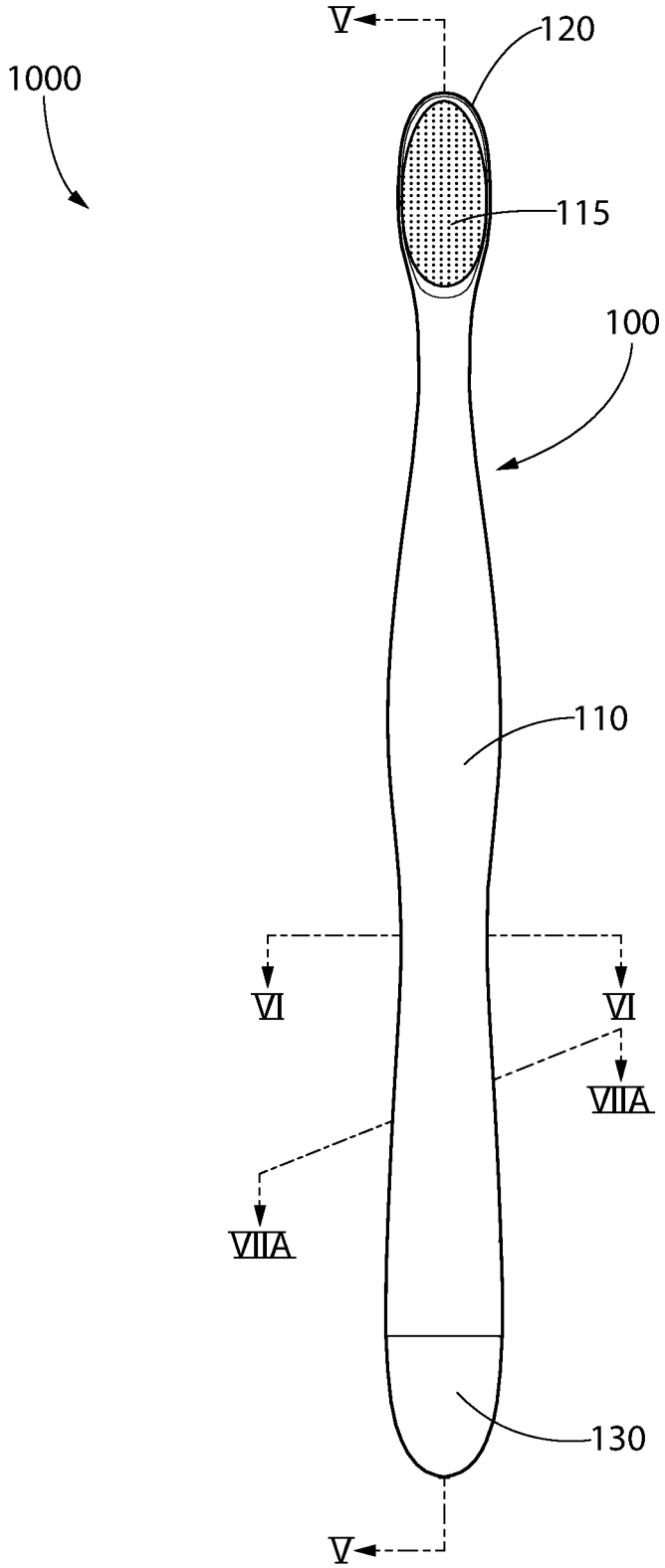
FIG. 4 is a front view of the personal care implement of FIG. 1.
Figure 5A:
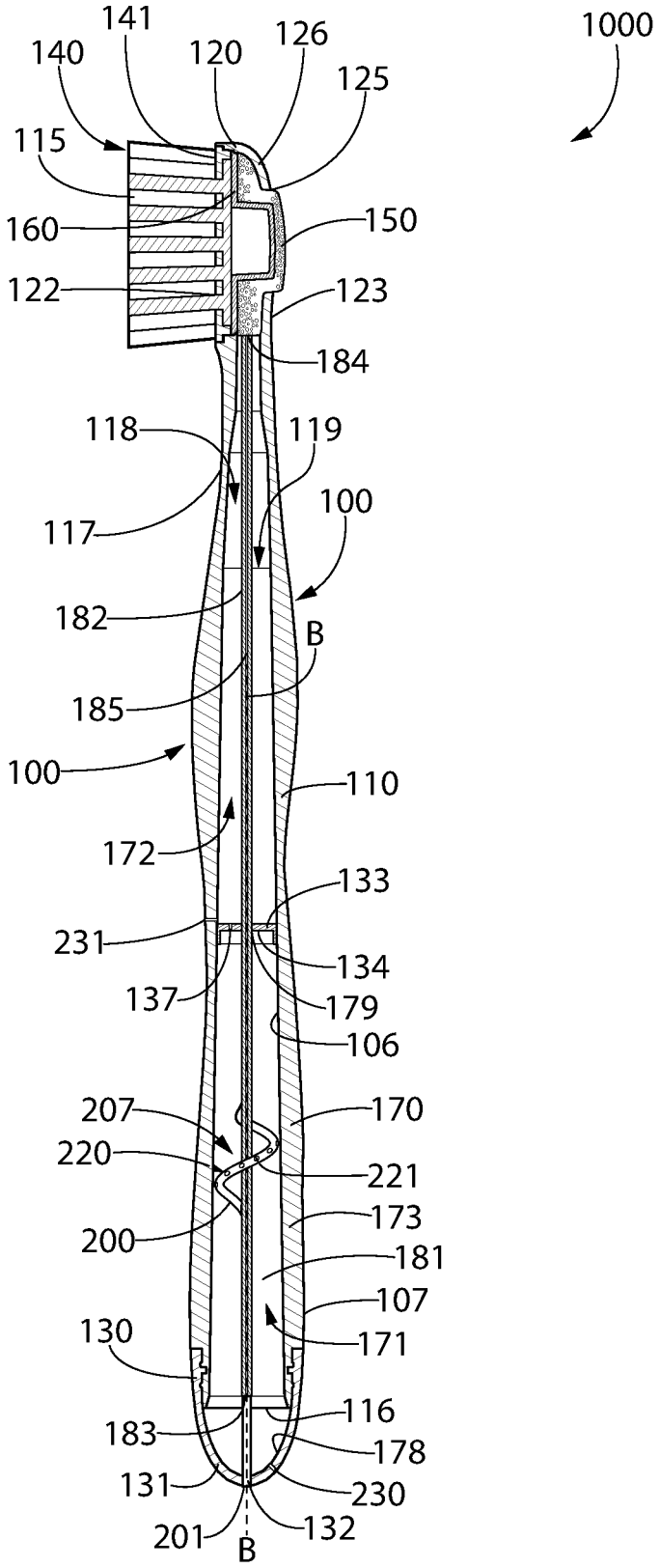
FIGS. 5A and 5B are cross-sectional views taken along line V-V of FIG. 4.
Figure 5B:
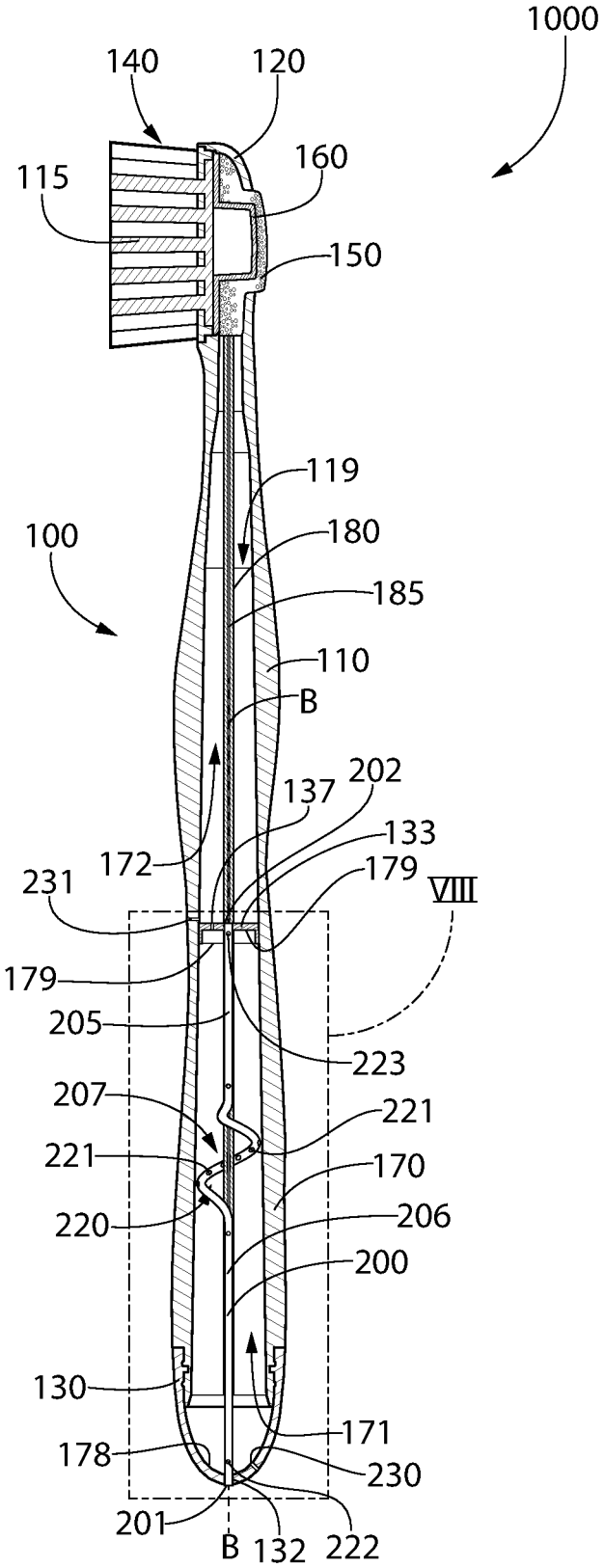

Referring briefly to FIGS. 3 and 5A, in the exemplified embodiment the tooth cleaning elements 115 are formed on a cleaning element assembly 140 that comprises a head plate 141 and the tooth cleaning elements 115 mounted thereon. In such an embodiment, the head plate 141 is a separate and distinct component from the body 101 of the personal care implement 100. However, the head plate 141 is connected to the body 101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 141 and the body 101 are separately formed components that are secured together during manufacture of the personal care implement 100. More specifically, the tooth cleaning elements 115 are secured to the head plate 141 in a manner known in the art (i.e., anchor free tufting or AFT) to form the cleaning element assembly 140, and then the cleaning element assembly 140 is coupled to the head 120. Alternatively, the tooth cleaning elements 115 may be connected to the head 120 using AMR techniques, stapling, or the like. The invention is not to be particularly limited by the manner in which the tooth cleaning elements 115 are coupled to the head 120 in all embodiments.

Although not illustrated herein, in certain embodiments the head 120 may also include a soft tissue cleanser coupled to or positioned on its rear surface 123. An example of a suitable soft tissue cleanser that may be used with the present invention and positioned on the rear surface 123 of the head 120 is disclosed in U.S. Pat. No. 7,143,462, issued Dec. 5, 2006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 100 may not include any soft tissue cleanser.

Referring again to FIGS. 1-5B concurrently, in the exemplified embodiment the personal care implement 100 comprises an applicator 150 protruding from the rear surface 123 of the head 120. More specifically, the head 120 has an opening 125 that extends from the rear surface 123 of the head 120 into a basin cavity 126 of the head 120. The applicator 150 is inserted into the basin cavity 126 of the head 120 and extends through the opening 125 and protrudes from the rear surface 123 of the head 120. Thus, during use of the personal care implement 100 to brush teeth, the applicator 150 will engage/contact the user's oral surfaces and dispense a fluid thereon as discussed in more detail below. The personal care implement 100 may also include a divider member 160 that divides the basin cavity 126 into an upper chamber and a lower chamber such that the cleaning element assembly 140 is located in the upper chamber and the applicator 150 is located in the lower chamber. The divider member 160 may seal the applicator 150 within the lower chamber so that any fluid loaded on the applicator 150 does not pass into the upper chamber.

The applicator 150 may be formed of a capillary material that is capable of being loaded with a fluid (i.e., a liquid) that can be dispensed from the applicator 150 when the applicator 150 is compressed. For example, the applicator 150 may be a porous foam such as including without limitation a polyurethane foam or other open cell porous material. Thus, in the exemplified embodiment the applicator 150 can be formed of any type of material through which a liquid can travel via capillary action or capillary flow. Specifically, the capillary material can be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. Furthermore, although described herein as being formed of a capillary material, the invention is not to be so limited in all embodiments and some alternative embodiments will be described herein below. For example, in certain embodiments the applicator 150 may be formed of a plastic material or a rubber material and may have an orifice formed therethrough to enable the fluid to flow through the applicator for application to a biological surface such as a user's oral cavity, facial surfaces, or the like.

The fluid supply apparatus 1000 generally comprises a housing 170 that defines a storage cavity 171 for storing a fluid/liquid that is dispensed via the applicator 150 as described herein, a capillary member 180, and a vent tube 200. The storage cavity 171 extends along a cavity axis B-B from a first end 178 to a second end 179. The storage cavity 171 is designed to hold a store of a fluid/liquid as discussed in greater detail below with reference to FIGS. 8A-8D. The capillary member 180 is designed to flow or otherwise transport the fluid/liquid from the storage cavity 171 to the applicator 150 or other desired location for dispensing onto a desired surface. The vent tube 200 is designed to permit air to replace fluid/liquid that is dispensed from the storage cavity during use to ensure consistent fluid flow and to vent the storage cavity 171 to prevent air from expanding within the storage cavity 171 and causing the fluid to leak out in an undesired manner.

In the exemplified embodiment, the housing 170 forms a portion of the handle 110 of the personal care implement 100. However, the invention is not to be so limited in all embodiments and the housing 170 could be a separate component from the handle 110 in other embodiments. For example, in one alternative embodiment the housing 170 could be a stand-alone device such as a cartridge that is insertable into a cavity of the handle 110 of the personal care implement 100. In such an embodiment the housing 170 would not form any portion of the handle 110, but rather it would be wholly retained therein. In another embodiment the housing 170 could be a stand-alone device that operates independently without being inserted into any separate product (such as the personal care implement 100). Thus, the housing 170 could include all features for storing the fluid and it may be coupled to or include additional features, such as an applicator, for applying the fluid to a desired surface without being coupled to or forming a part of a personal care implement.

In the exemplified embodiment the housing 170 comprises a tubular sidewall 173 that forms a portion of a gripping section of the handle 110, a first end wall 131 that forms the proximal end 104 of the personal care implement 100 (and also of the handle 110), and a divider component 133 having a second end wall 134 located within the interior of the handle 110. Specifically, the divider component 133 may be a separate component from the handle 110 and the housing 170 that is inserted into the handle 110 to form the upper-most bounds of the storage cavity 171. The divider component 133 may be formed of a rigid plastic material similar to the materials used to form the handle 110, or it may be formed from other materials such as rubber or other elastomeric materials. The divider component 133 may be securely placed within the interior of the handle 110 so that it is fixed relative to the handle 110 and forms a fixed upper boundary of the storage cavity 171. Techniques for fixing the divider component 133 within the handle 110 include interference fit, friction fit, protuberance/detent, adhesion, mechanical interlocking, or the like. In the exemplified embodiment because the housing 170 forms a portion of the handle 110, an inner surface 106 of the handle 110 is also the inner surface of the tubular sidewall 173 of the housing 170.

In the exemplified embodiment, the handle 110 defines an internal cavity 118 throughout its entire length. Thus, a large portion of the handle 110 is hollow thereby forming the internal cavity 118 of the handle 110. A first portion of the internal cavity 118 of the handle 110 forms the storage cavity 171 and a second portion of the internal cavity 118 of the handle 110 forms a venting cavity 119. The divider component 133 separates the storage cavity 171 from the venting cavity 119 while leaving the storage cavity 171 and the venting cavity 119 in spatial communication with one another either directly or via the venting tube 200.

Thus, in the exemplified embodiment, with the housing 170 forming a portion of the handle 110 of the personal care implement 100, the inner surface 106 of the handle 110 (which is also the inner surface of the housing 170) defines the storage cavity 171. The storage cavity 171 is closed at its bottom end via the end cap 130 that closes the opening 116 at the proximal end 111 of the handle 110. Specifically, the end cap 130 comprises the first end wall 131 that forms the proximal end 111 of the handle 110. In other embodiments the end cap 130 may be omitted but the handle 110 may nonetheless include the first end wall 131 that forms the proximal end 111 of the handle 110 and closes the bottom end of the storage cavity 171. As discussed in greater detail below, there is an opening at the top end of the storage cavity 171 that spatially couples the storage cavity 171 to the opening 125 in the head 120. More specifically, the storage cavity 171 is spatially coupled to the opening 125 in the head 120 via a passageway 172 that extends through the handle 110 and a neck region 117 of the personal care implement 100.

As noted above, the divider component 133 is inserted into the internal cavity 118 of the handle 110 to divide the internal cavity 118 into the storage cavity 171 and the venting cavity 119. The capillary member 180 is located in both the storage cavity 171 and the venting cavity 119. In that regard, the divider component 133 has a first opening 135 through which the capillary member 180 extends out of the housing 170 (i.e., out of the storage cavity 171) and into the neck region 117 of the personal care implement 100 (i.e., into the venting cavity 119 and the passageway 172). The divider component 133 has a second opening 136 into which the vent tube 200 extends. The divider component 133 may also include a third opening (i.e., a vent opening 137) that forms a vent aperture for venting the storage cavity 171 as discussed in more detail below. Specifically, the vent opening 137 in the divider member 133 forms a passageway between the storage cavity 171 and the venting cavity 119 to place the storage cavity 171 and the venting cavity 119 into spatial communication with one another so that air/gas can flow therebetween. The venting cavity 119 is vented to (i.e., in spatial communication with) the exterior environment via a handle vent aperture 231 as discussed more fully below. Of course, in certain embodiments the vent opening 137 may be omitted and air/gas flow between the storage cavity 171 and the venting cavity 119 may be achieved via the vent tube 200 as described in more detail below.

In the exemplified embodiment, an opening 132 is formed into the personal care implement 100 at the proximal end 104 thereof. Specifically, in the exemplified embodiment the opening 132 is formed into the bottom end of the end cap 130. However, if the end cap 130 were omitted the opening 132 would merely be formed into the proximal end 104 of the personal care implement 100. Alternatively, the opening 132 may be recessed relative to the proximal end 104 of the personal care implement 100 to prevent clogging from debris. In the exemplified embodiment, the vent tube 200 is positioned within the housing 170 so a first end 201 thereof extends into the opening 132 and an opposite second end 202 thereof extends into the second opening 136 of the divider component 133. As discussed in more detail below, the vent tube 200 may have a passageway extending entirely through it that terminates at openings 208, 209 in each of its opposing ends 201, 202. Thus, the opening 132 places the passageway of the vent tube 200 into spatial communication with the external environment at the first end 201 of the vent tube 200 and the second opening 136 in the divider component 133 places the passageway of the vent tube 200 into spatial communication with external environment via the venting cavity 119 at the second end 202 of the vent tube 200.

The capillary member 180 extends from a first end 183 that is located within the storage cavity 171 and fluidly coupled to the fluid stored in the storage cavity 171 to a second end 184 that is fluidly coupled to the applicator 150. Thus, the capillary member 180 transports the fluid from the storage cavity 171 of the housing 170 to the applicator 150 as described herein. In the exemplified embodiment, the vent tube 200 is aligned with the cavity axis B-B (with the exception of offset portions of the vent tube 200 as described below) and the capillary member 180 is entirely offset relative to the cavity axis B-B. Thus, in the exemplified embodiment the capillary member 180 may extend along a longitudinal axis that is parallel to or slightly angled relative to (up to about 5°) the cavity axis B-B while not being located directly on the cavity axis B-B. In other embodiments, the capillary member 180 may be located on the cavity axis B-B and the vent tube 200 may be offset from the cavity axis B-B.

The capillary member 180 is at least partially located within the storage cavity 171 so that the capillary member 180 is fluidly coupled to the store of the fluid (i.e., liquid) that is located within the storage cavity 171. Specifically, the capillary member 180 has a first portion 181 that includes the first end 183 that is located within the storage cavity 171. The capillary member extends through the first opening 135 in the divider component 133 so that a second portion 182 of the capillary member 180 that includes the second end 184 is located within the venting cavity 119 and the passageway 172 in the neck region 117. More specifically, the capillary member 180 extends from the housing 170 and through the passageway 172 in the neck region 117 of the personal care implement 100 to the applicator 150 so that the capillary member 180 can draw fluid from the store of the fluid in the storage cavity 171 and transport that fluid to the applicator 150 where it can be dispensed at an appropriate time and location.

Figure 6:
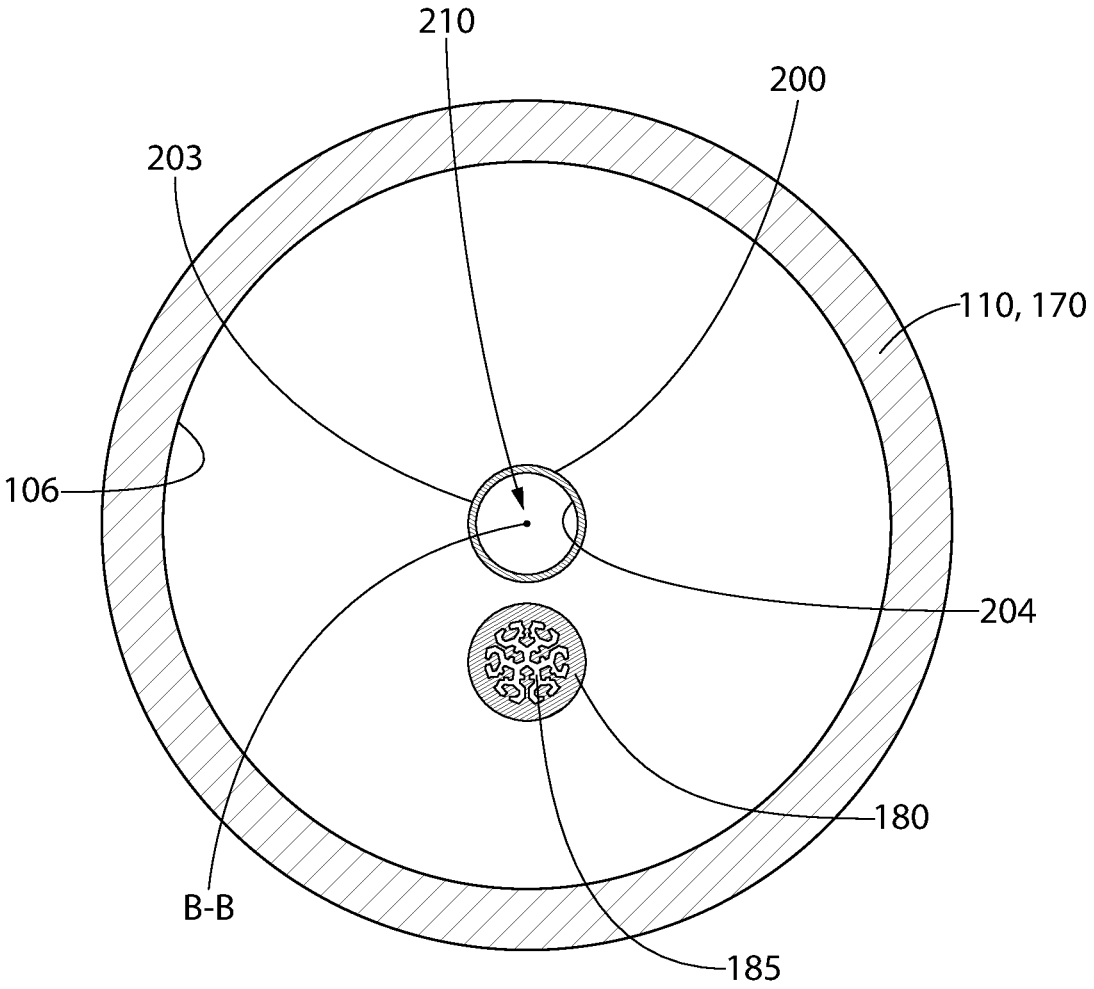
FIG. 6 is a schematic cross-sectional view taken along line VI-VI of FIG. 4.
Figure 7:
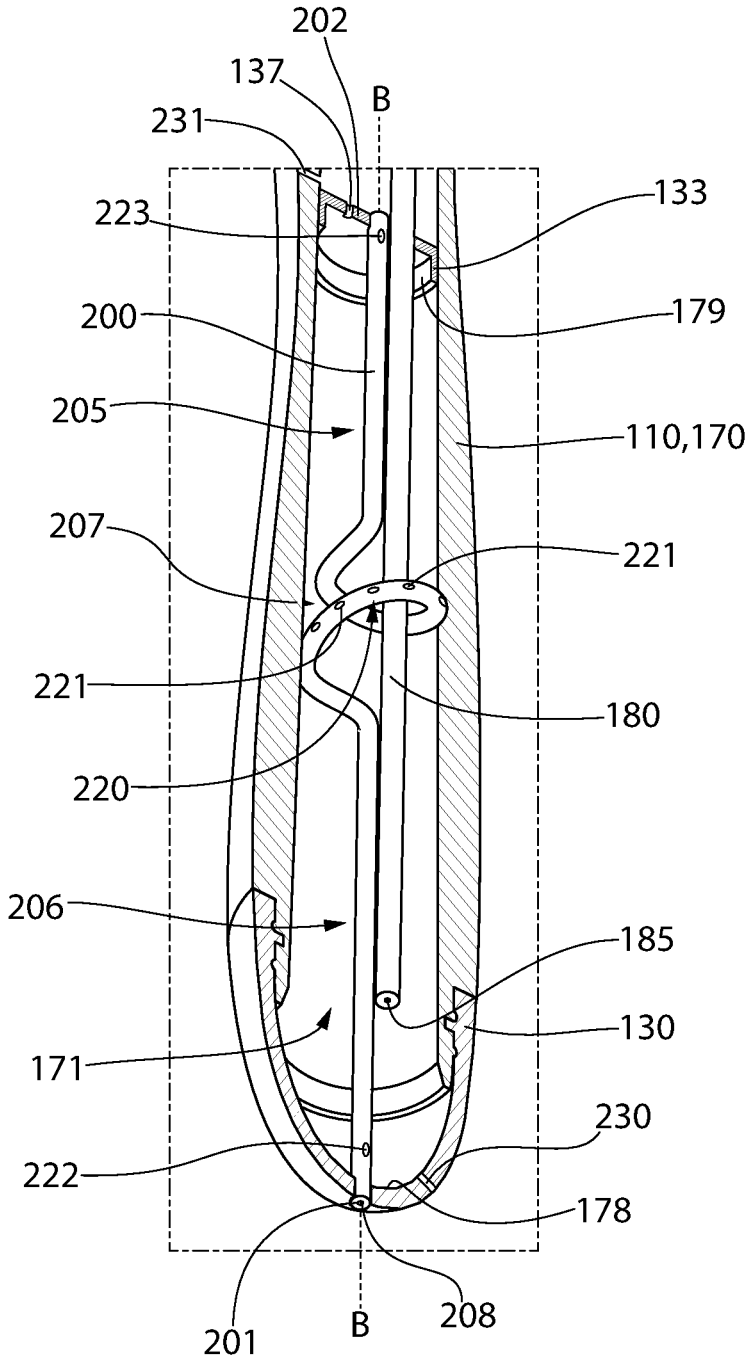
FIG. 7 is a partial cut-away view of a portion of the personal care implement of FIG. 1.
Figure 7A:
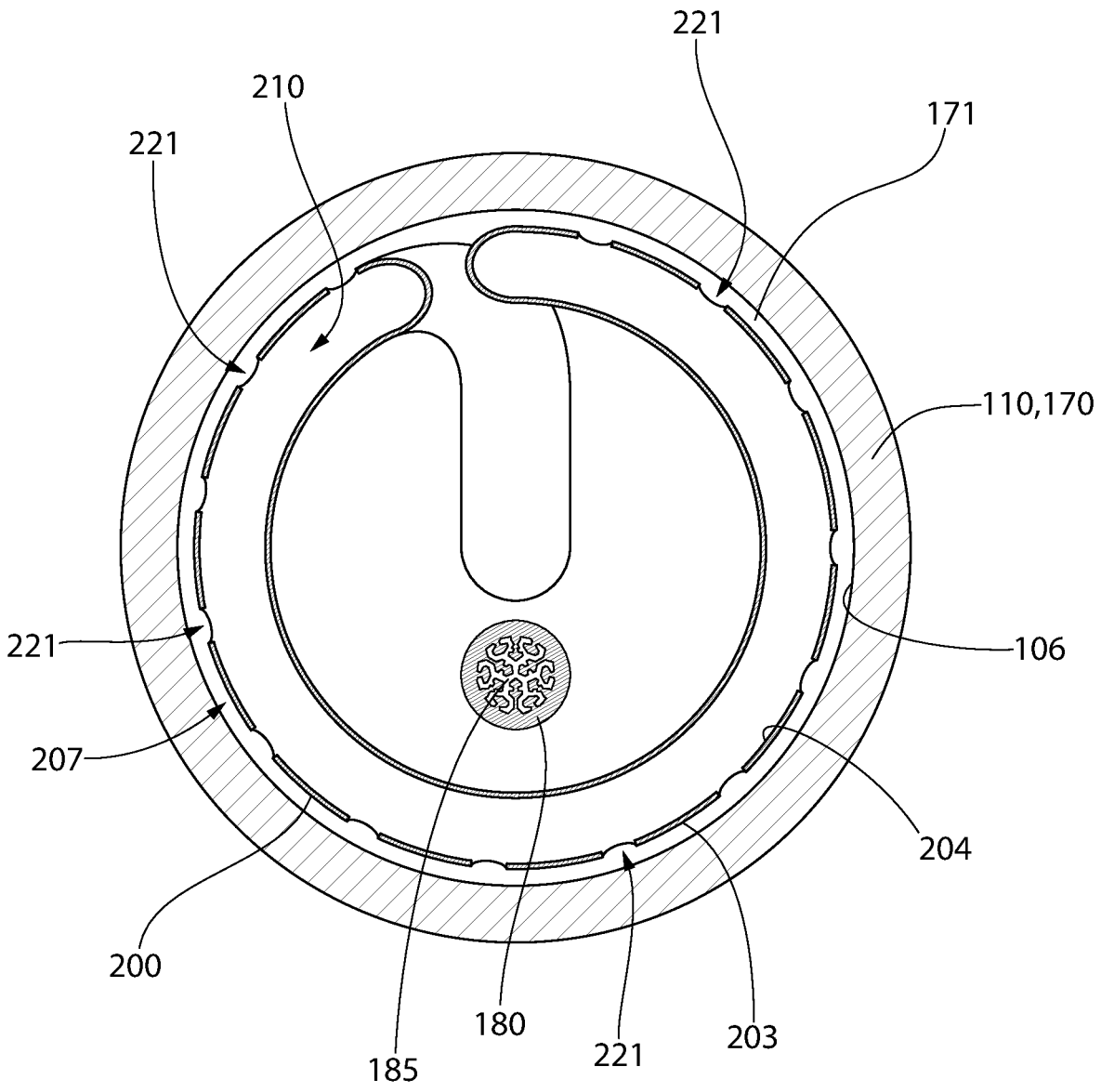
FIG. 7A is a schematic cross-sectional view taken along line VIIA-VIIA of FIG. 4.

In the exemplified embodiment, the capillary member 180 is a capillary tube having a capillary passageway 185 extending entirely through the capillary member 180 from the first end 183 to the second end 184 that permits the fluid to flow within the capillary member 180 from the first end 183 to the second end 184 via a wicking action. Thus, in this manner the fluid is able to flow from its storage location within the storage cavity 171 of the housing 170 to the applicator 150 so that the applicator 150 can be loaded with the fluid. Specifically, the passageway 185 may have a cross-sectional size and shape that permits flow of the fluid all the way from the storage cavity 171 to the applicator 150 to ensure that the applicator 150 remains loaded with the fluid (see, e.g., FIG. 6). In other embodiments, the capillary member 180 may be formed of a porous material, such as any of the materials described above with reference to the applicator 150. In such embodiments the fluid may flow up the capillary member 180 via a wicking action (also referred to herein as capillary action) due to the material of the capillary member 180 (for example if the capillary member 180 is formed from a porous material). In either embodiment, the flow of the fluid occurs naturally via capillary action without the need for a separate pump.

In certain embodiments, the capillary member 180 has a capillary structure which may be formed in numerous configurations and from numerous materials operable to produce fluid flow via capillary action. In one non-limiting embodiment, the capillary member 180 may be configured as a tube or lumen having an internal open capillary passageway extending between ends of the capillary member which is configured and dimensioned in cross section to produce capillary flow. The lumen or open capillary passageway may have any suitable cross sectional shape and configuration. In such embodiments the capillary member 180 may be formed of a porous material as described below or a non-porous material (e.g., plastics such as polypropylene, metal, rubber, or the like). In other non-limiting embodiments, capillary member 180 may be formed of a porous and/or fibrous material of any suitable type through which a fluid can travel via capillary action or flow. Examples of suitable materials include without limitation fibrous felt materials, ceramics, and porous plastics with open cells (e.g. polyurethane, polyester, polypropylene, or combinations thereof) including such materials as those available from Porex Technologies, Atlanta, Ga. The capillary member material may therefore be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. A mixture of porous and/or fibrous materials may be provided which have a distribution of larger and smaller capillaries. The capillary member 180 can be formed from a number of small capillaries that are connected to one another, or as a larger single capillary rod. The capillary member whether formed as a lumen or of porous or fibrous materials may have any suitable polygonal or non-polygonal cross sectional shape including for example without limitation circular, elliptical, square, triangular, hexagonal, star-shaped, etc. The invention is not limited by the construction, material, or shape of the capillary member.

In the exemplified embodiment, the capillary member 180 has openings into the passageway 185 only at the first end 183 thereof and at the second end 184 thereof. There are no other openings along the length of the first portion 181 of the capillary member 180 that permit the fluid to enter into the passageway 185 of the capillary member 180. Thus, the fluid within the storage cavity 171 can only enter into the passageway 185 of the capillary member 180 through the opening in the first end 183 of the capillary member 180. Thus, in certain orientations of the housing 170 and certain fluid levels within the storage cavity 171, the fluid is unable to enter into the passageway 185 of the capillary member 180 because it is not in contact with the opening in the first end 183 of the capillary member 180. Of course, in other embodiments additional openings may be provided in the capillary member 180 through which fluid can enter into the passageway 185 of the capillary member 180.

Referring to FIGS. 3 and 5A-7A concurrently, the vent tube 200 will be described in greater detail. As noted above, the vent tube 200 is at least partially located within the storage cavity 171. Specifically, in the exemplified embodiment the vent tube 200 extends from the first end 201 that extends into the opening 132 at the proximal end 104 of the personal care implement 100 to the second end 202 that extends into the second opening 136 in the divider component 133. Of course, the invention is not to be so limited in all embodiments and in certain other embodiments only one of the first and second ends 201, 202 of the vent tube 200 may extend out of the storage cavity 171. Alternatively, one or both of the first and second ends 201, 202 may extend through an opening in the tubular sidewall 173 of the housing 170. However, the vent tube 200 should extend out of the storage cavity 171 on at least one end thereof because the purpose of the vent tube 200 is to vent the storage cavity 171 to the external atmosphere. As described in more detail below, the vent tube 200 creates an air intake/venting system that allows air to replace the fluid that is dispensed from the storage cavity 171 over time during use and allows air to exit the storage cavity 171 to prevent it from exerting pressure on any fluid in the storage cavity 171.

The vent tube 200 has an outer surface 203 and an inner surface 204. The outer surface 203 of the vent tube 200 forms a generally continuous exterior of the vent tube 200 except that it has vent apertures therein as described in more detail below. The inner surface 204 of the vent tube 200 defines a primary vent passageway 210 that extends entirely through the vent tube 200 from the first end 201 of the vent tube 200 to the second end 202 of the vent tube 200. In the exemplified embodiment, the vent tube 200 has a first opening 208 in the first end 201 thereof and a second opening 209 in the second end 202 thereof. Thus, the primary vent passageway 210 extends from the first opening 208 to the second opening 209. However, in alternative embodiments the vent tube 200 may only include one of the first and second openings 208, 209, but not both. An opening, whether it is one of the first and second openings 208, 209 or some other opening, is needed to be in spatial communication with the exterior atmosphere to facilitate proper operation of the vent tube 200 regardless of the orientation of the housing 170.

The vent tube 200 comprises an upper section 205, a lower section 206, and a middle section 207. Specifically, the upper section 205 is located axially above the middle section 207, which in turn is located axially above the lower section 206. Thus, the upper, lower, and middle sections 205, 206, 207 are each axial sections of the vent tube 200. In the exemplified embodiment, the upper and lower sections 205, 206 are linear sections of the vent tube 200 and they are arranged substantially parallel to the cavity axis B-B. More specifically, in the exemplified embodiment the upper and lower sections 205, 206 of the vent tube 200 are located on the cavity axis B-B. However, the invention is not to be so limited in all embodiments and the upper and lower sections 205, 206 of the vent tube 200 could be offset from but parallel to the cavity axis B-B. Furthermore, in other embodiments the upper and lower sections 205, 206 of the vent tube 200 may be slightly angled relative to the cavity axis B-B. Thus, the term "substantially" with regard to the upper and lower sections 205, 206 of the vent tube 200 being parallel to the cavity axis B-B includes them being slightly angled (up to about 5°) relative to the cavity axis B-B.

The middle section 207 of the vent tube 200 is located axially between the upper and lower sections 205, 206 of the vent tube 200. Furthermore, the middle section 207 of the vent tube 200 is radially offset relative to the upper and lower sections 205, 206 of the vent tube 200. More specifically, in the exemplified embodiment the middle section 207 of the vent tube 200 comprises a helical portion or forms a helical portion of the vent tube 200. Stated another way, in the exemplified embodiment the middle section 207 of the vent tube 200 is a radially offset section of the vent tube 200 that forms a loop that circumferentially surrounds the cavity axis B-B. Thus, within the middle section 207, the vent tube 200 is spaced further from the cavity axis B-B than within the upper and lower sections 205, 206.

The loop formed by the middle section 207 of the vent tube 200 may be oriented oblique to the cavity axis B-B. A portion of the outer surface 203 of the vent tube 200 within the middle section 207 of the vent tube 200 faces the inner surface 106 of the housing 170 in a closely spaced manner (best illustrated in FIG. 7A). Specifically, the portion of the outer surface 203 of the vent tube 200 may be spaced apart from the inner surface 106 of the housing 170 by between 0.5 mm and 2 mm. In the exemplified embodiment, the outer surface 203 of the vent tube 200 within the middle section 207 of the vent tube 200 is spaced further from the cavity axis B-B than the outer surface 203 of the vent tube 200 within the upper and lower sections 205, 206 of the vent tube 200. Maintaining the outer surface 203 of the vent tube 200 in close proximity to the inner surface 106 of the handle 110/housing 170 ensures proper venting regardless of the orientation of the handle 110 and/or the housing 170 by ensuring that a vent aperture of the vent tube 200 is spatially coupled to any air pockets within the storage cavity 171.

Although in the exemplified embodiment the upper and lower sections 205, 206 of the vent tube 200 are linear and parallel to the cavity axis B-B, the invention is not to be so limited in all embodiments. In some alternative embodiments the vent tube 200 may have a helical structure along its entire length such that it is formed by multiple loops each circumferentially surrounding the cavity axis B-B. In some embodiments, it is merely preferable that the vent tube 200 comprise at least one loop or helical portion that surrounds the cavity axis B-B and that has vent apertures therein as described directly below.

The vent tube 200 also comprises a plurality of vent apertures 220, each forming a passageway between the storage cavity 171 and the primary vent passageway 210. Specifically, each of the vent apertures 220 extends through the vent tube 200 from the outer surface 203 thereof to the inner surface 204 thereof. In the exemplified embodiment, the plurality of vent apertures 220 include a plurality of first vent apertures 221 located within the middle section 207 of the vent tube 200, at least one second vent aperture 222 located within the lower section 206 of the vent tube 200, and at least one third vent aperture 223 located within the upper section 205 of the vent tube 200. In the exemplified embodiment, the second vent aperture 222 is located adjacent to the first end 178 of the storage cavity 171 and the third vent aperture 222 is located adjacent to the second end 179 of the storage cavity 170. Furthermore, there may be additional vent apertures located at other locations along the vent tube 200. As will be discussed in greater detail below with reference to FIGS. 8A-8D, in some embodiments the second and third vent apertures 222, 223 could be omitted and venting when the handle 110 and/or the housing 170 are in vertical orientations (upright or upside-down) can be achieved using other apertures or venting means. Thus, in some embodiments the vent tube 200 may only include the first vent apertures 221 within the middle section 207 thereof.

The vent tube 200 and its vent apertures 220 along with some additional vent openings described herein operates as an air intake and venting system to allow air to replace the fluid (i.e., liquid) that is dispensed from the storage cavity 171 over time during use. Specifically, each of the vent apertures 220 forms a passageway from the storage cavity 171 to the primary vent passageway 210 of the vent tube 200, and the primary vent passageway 210 forms a passageway to the external atmosphere as described in more detail below. The loop or helical shape of the vent tube 200 at which the first vent apertures 221 are located ensures that the vent tube 200 is always spatially coupled to any air pockets within the storage cavity 171 to vent the air pockets to the external atmosphere regardless of the orientation of the housing 170. This helps to ensure consistent flow of the fluid during use and prevents uncontrolled fluid leakage regardless of the orientation at which the handle 110 and/or housing 170 is positioned and regardless of changes in temperature and pressure.

In certain embodiments, each of the vent apertures 220 is designed with a specific dimension/size tailored to the physical properties (e.g., viscosity and surface tension) of the fluid/liquid stored within the storage cavity 171 such that once system equilibrium is reached, the fluid cannot pass through the vent apertures 220 under normal usage conditions. Stated another way, each of the vent apertures 220 is configured such that a fluid within the storage cavity 171 cannot flow through the vent apertures 220 at ambient temperature and with a pressure equilibrium existing between the storage cavity 171 and the external atmosphere. However, at the same time the vent apertures 220 are designed to permit gas, such as air, within the storage cavity 171 to pass through the vent apertures 220. Specifically, as long as the vent apertures 220 are not clogged, the gas/air will be capable of freely passing through the vent apertures 220 both into and out of the storage cavity 171 as needed (during periods of compression and expansion or the gas) to provide proper air intake and venting to ensure proper operation of the device (i.e., consistent fluid flow during use) without leakage.

The vent apertures 220 may be configured to prevent the fluid stored within the storage cavity 171 from passing therethrough at ambient temperature and with a pressure equilibrium existing between the storage cavity 171 and the external atmosphere in several ways. First, this may be accomplished by specifically selecting the dimensions of the vent apertures 220, based on the viscosity and surface tension of the fluid, to ensure that the fluid cannot pass through the vent apertures 220 under the conditions noted above. For example without limitation, in one embodiment the vent apertures 220 may have a diameter in a range of 0.05 mm-0.5 mm, and more specifically in a range of 0.1 mm-0.3 mm. Alternatively, the vent apertures 220 may be covered with a selective membrane that permits gas/air to pass therethrough in both directions while preventing the fluid from passing therethrough. In other embodiments, the material of the structure that forms the vent apertures 220 may be selected to prevent the fluid from passing therethrough while permitting gas/air to pass therethrough. Still further, the walls that define/surround the vent apertures 220 may have a jagged shape or the like that prevents fluid from passing therethrough under the conditions identified above. Thus, there are many different ways that the vent apertures 220 can be configured to permit air to flow therethrough while preventing fluid from passing therethrough at ambient temperature and with a pressure equilibrium existing as noted above.

As discussed in greater detail below with reference to FIGS. 8A-8D, the vent apertures 220 are positioned along the vent tube 200 in such a manner that there are no pockets of trapped air within the storage cavity 171, regardless of orientation of the handle 110 and/or housing 170, that can expand due to increases in temperature or decreases in pressure (both of which would exert pressure on the fluid in the storage cavity 171 and cause it to be expelled in an uncontrolled manner). Rather, any air pockets are always spatially coupled to the exterior atmosphere (via the vent apertures 220, the primary vent passageway 210, and handle vent apertures described below) so that as a result of any increases in temperature or decreases in pressure (i.e., expansion of the air/gas), the air/gas in the air pockets will exit the storage cavity 171 rather than exert pressure on the fluid and cause it to leak out of the storage cavity 171. In order to achieve this, at least one of the vent openings 220 may be positioned along the housing 170 at a location that is aligned with a maximum internal diameter of the storage cavity 171.

Thus, in the exemplified embodiment the middle section 207 of the vent tube 200 is located in alignment with the maximum (or near-maximum) internal diameter of the storage cavity 171. Furthermore, the first vent apertures 221 are formed into the portion of the outer surface 203 of the vent tube 200 that faces the inner surface 106 of the handle 110 and/or housing 170. As the orientation of the handle 110/housing 170 changes, the fluid in the storage cavity 171 will move around and the location of the air pockets will change. However, air pockets that form will be located in the regions of the storage cavity 171 that has the maximum internal diameter. Thus, keeping the middle portion 207 of the vent tube 200 in alignment with this maximum internal diameter portion of the storage cavity 171 ensures that one of the first vent apertures 221 is in spatial communication with gas/air pockets of the storage cavity 171. This is described in more detail below with reference to FIGS. 8A-8D.

Although the middle section 207 of the vent tube 200 is described and illustrated herein as being located between the upper and lower sections 205, 206 of the vent tube 200, the invention is not to be so limited in all embodiments. Specifically, in some embodiments it is merely preferable that the section of the vent tube 200 that forms a loop that surrounds the cavity axis B-B be aligned with a region of the storage cavity 171 that has the maximum or near-maximum diameter of the storage cavity 171. The maximum or near-maximum diameter region of the storage cavity 171 could be located closer to the first end 178 of the storage cavity 171 or closer to the second end 179 of the storage cavity, and in such case the location of the loop portion of the vent tube 200 could be moved accordingly to coincide with this maximum or near-maximum diameter region of the storage cavity 171. The region of the storage cavity 171 with the maximum diameter is the region in which air pockets are most likely to form. The loop portion of the vent tube 200 with the first apertures 221 therein should be aligned with or located within the region of the storage cavity 171 with the maximum or near-maximum diameter to ensure that the location of the first apertures 221 coincides with the air pockets within the storage cavity 171.

In some embodiments, the second vent apertures 222 permit proper venting of the storage cavity 171 when the housing 170 is in an upright orientation and the plurality of first vent apertures 221 and the third vent apertures 223 are submerged by the fluid in the storage cavity 171. The third vent apertures 223 permit proper venting of the storage cavity 171 when the housing 211 is in a vertical but inverted orientation and the plurality of first vent apertures 221 and the second vent apertures 222 are submerged by the fluid in the storage cavity 171. The plurality of first vent apertures 221 permit proper venting of the storage cavity 171 when the second and third vent apertures 222, 223 are submerged by the fluid in the storage cavity 171 but at least one of the plurality of first vent apertures 221 remains outside of the fluid in the storage cavity 171. In every instance that the second and third vent apertures 222, 223 are covered by the fluid in the storage cavity 171, regardless of the specific orientation of the housing 170, at least one of the first vent apertures 221 will be located outside of the fluid so that it is spatially coupled to the gas within the storage cavity 171. Thus, in certain embodiments, regardless of the orientation of the housing 170 there remains one vent aperture 221, 222, 223 of the vent tube 200 available for venting the storage cavity 171 which assists in preventing fluid leaks.

The plurality of first vent apertures 221 are arranged along the middle section 207 of the vent tube 200 in a spaced apart manner. In the exemplified embodiment, the first vent apertures 221 are both axially and angularly equi-spaced from one another. More specifically, in the exemplified embodiment adjacent ones of the first vent apertures 221 are separated by an angle that is less than or equal to sixty degrees, more specifically less than or equal to 50 degrees, more specifically less than or equal to 40 degrees, more specifically less than or equal to 30 degrees, more specifically less than or equal to 20 degrees, and more specifically less than or equal to 10 degrees. However, the exact spacing between adjacent ones of the first vent apertures 221 may be modified in alternative embodiments. Furthermore, the first vent apertures 221 need not be equi-spaced in all embodiments and adjacent first vent apertures 221 may have variations in spacing in alternative embodiments (i.e., a first of the first vent apertures 221 that is adjacent to a second and a third of the first vent apertures 221 may be in closer to proximity the second of the first vent apertures 221 than to the third of the first vent apertures 221).

In the exemplified embodiment, the first vent apertures 221 are arranged in a spaced-apart manner to circumferentially surround the cavity axis B-B of the storage cavity 171 of the housing 170. Furthermore, each of the first vent apertures 221 is radially spaced from the cavity axis B-B so as to be located adjacent to the sidewall 173 of the housing 171. In the exemplified embodiment, the first vent apertures 221 are arranged in a helical pattern about the cavity axis B-B, but in other embodiments the first vent apertures 221 may circumferentially surround the cavity axis B-B without forming a helical pattern. So long as the functionality described herein is achieved so that one of the vent apertures 221, 222, 223 is in spatial communication with the air/gas within the storage cavity 171 regardless of the orientation of the storage cavity 171, the exact location, number, and spacing of the plurality of first vent apertures 221 is not to be limiting of the present invention in all embodiments.

Although the vent tube 200 may achieve all of the venting of the storage cavity 171 in some embodiments, the invention is not to be so limited. Specifically, in some other embodiments some of the venting may be achieved via the vent apertures 220 in the vent tube 200 and additional venting may be achieved with other vent apertures not formed into the vent tube 200. Specifically the body 101, and more specifically the handle 110 (or the housing 170) may include a vent opening 230 in or near the proximal end 104 of the personal care implement 100. The vent opening 230 extends from the inner surface 106 of the handle 110 to an outer surface 107 of the handle 110. In the exemplified embodiment the vent opening 230 is formed into the end cap 130, but the invention is not to be so limited. The vent opening 230 forms a passageway from the storage cavity 171 directly to the exterior atmosphere.

Furthermore, in the exemplified embodiment the vent opening 137 in the divider component 133 also operates as an air vent. The vent opening 137 forms a passageway from the storage cavity 171 to the venting cavity 119. Furthermore, in this embodiment a handle vent aperture 231 is formed into the handle 110 within the venting cavity 119. The handle vent aperture 231 forms a passageway from the venting cavity 119 to the exterior atmosphere. Thus, if air in the storage cavity 171 expands and flows through the vent opening 137 in the divider component 133 and into the venting cavity 119, it can also flow from the venting cavity 119 to the external atmosphere via the handle vent aperture 231 to achieve the desired venting of the storage cavity 171.

In the exemplified embodiment the handle vent aperture 231 is oriented orthogonal to the longitudinal axis A-A of the personal care implement 100. However, in other embodiments the handle vent aperture 231 may be oriented oblique to the longitudinal axis A-A of the personal care implement 100 (and to the cavity axis B-B) to limit blockage or clogging of the handle vent aperture 231 by preventing debris from entering into the handle vent aperture 231.

The vent opening 230 and the vent opening 137 are designed similar to the vent apertures 220 in the vent tube 200 in that they are configured such that a fluid within the storage cavity 171 cannot flow through the vent opening 230 and the vent opening 137 at ambient temperature and with a pressure equilibrium existing between the storage cavity 171 and the external atmosphere. However, at the same time the vent opening 230 and the vent opening 137 are designed to permit gas, such as air, within the storage cavity 171 to pass through the vent opening 230 and the vent opening 137. Specifically, as long as the vent opening 230 and the vent opening 137 are not clogged, the gas/air will be capable of freely passing through the vent opening 230 and the vent opening 137 both into and out of the storage cavity 171 as needed to provide proper air intake and venting to ensure proper operation of the device (i.e., consistent fluid flow during use) without leakage. This can be accomplished by changing the size, shape, and material of the vent openings 230, 137 and/or by covering the vent openings 230, 137 with a selective membrane as described above with reference to the vent apertures 220.

In the exemplified embodiment, a passageway exists from the storage cavity 171 to the external atmosphere as follows: (1) from the storage cavity 171 through one of the first, second, and third vent openings 221, 222, 223 in the vent tube 200 and into the primary vent passageway 210 of the vent tube 200, and then either directly out the first opening 208 in the vent tube 200 to the external atmosphere or out the second opening 209 in the vent tube 200 to the venting cavity 119 and then through the handle vent aperture 231 to the external atmosphere; (2) from the storage cavity 171 through the vent opening 137 in the divider component 133 to the venting cavity 119, and then through the handle vent aperture 231 to the external atmosphere; and (3) through the vent opening 230 directly to the external atmosphere. Thus, as long as at least one of the first, second, and third vent openings 221, 222, 223, the vent opening 230, or the vent opening 137 is located in spatial communication with the air/gas within the storage cavity 171 (as opposed to being in spatial communication with fluid in the storage cavity 171), the storage cavity 171 is properly vented to substantially prevent fluid leaks as has been described herein. Furthermore, in some embodiments the second and third vent openings 222, 223 may be omitted and in other embodiments the vent opening 230 and/or the vent opening 137 may be omitted. However, in certain embodiments at least one of the second vent opening 222 and the vent opening 230 is included to permit venting of air/gas from the first end 178 of the storage cavity 171 and in certain embodiments at least one of the third vent opening 223 and the vent opening 137 is included to permit venting of air/gas from the second end 179 of the storage cavity 171.

Referring now to FIGS. 8A-8D, operation of the fluid supply apparatus 1000 of the personal care implement 100 will be described. It should be appreciated that the functionality described herein can be utilized with a stand-alone cartridge that operates independently or upon insertion into an interior cavity of a personal care implement 100 as described above. In certain embodiments, the vent apertures 221, 222, 223 are located and arranged on the vent tube 200 such that irrespective of the vertical and angular orientation of the housing 170 relative to a gravitational vector GV, at least one of the vent apertures 221, 222, 223, the vent opening 137, and the vent opening 230 is in spatial communication with a gas 109 located within the storage cavity 171 of the housing 170 rather than with a fluid located within the storage cavity 171 of the housing 170. Thus, in certain embodiments the vent tube 200 achieves proper venting in some orientations of the housing 170 whereas the vent opening 137 and/or the vent opening 230 achieve proper venting in other orientations of the housing 170. As used herein, the gravitational vector GV is a vector illustrating the direction of the force of gravity applied to the housing 170 at a given orientation of the housing 170.

Figure 8A:
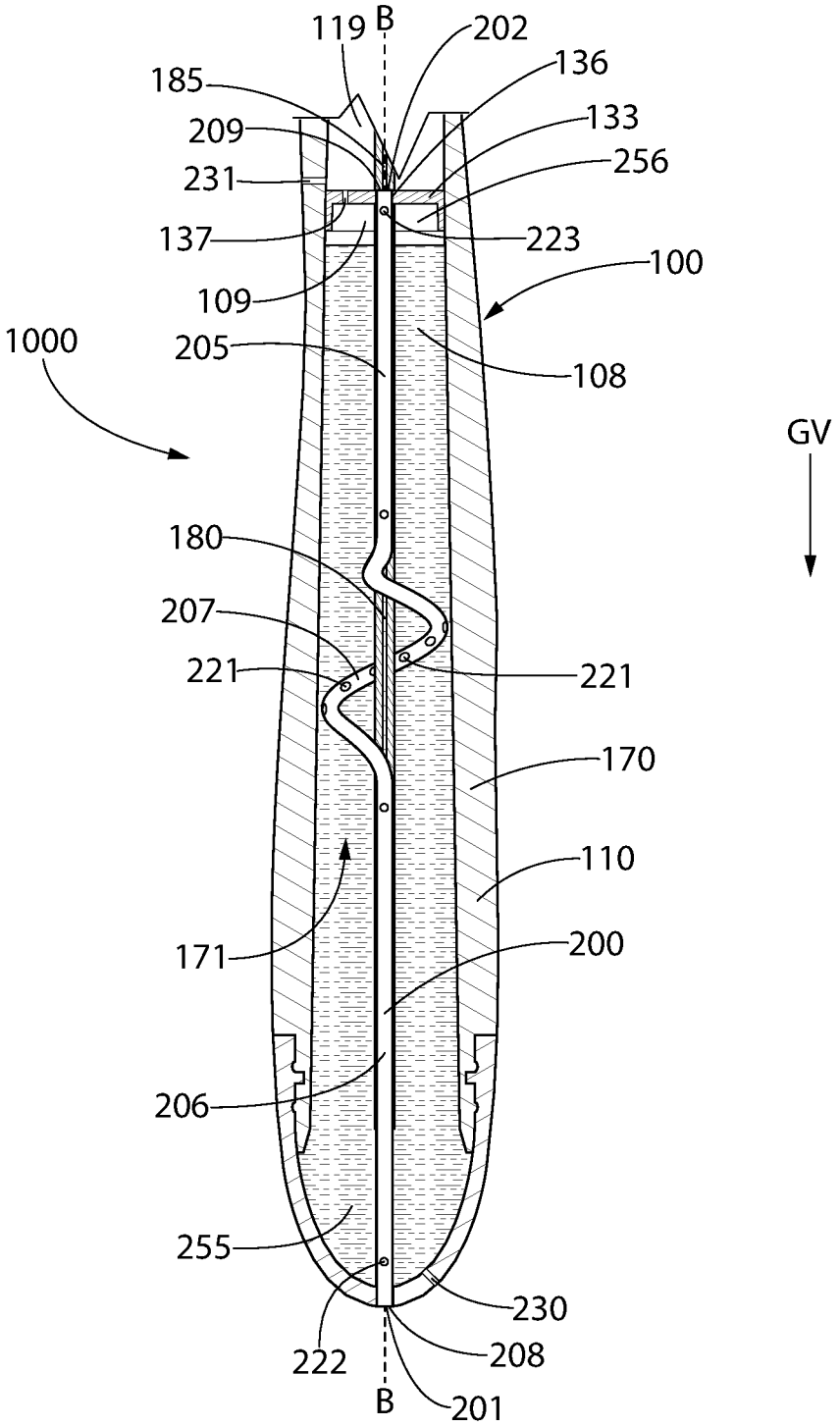
FIG. 8A is a close-up view of area VIII of FIG. 5B with fluid in a storage cavity and with the personal care implement in a first orientation.

FIG. 8A illustrates the housing 170 positioned in an upright orientation. As shown here, the storage cavity 171 of the housing 170 has a total volume that is occupied by a fluid 108 and a gas 109. As noted above, as used herein the term fluid is intended to refer to a liquid and is intended to exclude gases. Thus, the term fluid includes materials that are in liquid form and not materials that are in gaseous form. Thus, the total volume of the storage cavity 171 is occupied collectively by the fluid 108 (which is a liquid) and the gas 109.

In the exemplified embodiment, a first portion of the total volume of the storage cavity 171 of the housing 170 is occupied by the fluid 108 and a second portion of the total volume of the storage cavity 171 of the housing 170 is occupied by the gas 109. In the exemplified embodiment, the first portion of the total volume of the storage cavity 171 that is occupied by the fluid 108 is a majority of the total volume such that the fluid occupies a majority of the total volume of the storage cavity 171. In one embodiment, the fluid 108 occupies at least eighty percent (80%) of the total volume of the storage cavity 171. In another embodiment, the fluid 108 occupies at least eight-five percent (85%), or at least ninety percent (90%) or at least ninety-five percent (95%) of the total volume of the storage cavity 171. Of course, as the fluid 108 is dispensed during use of the device, the fluid 108 contained within the storage cavity 171 becomes depleted and the percentage of the total volume that is taken up by the fluid 108 decreases while the percentage of the total volume that is taken up by the gas 109 increases. This results in increased venting because more of the vent apertures/openings are in spatial communication with the gas 109 than the fluid 108 as the fluid 108 becomes depleted and takes up less of the total volume of the storage cavity 171.

In one specific embodiment, the total volume of the storage cavity 171 may be between 5 ml and 10 ml, more specifically between 6 ml and 8 ml, and still more specifically approximately 7 ml. Furthermore, in certain embodiments prior to use the fluid 108 will encompass approximately 95% (about 6.7 ml when the total volume is 7 ml) of the total volume. Of that 6.7 ml of the fluid 108, a portion will prime the capillary member 180 and the applicator 150, leaving approximately 6 ml of the fluid 108 within the storage cavity 171 (based on the storage cavity 171 having a total volume of 7 ml, the exact numbers may change while the percentages may remain the same). Thus, after priming and at or before first use by an end user, between 80%-90%, and more specifically approximately 85% of the total volume of the storage cavity 171 will be taken up by the fluid 108, the remaining 10%-20%, and more specifically 15%, being taken up by the gas/air 109.

With the housing 170 positioned in the upright orientation such that the gravitational vector GV is parallel to the cavity axis B-B, the fluid 108 in the storage cavity 171 is located in a bottom portion 255 of the storage cavity 171 and the gas 109 is located in a top portion 256 of the storage cavity 171 above the free surface of the fluid 108. In this example and orientation of the housing 170, the third vent aperture 223 of the vent tube 200 and the vent opening 137 of the divider component 133 are in spatial communication with the gas 109 in the storage cavity 171 while the first and second vent apertures 221, 222 of the vent tube 200 and the vent opening 230 are submerged in the fluid 108. Thus, if there were an increase in temperature or a decrease in pressure, the gas 109 will flow out of the storage cavity 171 in at least one of the following manners: (1) through the third vent aperture 223 of the vent tube 200 into the primary vent passageway 210, through the second opening 209 in the vent tube 200 into the venting cavity 119, and then out to the external atmosphere through the handle vent aperture 231; and/or (2) through the vent opening 137 of the divider component 133 into the venting cavity 119 and then out to the external atmosphere through the handle vent aperture 231. Thus, because the third vent aperture 223 of the vent tube and/or the vent opening 137 of the divider component 133 are in spatial communication with the gas 109 (i.e., air pocket) within the storage cavity 171, the gas 109 is permitted to pass to the external atmosphere rather than having it exert a pressure on the fluid 108 which could create a leak situation.

In certain embodiments, either the third vent aperture 223 of the vent tube 200 or the vent opening 137 of the divider component 133 could be omitted. Thus, there only needs to be one vent aperture available for the gas 109 to vent through when the housing 170 is in the upright vertical orientation illustrated in FIG. 8A. However, including both the third vent aperture 223 of the vent tube 200 and the vent opening 137 of the divider component 133 may be preferable in some embodiments for redundancy and may be beneficial because even if one of them becomes clogged operation will not be affected.

In certain embodiments, the gas 109 in the storage cavity 171 is air (i.e., oxygen, a mixture of oxygen, nitrogen, and small amounts of other gases, or the like). Furthermore, the fluid 109 can be any fluid, particularly liquid, that is desired to be dispensed for application to a surface (such as a biological surface) depending on the end use. For example, when the desired application site is a user's oral cavity, the fluid 108 may be one that provides a benefit to a user's oral surfaces (i.e., a benefit agent) such as a sensorial or therapeutic benefit. For example without limitation, the fluid 108 may be a mouthwash, a dentifrice, a tooth whitening agent such as peroxide containing tooth whitening compositions, or the like. Other contemplated fluids that can be stored in the storage cavity 171 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the first fluid 103 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

Thus, when the fluid 108 is stored in an oral care implement or toothbrush, any of the above fluids may be desirable for use as the fluid 108. In other embodiments the personal care implement 100 may not be a toothbrush. Thus, the fluid 108 can be any other type of fluid that has beneficial results when dispensed in accordance with its end use or the end use of the product/implement with which it is associated. For example, the fluid 108 may be hair gel when the implement is a hairbrush, make-up (i.e., mascara or the like) when the implement is a make-up applicator, shaving cream when the implement is a razor, anti-acne cream when the implement is a skin or face scrubber, or the like. Furthermore, as described herein in some embodiments the fluid supply apparatus 1000 may not be associated with a personal care implement at all. Thus, the fluid 108 may be modified to be any type of fluid that is desired to be dispensed in accordance with the teachings set forth herein even if it is dispensed directly from the fluid supply apparatus 1000 rather than through a personal care implement 100.

In FIGS. 8A-8D, the vent apertures 221 appear to be located on the inner surface of the vent tube 200. This is done for ease of understanding regarding the location of the vent apertures 221. Although the vent apertures 221 could be positioned as illustrated in some embodiments, in other embodiments the vent apertures 221 are on the outer surface 203 of the vent tube 200 facing the inner surface of the body 110 as discussed above and specifically illustrated in FIG. 7A.

Figure 8B:
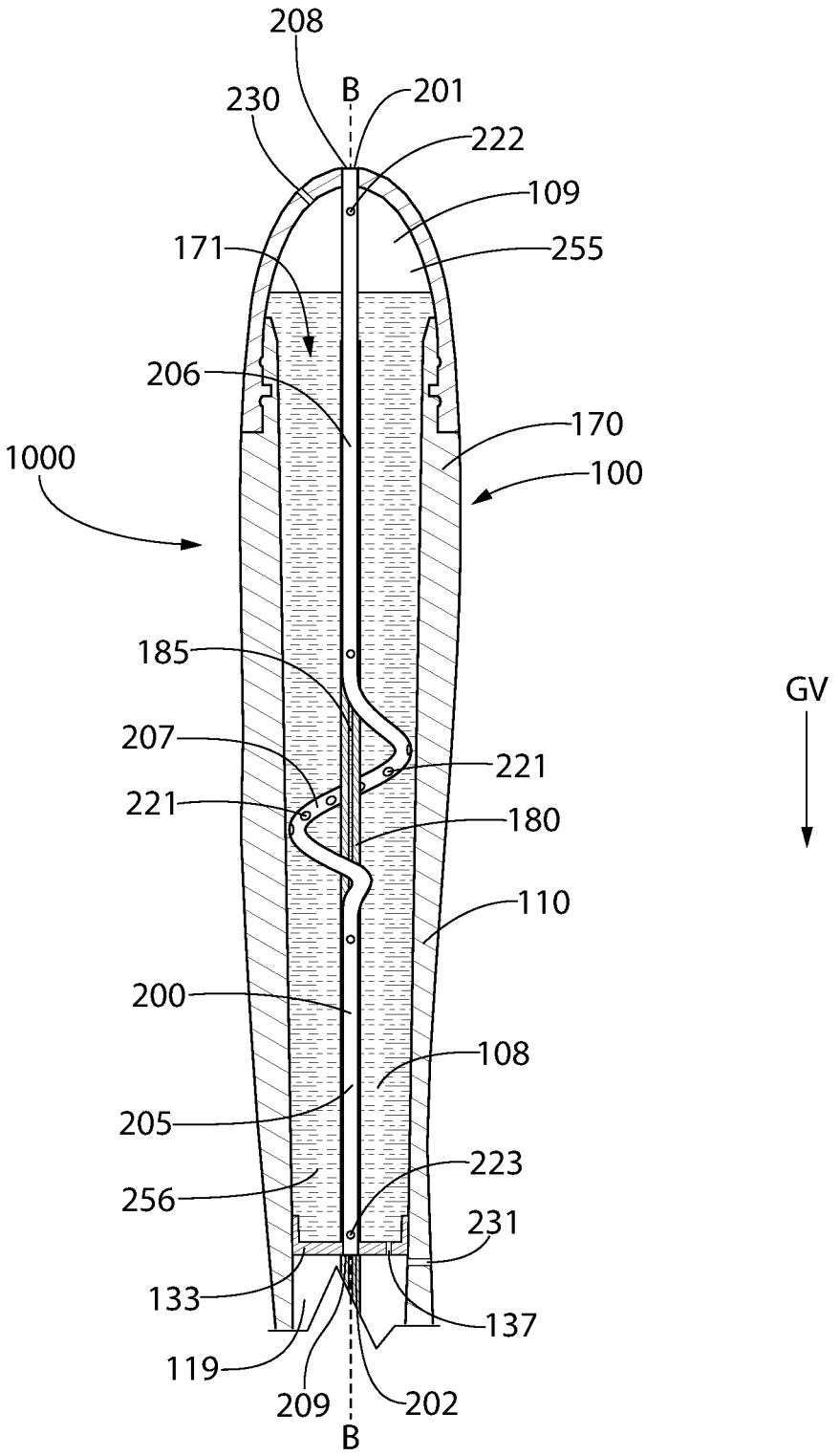
FIG. 8B is a close-up view of area VIII of FIG. 5B with fluid in the storage cavity and with the personal care implement in a second orientation.

FIG. 8B illustrates the same thing as FIG. 8A except the housing 170 has been flipped 180° so that it is upside-down relative to FIG. 8A. Thus, in this embodiment the cavity axis B-B remains parallel to the gravitational vector GV, except here the housing 170 is in an upside-down vertical orientation such that the top portion 256 of the storage cavity 171 is facing downward and the bottom portion 255 of the storage cavity is facing upward. In this embodiment, the same amount of the total volume of the storage cavity 171 is occupied by the fluid 108 and the gas 109 as with the embodiment of FIG. 8A (i.e., a majority of the total volume is occupied by the fluid 108 and the remainder by the gas 109).

With the housing 170 positioned in the upside-down vertical orientation, the fluid 108 in the storage cavity 171 is located in the top portion 256 of the storage cavity 171 (which faces downward) and the gas 109 is located in the bottom portion 255 of the storage cavity 171 (which is above the free surface of the liquid 108 due to the upside-down orientation). In this example and orientation of the housing 170, the second vent aperture 222 of the vent tube 200 and the vent opening 230 are in spatial communication with the gas 109 in the storage cavity 171 while the first and third vent apertures 221, 223 and the vent opening 137 are submerged in the fluid 108. Thus, if there were an increase in temperature or a decrease in pressure, the gas 109 will flow out of the storage cavity 171 in at least one of the following manners: (1) through the second vent aperture 222 of the vent tube 200 into the primary vent passageway 210, and then through the first opening 208 in the vent tube 200 to the external atmosphere; and/or (2) through the vent opening 230 in the housing 170 directly out to the external atmosphere. Thus, because the second vent aperture 221 of the vent tube and/or the vent opening 230 are in spatial communication with the gas 109 (i.e., air pocket) within the storage cavity 171, the gas 109 is permitted to pass to the external atmosphere rather than having it exert a pressure on the fluid 108 which could create a leak situation.

In certain embodiments, either the second vent aperture 222 of the vent tube 200 or the vent opening 230 could be omitted. Thus, there only needs to be one vent aperture available for the gas 109 to vent through when the housing 170 is in the upside-down vertical orientation illustrated in FIG. 8B. However, including both the second vent aperture 223 of the vent tube 200 and the vent opening 230 may be preferable in some embodiments for redundancy and may be beneficial because even if one of them becomes clogged operation will not be affected.

Figure 8C:
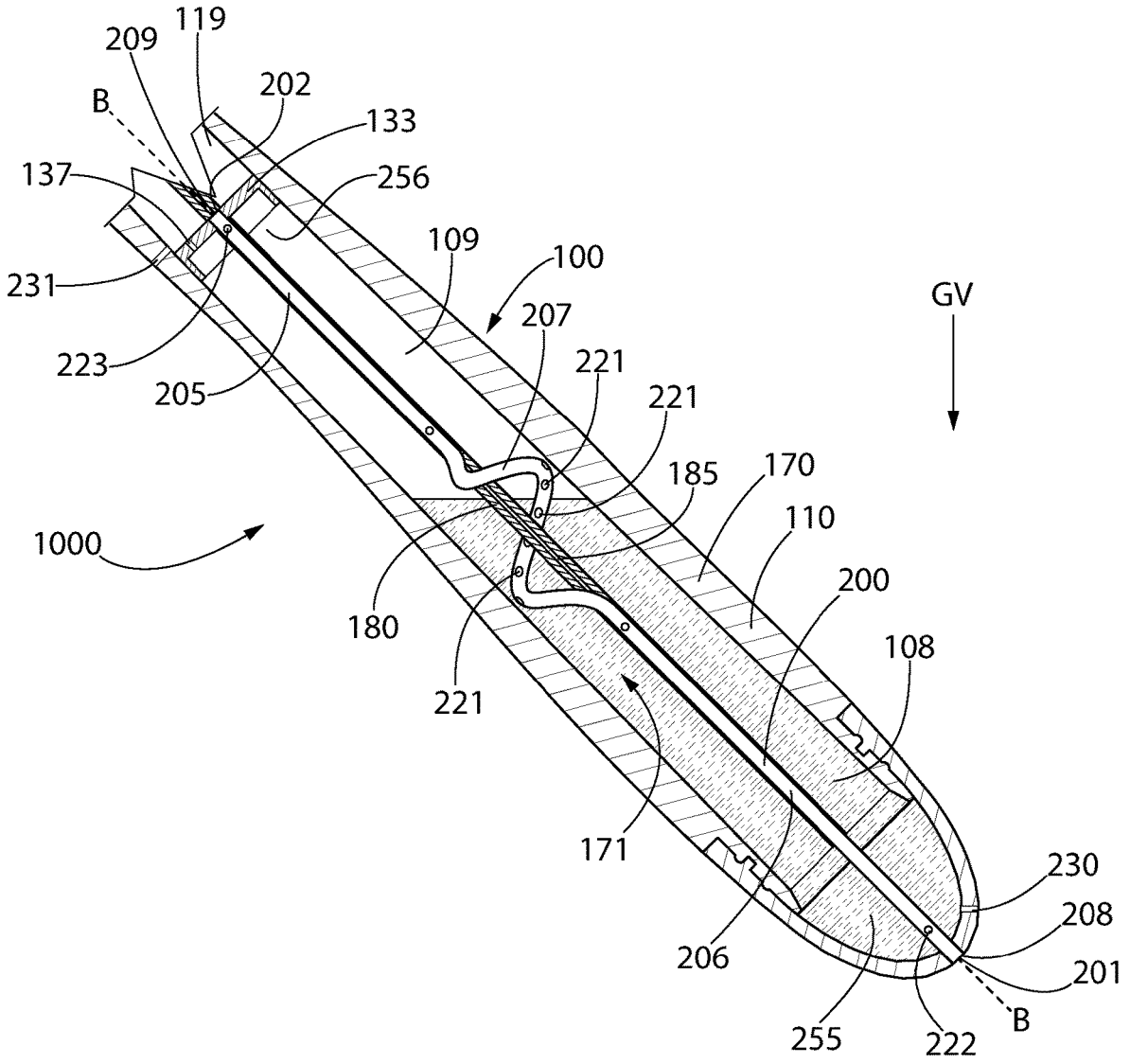
FIG. 8C is a close-up view of area VIII of FIG. 5B with fluid in the storage cavity and with the personal care implement in a third orientation.

FIG. 8C illustrates the same thing as FIGS. 8A and 8B except the housing 170 has been tilted so that the cavity axis B-B is oriented obliquely to the gravitational vector GV. Although one tilt orientation is illustrated in FIG. 8C, the device will operate similarly in any of the infinite tilt orientations at which the cavity axis B-B is oblique to the gravitational vector GV. Furthermore, at any orientation shown (including those shown in any of FIGS. 8A-8D and any of the other infinite orientations), the housing 170 can be rotated (with the cavity axis B-B as the rotational axis) 360° with the device still properly functioning to prevent a leak situation. In the embodiment of FIG. 8C, there is less of the fluid 108 in the storage cavity 171 than in the embodiments of FIGS. 8A and 8B to illustrate the first vent apertures 221 being in spatial communication with the gas 109 in the storage cavity 171 as discussed below.

With the housing 170 positioned in this tilted orientation and the fluid level as shown, the gas 109 in the storage cavity 171 is located in the top portion 256 of the storage cavity 171, but there is more of the gas 109 than with previous embodiments so the gas 109 is present to about half way down the storage cavity 171. In this example and orientation of the housing 170, in addition to the third vent aperture 223 of the vent tube and the vent opening 137 being in spatial communication with the gas 109 in the storage cavity 171, one of the first vent apertures 221 is also in spatial communication with the gas 109 in the storage cavity 171. Thus, if there were an increase in temperature or a decrease in pressure, in addition to being able to flow out of the storage cavity 171 to the external atmosphere through the third vent aperture 223 and/or the vent opening 137 as discussed above with reference to FIG. 8A, the gas 109 will also be able to flow out of the storage cavity 171 through one of the first vent apertures 221. Specifically, as an additional route, the gas 109 could flow from the storage cavity 171 through one or more of the first vent apertures 221 into the primary vent passageway 210 of the vent tube 200, and then through the primary vent passageway 210 of the vent tube and to the external atmosphere in at least one of the following flow paths: (1) out through the first opening 208 of the vent tube 200 directly to the external atmosphere; and/or (2) out through the second opening 209 of the vent tube 200 into the venting cavity 119, and then out from the venting cavity 119 to the external atmosphere via the handle vent aperture 231.

Figure 8D:
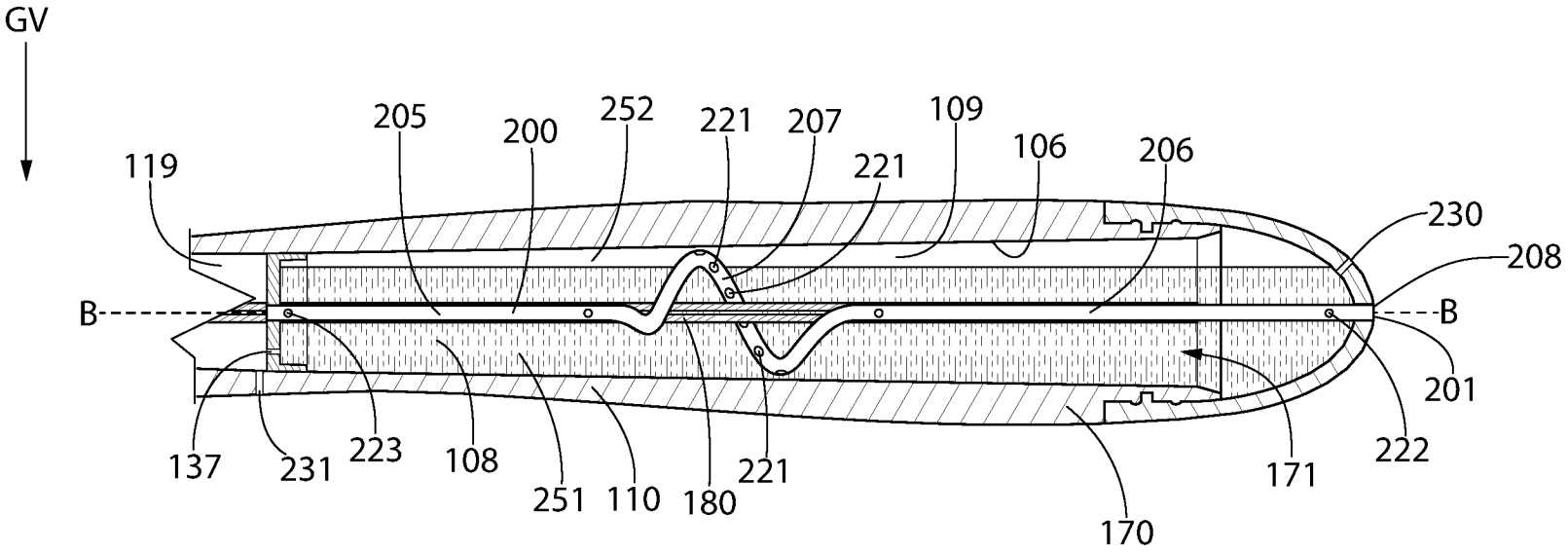
FIG. 8D is a close-up view of area VIII of FIG. 5B with fluid in the storage cavity and with the personal care implement in a fourth orientation.
Figure 9:
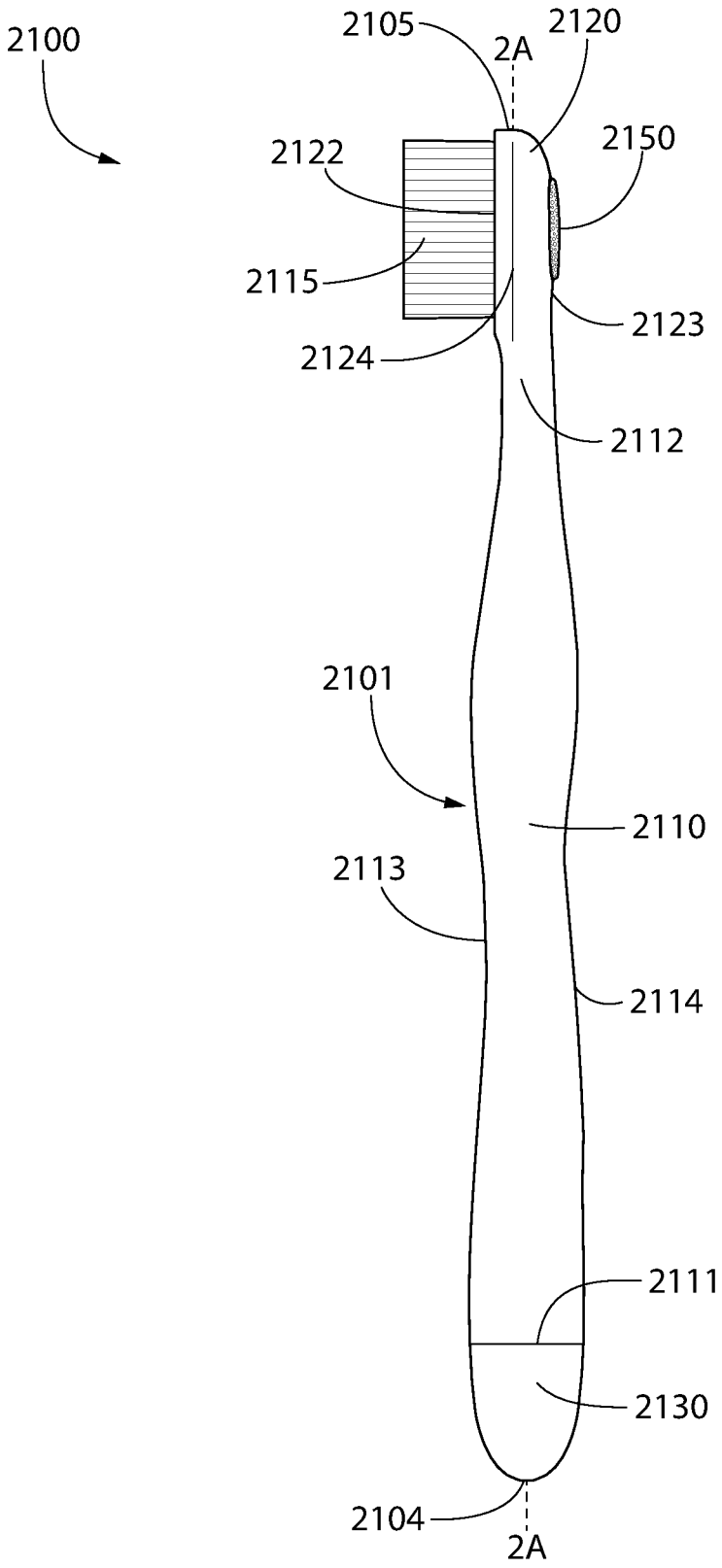
FIG. 9 is side view of a personal care implement in accordance with an embodiment of the present invention.
Figure 10:
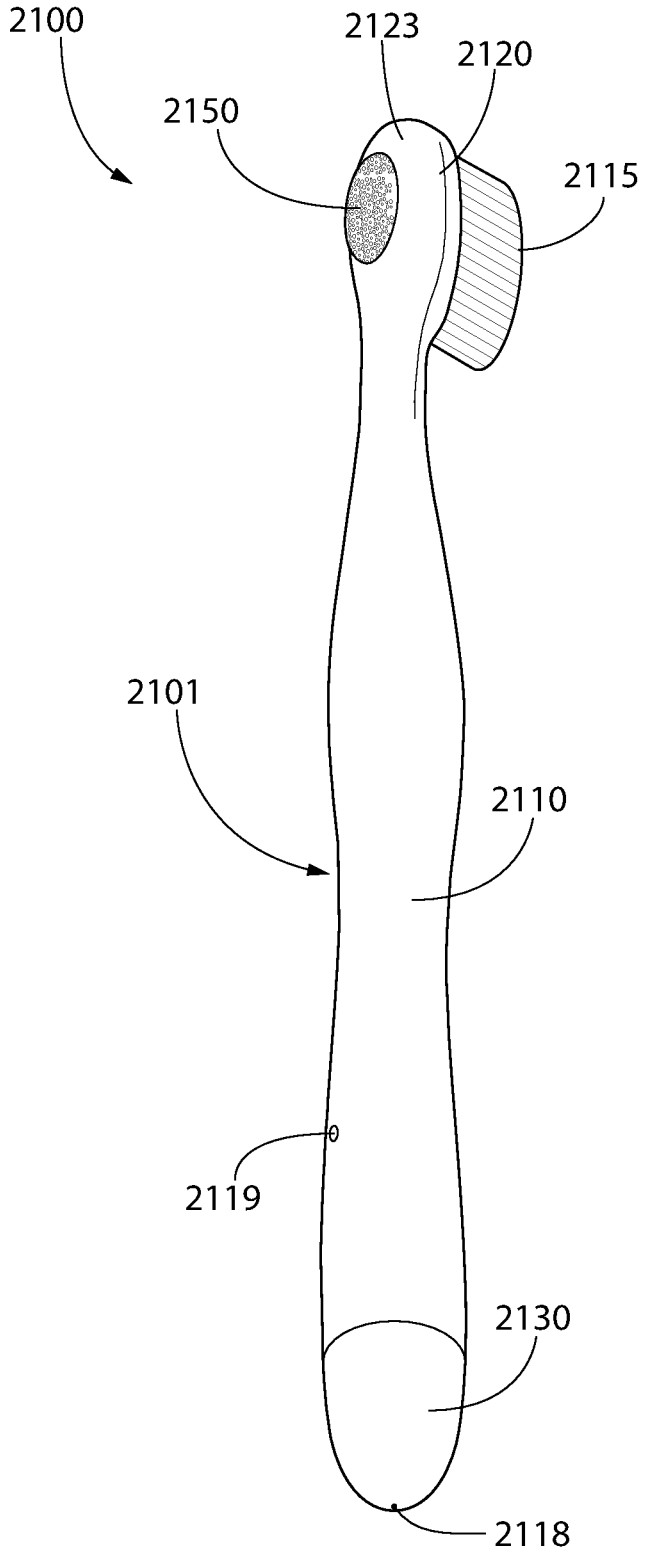
FIG. 10 is a rear perspective view of the personal care implement of FIG. 9.

FIG. 8D illustrates the same thing as FIGS. 8A-8C except the housing 170 has been tilted so that the cavity axis B-B is oriented orthogonal to the gravitational vector GV. With the housing 170 positioned in this orientation, the fluid 108 in the storage cavity 171 falls by gravity to the left-side portion 251 of the storage cavity 171 (illustrated as the bottom due to the orientation of the housing 170 in FIG. 8D) and the right-side portion 252 of the storage cavity 171 (illustrated as the top due to the orientation of the housing in FIG. 8D) is filled with the gas 109. In this example and orientation of the housing 170, the second and third vent apertures 222, 223 of the vent tube 200 and the vent openings 137, 230 are all submerged in the fluid and thus are not in spatial communication with the gas 109 in the storage cavity 171.

However, in this orientation of the housing 170, at least one of the first vent apertures 221 is in spatial communication with the gas 109 in the storage cavity 171. This occurs due to the fact that the first vent apertures 221 are formed into the middle section 207 of the vent tube 200 that has the loop or helical portion of the vent tube 200. Thus, the first vent apertures 221 are located adjacent and near to the inner surface 106 of the housing 170 in a 360° loop to ensure that at least one of the first vent apertures 221 is in spatial communication with the gas 109 in the storage cavity 171.

Thus, with the housing 170 in the horizontal orientation of FIG. 8D, if there were an increase in temperature or a decrease in pressure, the gas 109 will flow out of the storage cavity 171 as follows: (1) first the gas 109 will flow from the storage cavity 171 through at least one of the first vent apertures 221 into the primary vent passageway 210; (2) then the gas 109 will flow within the primary vent passageway 210 in at least one of (a) through the first opening 208 in the vent tube 200 directly to the external atmosphere; and (b) through the second opening 209 in the vent tube 200 into the venting cavity 119, and from the venting cavity 119 to the external atmosphere via the handle vent aperture 231. Thus, because one of the first vent apertures 221 is in spatial communication with the gas (i.e., air pocket) within the storage cavity 171, the gas 109 is permitted to pass to the external atmosphere rather than having it exert a pressure on the fluid 108 which could create a leak situation.

Referring to FIGS. 9-13, a personal care implement 2100 is illustrated with a liquid supply apparatus 2200 coupled thereto in accordance with an embodiment of the present invention. In certain embodiments the liquid supply apparatus 2200 may be a stand-alone apparatus that operates independently of the personal care implement 2100 and in other embodiments the liquid supply apparatus 2200 may be used in conjunction with the personal care implement 2100. In certain embodiments, the personal care implement 2100 may comprise the liquid supply apparatus 2200.

The liquid supply apparatus 2200, or the personal care implement 2100 comprising the same, is designed to store a liquid and to dispense the liquid onto a desired surface. The liquid supply apparatus 2200 includes mechanisms that facilitate flow of the liquid from its stored location to another location at which the liquid is dispensed in a desired manner. As described more fully herein, the liquid supply apparatus 2200 is specifically configured to prevent (or severely limit) liquid leakage regardless of the orientation at which the liquid supply apparatus 2200 is held under any normal usage and storage conditions including through changes in temperature and pressure. Although described herein as being a part of a personal care implement, the invention is not to be so limited and the liquid supply apparatus 2200 may be a stand-alone device that is not tied to a particular product type or it may be formed as a part of a different type of product.

In the exemplified embodiment, the personal care implement 2100 is an oral care implement, and more specifically a manual toothbrush. Thus, the invention will be described herein with the details predominately directed to a toothbrush. However, in certain other embodiments the personal care implement 2100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 2100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims. Furthermore, in some embodiments the invention is directed solely to the liquid supply apparatus 2200. Thus, the liquid supply apparatus 2200 may be included as a part of the personal care implement 2100 or it may be a separate, stand-alone device. When a stand-alone device, the liquid supply apparatus 2200 may include some type of applicator so that the liquid dispensed from the liquid supply apparatus 2200 can be properly applied to a desired surface.

In the exemplified embodiment, the personal care implement 2100 generally includes a body 2101 comprising a handle 2110 and a head 2120 and an end cap 2130 that is detachably coupled to the handle 2110. The personal care implement 2100 generally extends along a longitudinal axis 2A-2A from a proximal end 2104 to a distal end 2105. Conceptually, the longitudinal axis 2A-2A is a reference line that is generally coextensive with the three-dimensional center line of the body 2101. Because the body 2101 may, in certain embodiments, be a non-linear structure, the longitudinal axis 2A-2A of the body 2101 may also be non-linear in certain embodiments. However, the invention is not to be so limited in all embodiments and in certain other embodiments the body 2101 may have a simple linear arrangement and thus a substantially linear longitudinal axis 2A-2A.

The handle 2110 extends from a proximal end 2111 to a distal end 2112 and the head 2120 is coupled to the distal end 2112 of the handle 2110. In the exemplified embodiment, the end cap 2130 is detachably coupled to the proximal end 2111 of the handle 2120. Specifically, the handle 2120 has an opening 2116 at the proximal end 2111 thereof and the end cap 2130 is coupled to the proximal end 2111 of the handle 2120 and closes the opening 2116. The end cap 2130 may be detachable from the handle 2120 so that a liquid or oral care material can be stored within the body 2101 and can be refilled by detaching the end cap 2130 from the handle 2110 to provide access, via the opening 2116, to a cavity/reservoir in the body 2101 within which the liquid may be stored. Furthermore, in certain embodiments the end cap 2130 may be altogether omitted and the proximal end 2111 of the body 2101 may form a closed bottom end of the personal care implement 2100. In such embodiments, refill of the reservoir may not be possible or may occur through other mechanisms/structures as would be understood to persons skilled in the art.

The handle 2110 is an elongated structure that provides the mechanism by which the user can hold and manipulate the personal care implement 2100 during use. The handle 2110 comprises a front surface 2113 and an opposing rear surface 2114. In the exemplified embodiment, the handle 2110 is generically depicted having various contours for user comfort. Of course, the invention is not to be so limited in all embodiments and in certain other embodiments the handle 2110 can take on a wide variety of shapes, contours and configurations, none of which are limiting of the present invention unless so specified in the claims.

In the exemplified embodiment, the handle 2110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 2110 may include a resilient material, such as a thermoplastic elastomer, as a grip cover that is molded over portions of or the entirety of the handle 2110 to enhance the gripability of the handle 2110 during use. For example, portions of the handle 2110 that are typically gripped by a user's palm during use may be overmolded with a thermoplastic elastomer or other resilient material to further increase comfort to a user.

The head 2120 of the personal care implement 2100 is coupled to the handle 2110 and comprises a front surface 2122, an opposing rear surface 2123, and a peripheral surface 2124 extending between the front and rear surfaces 2122, 2123. In the exemplified embodiment, the head 2120 is formed integrally with the handle 2110 as a single unitary structure using a molding, milling, machining or other suitable process. However, in other embodiments the handle 2110 and the head 2120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 2120 may be detachable from the handle 2110. The head 2120 may be formed of any one of the materials discussed above with regard to the handle 2110.

In the exemplified embodiment, the head 2120 of the personal care implement 2100 is provided with a plurality of tooth cleaning elements 2115 extending from the front surface 2122. Of course, depending on the particular type of device selected for the personal care implement 2100, the tooth cleaning elements 2115 may be replaced with some other bristle-like elements (for example when the personal care implement 2100 is a hairbrush or a mascara applicator) or may be altogether omitted.

In the exemplified embodiment the tooth cleaning elements 2115 are generically illustrated. In certain embodiments the exact structure, pattern, orientation and material of the tooth cleaning elements 2115 are not to be limiting of the present invention. Thus, the term "tooth cleaning elements" is used herein in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 11:
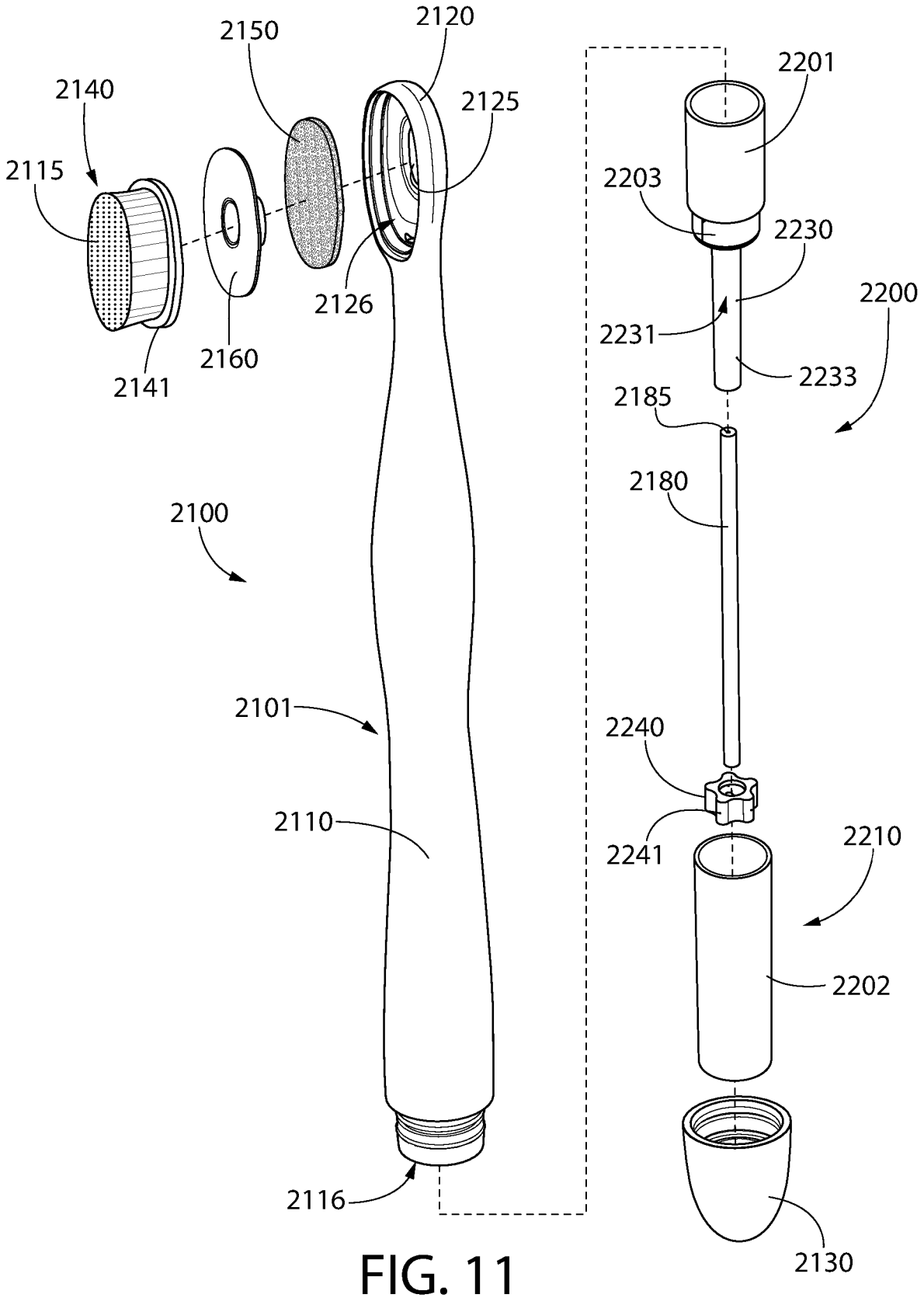
FIG. 11 is an exploded front perspective view of the personal care implement of FIG. 9 illustrating a liquid supply apparatus exploded from a body of the personal care implement.
Figure 12:
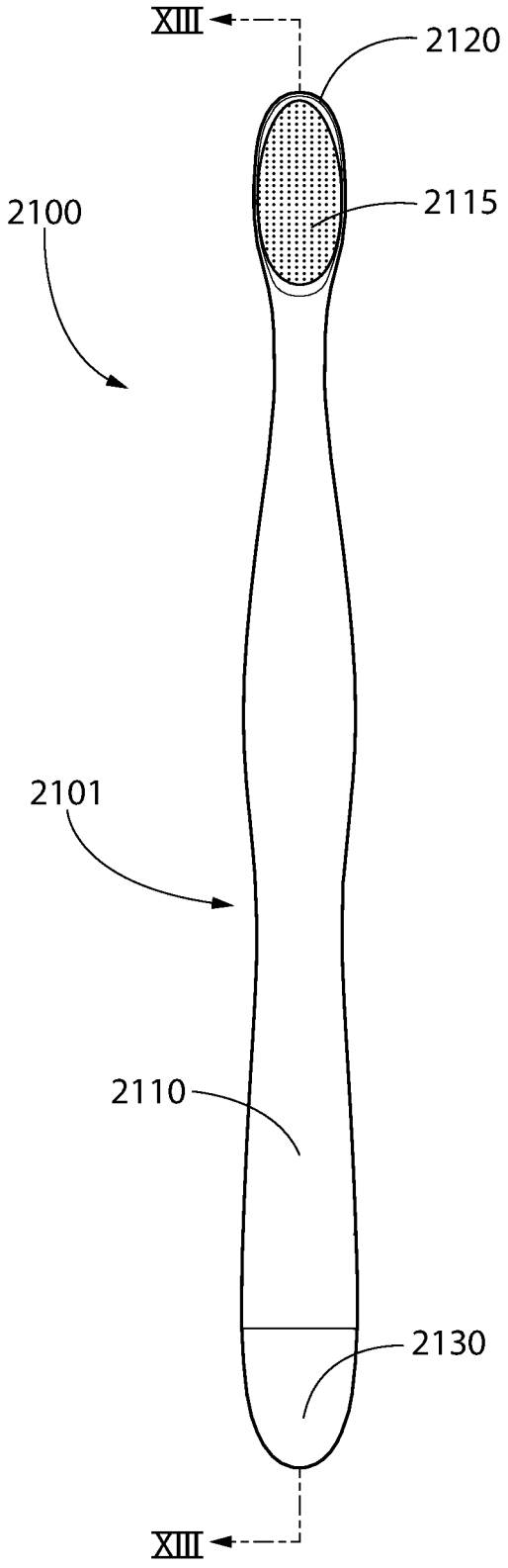
FIG. 12 is a front view of the personal care implement of FIG. 9.
Figure 13:
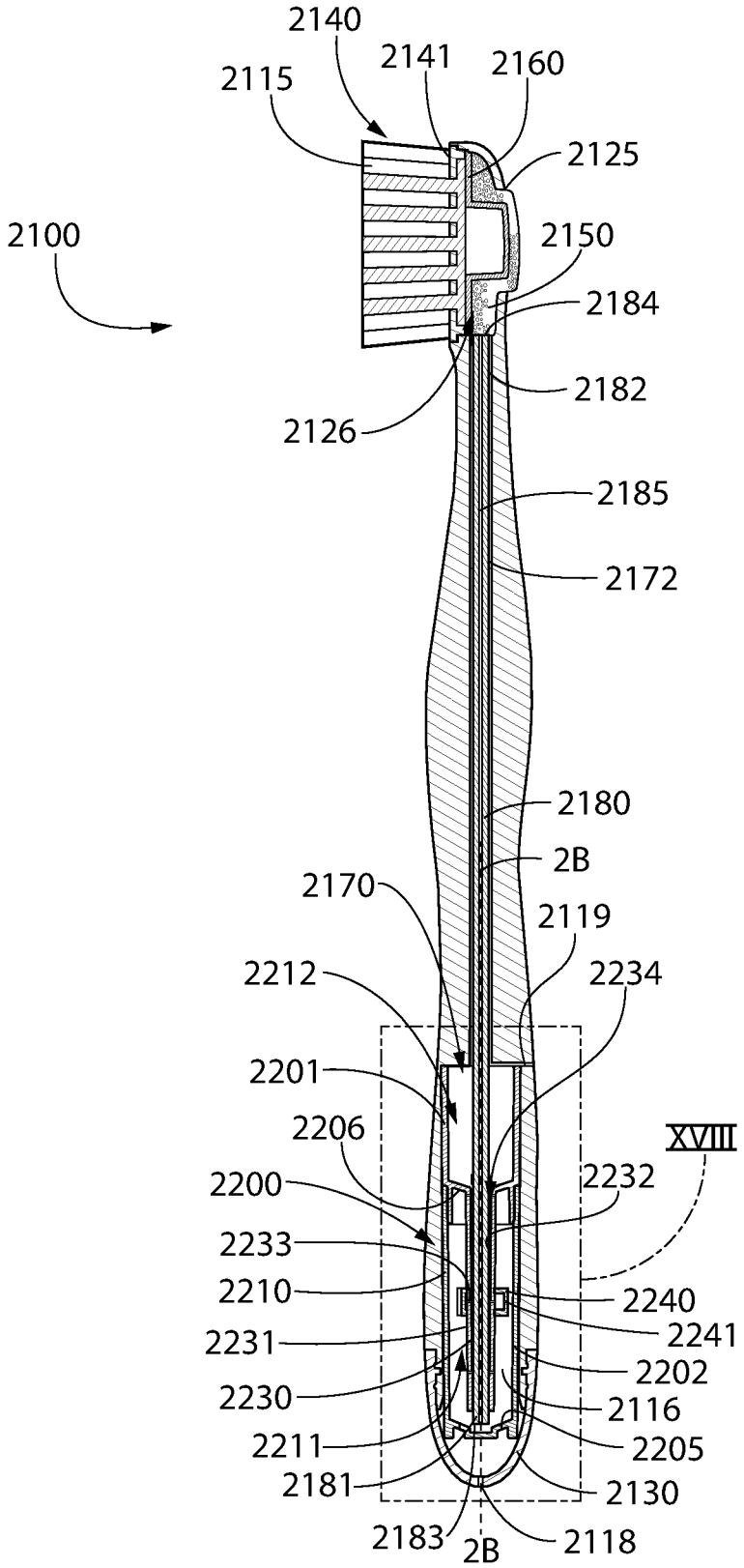
FIG. 13 is a cross-sectional view taken along line XIII-XIII of FIG. 12 illustrating the liquid supply apparatus located within the body of the personal care implement.
Figure 14:
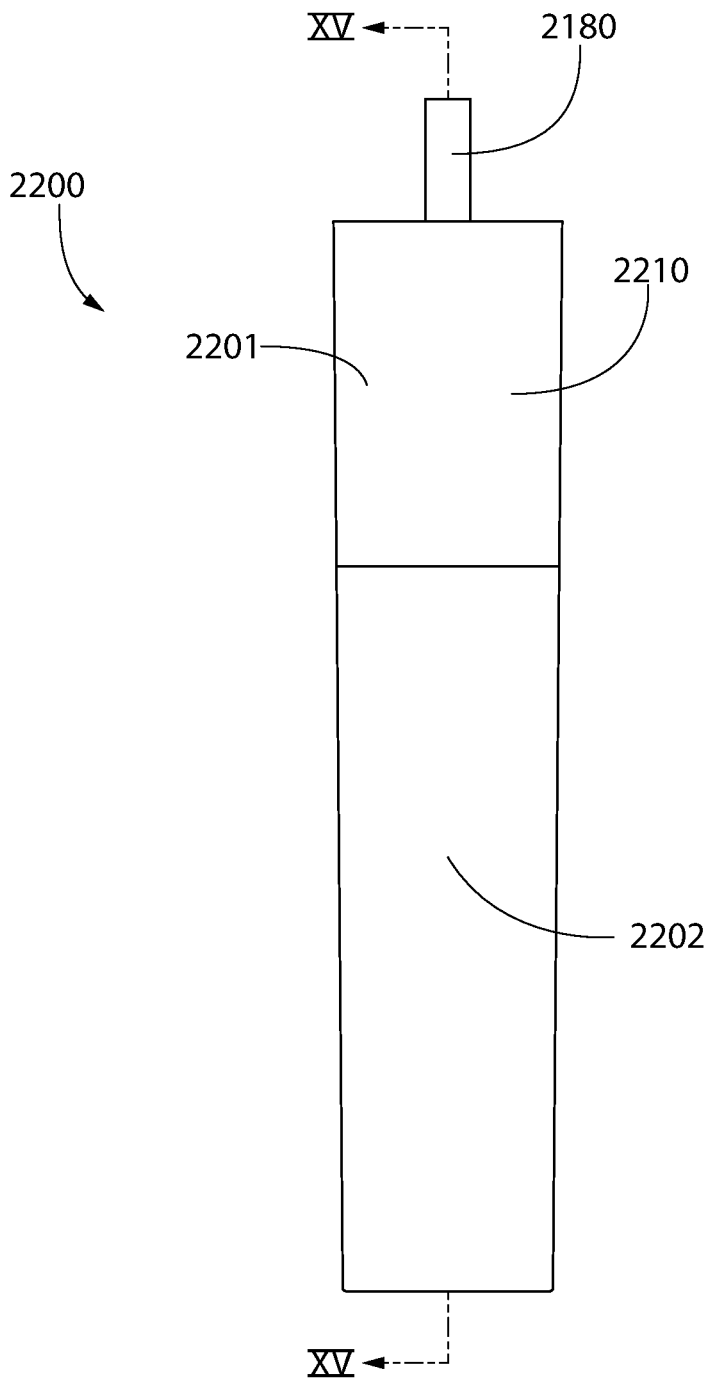
FIG. 14 is a front view of the liquid supply apparatus of FIG. 11.

Referring briefly to FIGS. 11 and 13, in the exemplified embodiment the tooth cleaning elements 2115 are formed on a cleaning element assembly 2140 that comprises a head plate 2141 and the tooth cleaning elements 2115 mounted thereon. In such an embodiment, the head plate 2141 is a separate and distinct component from the body 2101 of the personal care implement 2100. However, the head plate 2141 is connected to the body 2101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 2141 and the body 2101 are separately formed components that are secured together during manufacture of the personal care implement 2100. More specifically, the tooth cleaning elements 2115 are secured to the head plate 2141 in a manner known in the art (i.e., anchor free tufting or AFT) to form the cleaning element assembly 2140, and then the cleaning element assembly 2140 is coupled to the head 2120. Alternatively, the tooth cleaning elements 2115 may be connected to the head 2120 using AMR techniques, stapling, or the like. The invention is not to be particularly limited by the manner in which the tooth cleaning elements 2115 are coupled to the head 2120 in all embodiments.

Although not illustrated herein, in certain embodiments the head 2120 may also include a soft tissue cleanser coupled to or positioned on its rear surface 2123. An example of a suitable soft tissue cleanser that may be used with the present invention and positioned on the rear surface 2123 of the head 2120 is disclosed in U.S. Pat. No. 7,143,462, issued Dec. 5, 22006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 2100 may not include any soft tissue cleanser.

Referring again to FIGS. 9-13 concurrently, in the exemplified embodiment the personal care implement 2100 comprises an applicator 2150 protruding from the rear surface 2123 of the head 2120. More specifically, the head 2120 has an opening 2125 that extends from the rear surface 2123 of the head 2120 into a basin cavity 2126 of the head 2120. The applicator 2150 is inserted into the basin cavity 2126 of the head 2120 and extends through the opening 2125 and protrudes from the rear surface 2123 of the head 2120. Thus, during use of the personal care implement 2100 to brush teeth, the applicator 2150 will engage/contact the user's oral surfaces and dispense a liquid that is loaded on the applicator 2150 onto the oral surface as discussed in more detail below. The personal care implement 2100 may also include a divider member 2160 that divides the basin cavity 2126 into an upper chamber and a lower chamber such that the cleaning element assembly 2140 is located in the upper chamber and the applicator 2150 is located in the lower chamber. The divider member 2160 may seal the applicator 2150 within the lower chamber so that any liquid loaded on the applicator 2150 does not pass into the upper chamber.

The applicator 2150 may be formed of a capillary material that is capable of being loaded with a liquid that can be dispensed from the applicator 2150 when the applicator 2150 is compressed. For example, the applicator 2150 may be a porous foam such as including without limitation a polyurethane foam or other open cell porous material. Thus, in the exemplified embodiment the applicator 2150 can be formed of any type of material through which a liquid can travel via capillary action or capillary flow. Specifically, the capillary material can be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. Furthermore, although described herein as being formed of a capillary material, the invention is not to be so limited in all embodiments and some alternative embodiments will be described herein below. For example, in certain embodiments the applicator 2150 may be formed of a plastic material or a rubber material and may have an orifice formed therethrough to enable the liquid to flow through the applicator for application to a biological surface such as a user's oral cavity, facial surfaces, or the like.

Referring to FIGS. 11 and 13-17 concurrently, the liquid supply apparatus 2200 will be described in more detail. The liquid supply apparatus 2200 generally comprises a housing 2210 having an inner surface 2209 that defines a storage cavity 2211 and a venting cavity 2212, a hub component 2240 mounted within the storage cavity 2211, and a capillary member 2180 extending through the storage and venting cavities 2211, 2212 of the housing 2210. In the exemplified embodiment the housing 2210 is a separate component from the personal care implement 2100 that is insertable into a handle cavity 2170 of the personal care implement 2100. However, in other embodiments portions of the housing 2210 may be formed by the body 2101 of the personal care implement 2100 rather than having a separate insertable housing 2210.

The storage cavity 2211 is for storing a liquid that is dispensed via the applicator 2150 as described herein. The venting cavity 2212 is spatially coupled to the storage cavity 2211 as described in more detail below and it is the location through which air/gas can be vented from the storage cavity 2211 to the external environment or vice versa as needed to ensure acceptable flow of the liquid while eliminating the potential for leaks. Although air/gas can pass from the storage cavity 2211 to the venting cavity 2212 as described herein, liquid stored in the storage cavity 2211 cannot pass/flow into the venting cavity 2212 under normal usage conditions. The capillary member 2180 promotes the flow and transport of the liquid from the storage cavity 2211 to the applicator 2150 or other location where it can be dispensed and applied onto a desired surface.

The storage cavity 2211 extends along a cavity axis 2B-2B from a first end 2205 to a second end 2206. More specifically, the storage cavity 2211 has a floor 2207 at the first end 2205 thereof and a roof 2208 at the second end 2206 thereof. Thus, the floor 2207 forms a lower boundary of the storage cavity 2211, the roof 2208 forms an upper boundary of the storage cavity 2211, and the inner surface 2209 of the housing 2210 forms the remaining boundary of the storage cavity 2211. The roof 2208 separates the storage cavity 2211 from the venting cavity 2212.

The capillary member 2180 is designed to flow or otherwise transport the liquid from the storage cavity 2211 to the applicator 2150 or other desired location for dispensing onto a desired surface. The capillary member 2180 extends from a first end 2183 that is located within the storage cavity 2211 and fluidly coupled to the liquid stored in the storage cavity 2211 to a second end 2184 that is fluidly coupled to the applicator 2150. The capillary member 2180 may extend along the cavity axis 2B-2B or it may be offset therefrom.

The capillary member 2180 is at least partially located within the storage cavity 2211 so that the capillary member 2180 is fluidly coupled to the store of the liquid that is located within the storage cavity 2211. Specifically, the capillary member 2180 has a first portion 2181 that includes the first end 2183 that is located within the storage cavity 2211. The capillary member 2180 extends from the housing 2210 and through a passageway 2172 in the personal care implement 2100 to the applicator 2150 so that the capillary member 2180 can draw liquid from the store of the liquid in the storage cavity 2211 and transport that liquid to the applicator 2150 where it can be dispensed at an appropriate time and location.

In the exemplified embodiment, the capillary member 2180 is a capillary tube having a capillary passageway 2185 extending entirely through the capillary member 2180 from the first end 2183 to the second end 2184 that permits the liquid to flow within the capillary member 2180 from the first end 2183 to the second end 2184 via a wicking action. Thus, in this manner the liquid is able to flow from its storage location within the storage cavity 2211 of the housing 2210 to the applicator 2150 so that the applicator 2150 can be loaded with the liquid. Specifically, the passageway 2185 may have a cross-sectional size and shape that permits flow of the liquid all the way from the storage cavity 2211 to the applicator 2150 to ensure that the applicator 2150 remains loaded with the liquid. As some of the liquid is dispensed from the applicator 2150, the capillary member 2180 transports an additional amount of the liquid to the applicator 2150.

In other embodiments, the capillary member 2180 may be formed of a porous material, such as any of the materials described above with reference to the applicator 2150. In such embodiments the liquid may flow up the capillary member 2180 via a wicking action (also referred to herein as capillary action) due to the material of the capillary member 2180 (for example if the capillary member 2180 is formed from a porous material). In either embodiment, the flow of the liquid occurs naturally via capillary action without the need for a separate pump.

In certain embodiments, the capillary member 2180 has a capillary structure which may be formed in numerous configurations and from numerous materials operable to produce fluid flow via capillary action. In one non-limiting embodiment, the capillary member 2180 may be configured as a tube or lumen having an internal open capillary passageway extending between ends of the capillary member which is configured and dimensioned in cross section to produce capillary flow. The lumen or open capillary passageway may have any suitable cross sectional shape and configuration. In such embodiments the capillary member 2180 may be formed of a porous material as described below or a non-porous material (e.g., plastics such as polypropylene, metal, rubber, or the like). In other non-limiting embodiments, capillary member 2180 may be formed of a porous and/or fibrous material of any suitable type through which a fluid can travel via capillary action or flow. Examples of suitable materials include without limitation fibrous felt materials, ceramics, and porous plastics with open cells (e.g. polyurethane, polyester, polypropylene, or combinations thereof) including such materials as those available from Porex Technologies, Atlanta, Ga. The capillary member material may therefore be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. A mixture of porous and/or fibrous materials may be provided which have a distribution of larger and smaller capillaries. The capillary member 2180 can be formed from a number of small capillaries that are connected to one another, or as a larger single capillary rod. The capillary member whether formed as a lumen or of porous or fibrous materials may have any suitable polygonal or non-polygonal cross sectional shape including for example without limitation circular, elliptical, square, triangular, hexagonal, star-shaped, etc. The invention is not limited by the construction, material, or shape of the capillary member.

In the exemplified embodiment, the capillary member 2180 has openings into the passageway 2185 only at the first end 2183 thereof and at the second end 2184 thereof. There are no other openings along the length of the capillary member 2180 that permit the liquid to enter into the passageway 2185 of the capillary member 2180. Thus, the liquid within the storage cavity 2211 can only enter into the passageway 2185 of the capillary member 2180 through the opening in the first end 2183 of the capillary member 2180. Thus, in certain orientations of the housing 2210 and certain liquid levels within the storage cavity 2211, the liquid is unable to enter into the passageway 2185 of the capillary member 2180 because it is not in contact with the opening in the first end 2183 of the capillary member 2180. Of course, in other embodiments additional openings may be provided in the capillary member 2180 through which liquid can enter into the passageway 2185 of the capillary member 2180.

In the exemplified embodiment the housing 2210 is formed of a first housing component 2201 and a second housing component 2202. Furthermore, the first housing component 2201 has a flange 2203 that is insertable into the second housing component 2202 to couple the upper and lower parts 2201, 2202 together via an interference or friction fit, although other mechanisms for coupling the upper and lower parts 2201, 2202 of the housing 2210 together may also be used in other embodiments (adhesive, engaging threaded surfaces, or the like). Of course, the flange 2203 could be on the second housing component 2202 rather than the first housing component 2201. It may also be possible to form the housing 2210 as a single part in other embodiments.

In the exemplified embodiment, the housing 2210 is a separate component from the handle 2110 of the personal care implement 2100. For example, in one embodiment the housing 2210 could be a stand-alone device such as a cartridge that is insertable into the handle cavity 2170 of the handle 2110 of the personal care implement 2100. In such an embodiment the housing 2210 would not form any portion of the handle 2110, but rather it would be wholly retained therein. In another embodiment the housing 2210 could be a stand-alone device that operates independently without being inserted into any separate product (such as the personal care implement 2100). Thus, the housing 2210 could include all features for storing the liquid and it may be coupled to or include additional features, such as an applicator, for applying the liquid to a desired surface without being coupled to or forming a part of a personal care implement. However, in other embodiments the housing 2210 may form a portion of the handle 2110 of the personal care implement 2100.

The liquid supply apparatus 2200 is designed to permit air to replace liquid that is dispensed from the storage cavity 2211 during use to ensure consistent liquid flow and to vent the storage cavity 2211 to prevent air from expanding within the storage cavity 2211 and causing the liquid to leak out in an undesired manner. Specifically, increases in temperature and decreases in pressure cause air to expand, and if air expands within the storage cavity 2211 without being vented it will exert a pressure on the liquid in the storage cavity 2211 which could result in a leak situation. In the exemplified embodiment this scenario is dealt with by including the liquid supply apparatus 2200, which comprises a vent tube 2230 and a hub component 2240. In the exemplified embodiment, the first housing component 2201 comprises the vent tube 2230, and the first housing component 2201 is coupled to the second housing component 2202 so that the vent tube 2230 extends into the second housing component 2202. Specifically, the second housing component 2202 defines the storage cavity 2211 and the vent tube 2230 extends into the storage cavity 2211.

The vent tube 2230 has an outer surface 2231 and an inner surface 2232 that defines a passageway 2234 extending along the entire length of the vent tube 2230. Specifically, the vent tube 2230 extends from a first end 2235 adjacent the floor 2207 of the storage cavity 2211 to an opposite second end 2236 adjacent the roof 2208 of the storage cavity 2211 and the venting cavity 2212. In the exemplified embodiment, the passageway 2234 of the vent tube 2230 is tapered such that its transverse cross-sectional area increases from the first end 2235 of the vent tube 2230 to the second end 2236 of the vent tube 2230.

The capillary member 2180 extends through the housing 2210 within the passageway 2234 of the vent tube 2230 and protrudes from the second end 2236 of the vent tube 2230 where it passes into the venting cavity 2212 and the passageway 2172 to the applicator 2150. Although it is located within the passageway 2234 of the vent tube 2230, an outer surface 2189 the capillary member 2180 is spaced from the inner surface 2232 of the vent tube 2230 along at least a portion of its length by an annular gap 2186. Specifically, due to the tapering nature of the passageway 2234, the vent tube 2230 is in contact with the capillary member 2180 at the first end 2235 of the vent tube 2230, but the vent tube 2230 is spaced from the capillary member 2180 at the second end 2236 of the vent tube 2230 by the annular gap 2186. The transverse cross-sectional area of the annular gap 2186 increases from the first end 2235 of the vent tube 2230 to the second end 2236 of the vent tube 2230. The annular gap 2186 that is formed between the inner surface 2232 of the vent tube 2230 and the outer surface 2189 of the capillary member 2180 forms a primary vent passageway 2250 of the vent tube 2230.

Although in the exemplified embodiment the passageway 2234 of the vent tube 2230 tapers, the invention is not to be so limited. In other embodiments, the passageway 2234 may have a constant transverse cross-sectional area along most of its length, except at the first end 2235 of the vent tube 2230 where the passageway 2234 may have a decreased transverse cross-sectional area. In this manner, the vent tube 2230 would still contact the capillary member 2180 at the first end 2235 and be spaced from the capillary member 2180 by the annular gap 2186 at locations other than the first end 2235, but the transverse cross-sectional area of the annular gap 2186 will be constant.

Because the vent tube 2230 is in contact with the capillary member 2180 at the first end 2235 of the vent tube 2230, fluids (air and liquid) within the storage cavity 2211 are prevented from entering into the annular gap 2186 (and into the primary vent passageway 2250) at the first end 2235 of the vent tube 2230. However, the vent tube 2230 has a plurality of vent apertures 2233 extending from the outer surface 2231 of the vent tube 2230 to the inner surface 2232 of the vent tube 2230 that are sized and configured to permit air/gas to pass therethrough. Specifically, each of the vent apertures 2233 place the storage cavity 2211 into spatial/fluid communication with the primary vent passageway 2250 (i.e., with the annular gap 2186). Thus, as discussed in more detail below, air/gas is able to pass from the storage cavity 2211 into the primary vent passageway 2250, and then upwardly within the primary vent passageway 2250 to the venting cavity 2212 where it can be vented to the external atmosphere via a handle vent aperture 2119 (FIG. 13). In certain embodiments the venting cavity 2212 may be omitted and the primary vent passageway 2250 may be fluidly/spatially coupled directly to the handle vent aperture 2119 without first passing through a separate venting cavity.

In the exemplified embodiment the handle vent aperture 2119 is oriented orthogonal to the longitudinal axis 2A-2A of the personal care implement 2100. However, in other embodiments the handle vent aperture 2119 may be oriented oblique to the longitudinal axis 2A-2A of the personal care implement 2100 (and to the cavity axis 2B-2B) to limit blockage or by preventing debris from entering into the handle vent aperture 2119.

In the exemplified embodiment, the vent apertures 2233 are positioned at different axial locations along the length of the vent tube 2230. Thus, the vent apertures 2233 include at least one lower vent aperture 2233*a* adjacent to the first end 2205 of the storage cavity 2210 and at least one upper vent aperture 2233*b* adjacent to the second end 2206 of the storage cavity 2210. Although the vent apertures 2233 are located at three different axial heights along the vent tube 2230 in the exemplified embodiment, the invention is not to be so limited and more (or less) vent apertures can be included on the vent tube 2230 in other embodiments. In the exemplified embodiment, there is a at least one additional vent aperture 2137 formed into the floor 2207 of the storage cavity 2211 and at least one additional vent aperture 2138 formed into the roof 2208 of the storage cavity 2211. These additional vent apertures 2137, 2138 may be included to ensure adequate spatial/fluid communication exists between the storage cavity 2211 and the external atmosphere as described in more detail herein below with specific reference to FIGS. 18A-18D. Thus, the location of the vent apertures 2233, 2137, 2138 are specifically selected so that irrespective of the inclination (vertical upright, vertical upside-down, tilted at any of various angles, or the like) and rotational orientation of the housing 2210 relative to a gravitational vector, at least one of the vent apertures 2233, 2137, 2138 is in fluid communication with a gas or air pocket in the storage cavity 2211.

Figure 15:
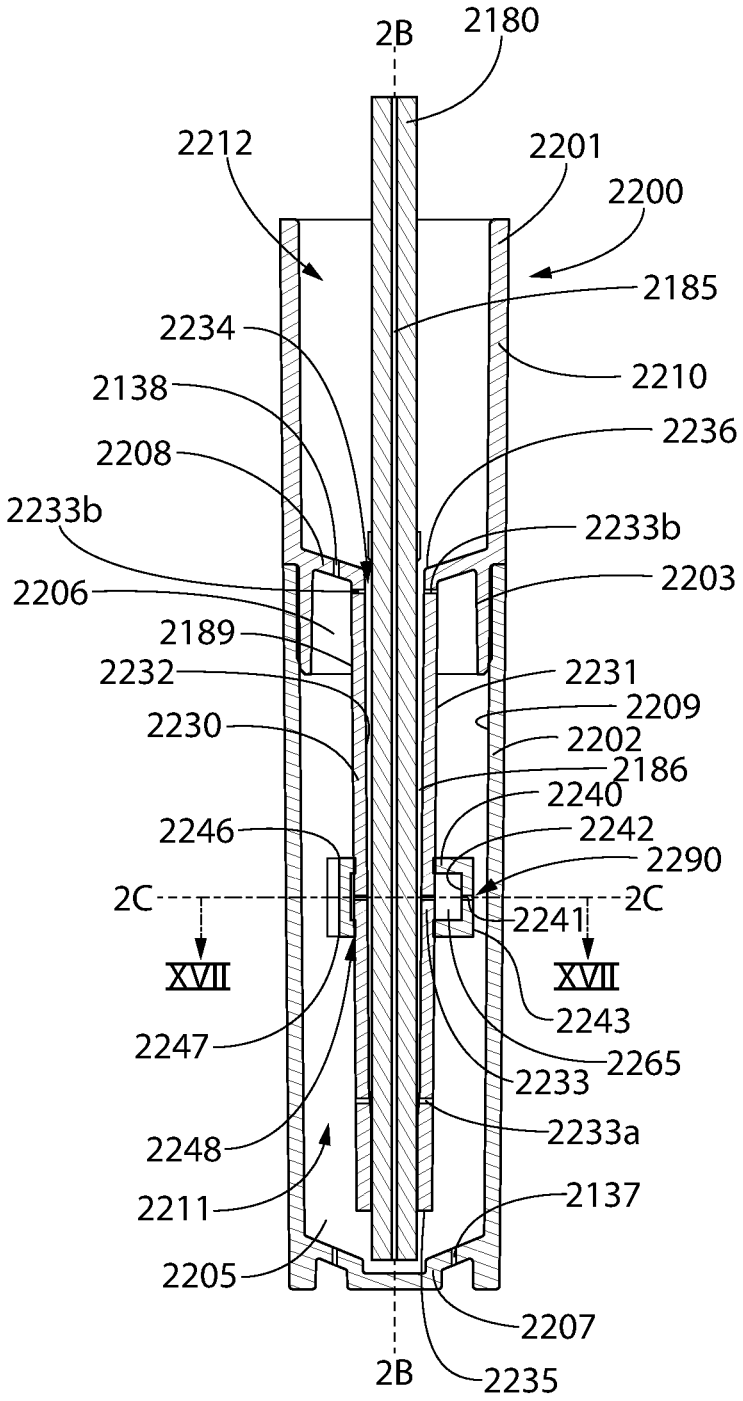
FIG. 15 is a cross-sectional view taken along line XV-XV in FIG. 14.
Figure 16A:
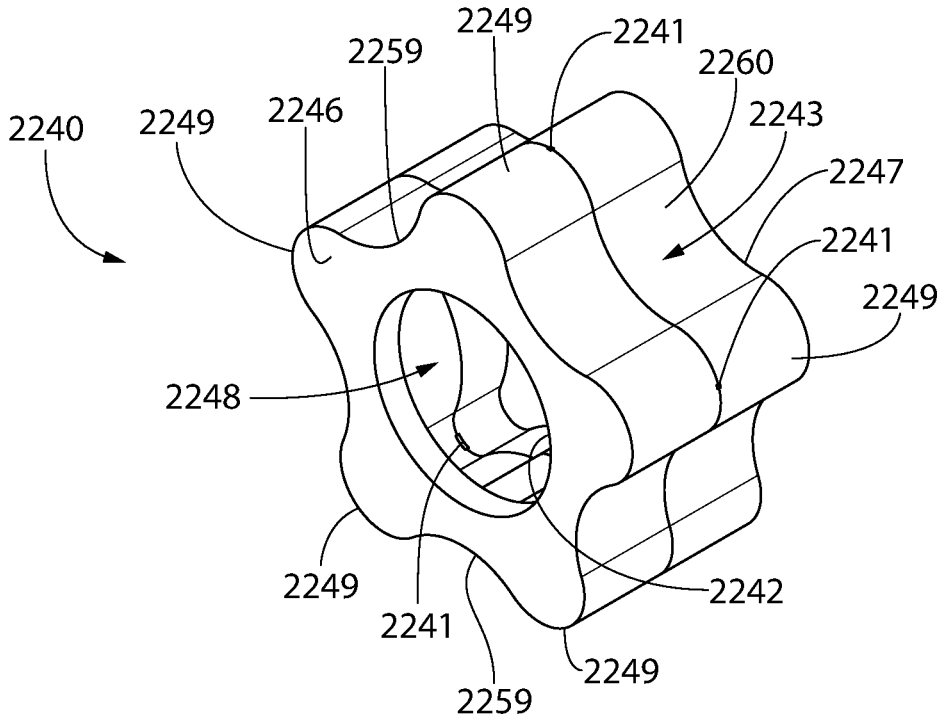
FIG. 16A is a perspective view of a portion of a hub component of the liquid supply apparatus of FIG. 11.
Figure 16B:
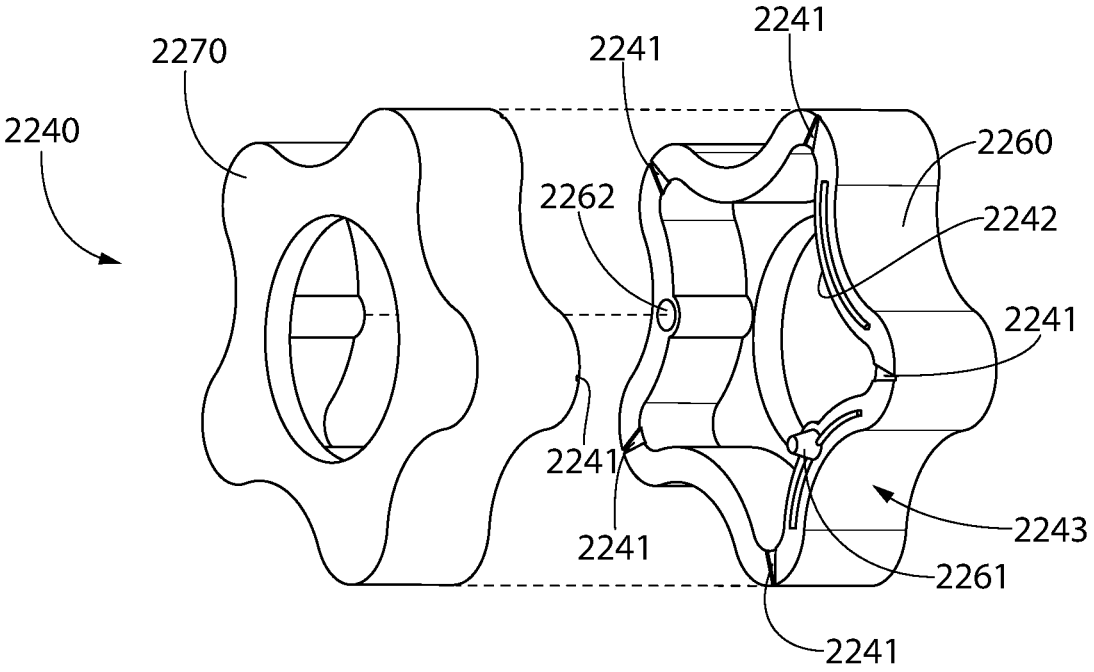
FIG. 16B is an exploded view of the hub component of FIG. 16A.
Figure 17:
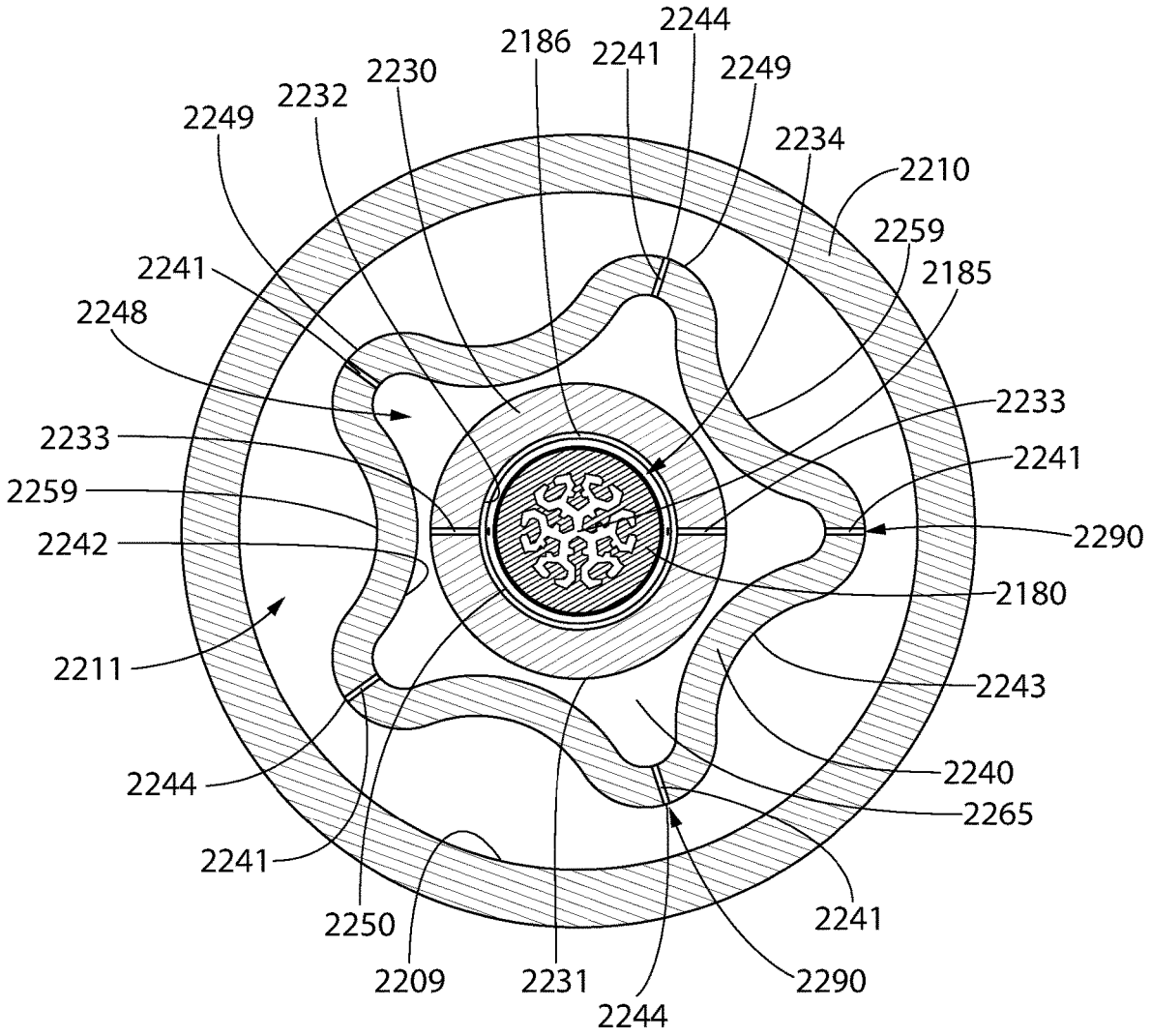
FIG. 17 is a cross-sectional view taken along line XVII-XVII in FIG. 15.

Referring to FIGS. 15-17, the hub component 2240 will be further described. In the exemplified embodiment, the hub component 2240 is formed of a first part 2260 and a second part 2270. The first part 2260 has a protuberance 2261 and a recess 2262. The second part 2270 has a similar protuberance and recess, although they are not visible on the illustrations of the second part 2270 provided herewith. The protuberance 2261 of the first part 2260 mates with the recess of the second part 2270 and the recess 2262 of the first part 2260 mates with the protuberance of the second part 2270 to couple the first and second parts 2260, 2270 together. Of course, other mechanisms can be used to couple the first and second parts 2260, 2270 together in other embodiments. Furthermore, in still other embodiments the hub component 2240 may be formed of a single part rather than two parts. Each of the first and second parts 2260, 2270 has cut-outs or notches therein such that when the first and second parts 2260, 2270 are coupled together, the cut-outs/notches are aligned to thereby form vent apertures 2241 that extend from an outer side surface 2243 of the hub component 2240 to an inner surface 2242 of the hub component 2240. The vent apertures 2241 of the hub component 2240 and the vent apertures 2233 of the vent tube 2230 that are aligned with the hub component 2240 as described herein each form a portion of a radial vent passageway 2290 as described more fully herein below.

In the exemplified embodiment, the hub component 2240 is in the shape of a five-sided star. However, the invention is not to be so limited and the hub component 2240 may have other shapes so long as it achieves the function described herein. Specifically, the hub component 2240 may be a star having less than five sides (i.e., three or four sides) or more than five sides (i.e., six sides, seven sides, eight sides, etc.). Alternatively, the hub component 2240 could simply have a main body and a plurality of arms protruding from the main body in a radial manner such that each of the arms forms a venting passageway. In one embodiment, the hub component 2240 may comprise a central portion and a spoke portion or a plurality of spoke portions such that the spoke portions form portions of the radial vent passageways. In another embodiment, the hub component 2240 could simply comprise separate structures each defining a vent passageway from the storage cavity 2211 to one of the vent apertures 2233 of the vent tube 2230 as described herein. Thus, it should be appreciated that although one specific embodiment for the hub component 2240 is illustrated in the drawings, the invention is not to be particularly limited to the shape exemplified in all embodiments.

The hub component 2240 comprises an inner surface 2242, an outer side surface 2243, an outer top surface 2246, and an outer bottom surface 2247. The hub component 2240 comprises a plurality of the vent apertures 2241 extending through the hub component 2240 from the outer side surface 2243 to the inner surface 2243. Furthermore, the hub component 2240 comprises a passageway 2248 extending from the outer top surface 2246 to the outer bottom surface 2247. The hub component 2240 may be mounted within the storage cavity 2211 with the vent tube 2230 located within and extending through the passageway 2248. Thus, the hub component 2240 may be mounted directly to the vent tube 2230 in some embodiments. The hub component 2240 may be mounted to the vent tube 2230 using mechanical means, fasteners, adhesion, interference fit, protuberance/detent, or the like.

When the hub component 2240 is mounted within the storage cavity 2211, the vent apertures 2241 are radially arranged about the cavity axis 2B-2B of the storage cavity 2211. Stated another way, each of the vent apertures 2241 extends radially from the cavity axis 2B-2B towards the inner surface 2209 of the housing 2210 in a spaced apart manner. Each of the vent apertures 2241 of the hub component 2240 terminates in a vent opening 2244 at the outer side surface 2243 of the hub component 2240. The vent openings 2244 are radially spaced from the cavity axis 2B-2B and arranged in a spaced apart manner to circumferentially surround the cavity axis 2B-2B. In one embodiment, all of the vent openings 2244 are intersected by a single reference plane 2C-2C that is orthogonal to the cavity axis 2B-2B.

In one embodiment, the hub component 2240 has a shape such that the outer side surface 2243 undulates and comprises a plurality of apex portions 2249 and a plurality of valley portions 2259 such that one of the valley portions 2259 is located between each pair of adjacent apex portions 2249 and vice versa. The apex portions 2249 of the hub component 2240 are the portions of the hub component 2240 that extend furthest from the cavity axis 2B-2B when the hub component 2240 is coupled to the vent tube 2230 as described herein below. In the exemplified embodiment, the hub component 2240 has five of the apex portions 2249 and five of the valley portions 2259 (hence the five-sided star) although more or less than five apex and valley portions 2249, 2259 are possible in other embodiments.

In the exemplified embodiment, the vent openings 2244 are located at the outer side surface 2243 of the hub component 2240 at the apexes 2249 of the hub component 2240. Thus, the vent openings 2244 are located adjacent to the inner surface 2209 of the housing 2210. In one embodiment, the distance between the vent openings 2244 and the inner surface 2209 of the housing 2210 may be between 0.5 mm and 2.0 mm. Maintaining the vent openings 2244 closely spaced to the inner surface 2209 of the housing 2210 ensures that at least one of the vent openings 2244 is fluidly coupled to an air pocket within the storage cavity 2211 when the housing 2210 is in an orientation such that none of the other vents are fluidly coupled to the air pocket, as discussed in more detail below with reference to FIGS. 18A-18D. Thus, the vent apertures 2241 of the hub component 2240 and the vent apertures 2233 and the passageway 2234 of the vent tube 2230 work cooperatively (as the radial vent passageways 2290) to permit proper venting of the storage cavity 2211 to ensure that the storage cavity 2211 is vented to the external atmosphere regardless of the orientation of the housing 2210.

Although described herein as being "radial," the radial vent passageways 2290 need not be radial in a linear sense. Specifically, the term "radial" as referring to the radial vent passageways 2290 merely means that the radial vent passageways 2290 extend from a first point (i.e., at the openings 2244 of the vent apertures 2241) that is located a first distance from the cavity axis 2B-2B to a second point (i.e., at the openings of the vent apertures 2233 of the vent tube 2230 at the inner surface 2232 of the vent tube 2230) that is located a second distance from the cavity axis 2B-2B, the second distance being less than the first distance. Thus, this "radial" path may be linear, tortuous, or the like so long as it extends from a first point a first (greater)distance from the cavity axis 2B-2B to a second point a second (lesser) distance from the cavity axis 2B-2B).

The radial vent passageways 2290, the vent apertures 2233 that are not aligned with the hub component 2240, and the additional vent apertures 2137, 2138 may be individually referred to herein as "vents" in some embodiments because each is able to vent air from the storage cavity 2211 to the external atmosphere. Thus, when the term "vents" is used, it may be referring to any of one or more of the radial vent passageways 2290, the vent apertures 2233 that are not aligned with the hub component 2240, and the additional vent apertures 2137, 2138.

The hub component 2240 may be formed from any material desired, including rigid materials like plastic, wood, metal, or the like and more flexible materials like thermoplastic elastomers, rubbers, or the like. In some embodiments, the hub component 2240 may be formed via an injection molding process. In other embodiments, the hub component 2240 may be formed by a 3D printing or other additive manufacturing process.

In the exemplified embodiment, the hub component 2240 is placed within the storage cavity 2211 and mounted to the vent tube 2230 so that a manifold chamber 2265 is formed between the inner surface 2242 of the hub component 2240 and the outer surface 2231 of the vent tube 2230. The manifold chamber 2265 may be an annular space that surrounds the vent tube 2230 in some embodiments. The hub component 2240 may be mounted to the vent tube 2230 in a hermetically sealed manner so that air/gas that enters into the manifold chamber 2265 can only exit the manifold chamber 2265 via the vent apertures 2233 in the vent tube 2230 or the vent apertures 2241 in the hub component 2240.

In the exemplified embodiment, the vent apertures 2241 of the hub component 2240, the manifold chamber 2265, and the vent apertures 2233 of the vent tube 2230 collectively form the radial vent passageways 2290, which extend from the storage cavity 2211 to the primary vent passageway 2250. Although described herein as being "radial," in certain embodiments the radial vent passageways 2290 do not extend in a perfectly linear/radial manner. Rather, the radial vent passageways 2290 may form pathways between the vent apertures 2241 of the hub component 2240 and the vent apertures 2233 of the vent tube 2230 that are spatially coupled via the manifold chamber 2265 but that are not circumferentially aligned with one another. The hub component 2240 is coupled to the vent tube 2230 at an axial location along the vent tube 2230 such that at least one of the vent apertures 2233 of the vent tube 2230 is in fluid or spatial communication with the manifold chamber 2265. As a result, air/gas can pass from the storage cavity 2211 into the manifold chamber 2265 via the vent apertures 2241, from the manifold chamber 2265 to the primary vent passageway 2250 via the vent apertures 2233, and then up the primary vent passageway 2250 to the venting cavity 2212 where it can flow to the external atmosphere as discussed more fully below.

As an alternative embodiment, the manifold chamber 2265 may be omitted and the hub component 2240 may be coupled to the vent tube 2230 so that the vent apertures 2241 in the hub component 2240 are directly transversely aligned with the vent apertures 2233 in the vent tube 2230. In this alternative embodiment, the air/gas in the storage cavity 2211 would pass from the storage cavity 2211 and into the primary vent passageway 2250 of the vent tube 2230 via the vent apertures 2241 of the hub component 2240 and the vent apertures 2233 of the vent tube 2230 without passing into any intermediate chamber. However, including the manifold chamber 2265 may be beneficial in that it allows for a greater degree of tolerance such that the vent apertures 2241 of the hub component 2240 do not need to be perfectly aligned with the vent apertures 2233 of the vent tube 2230 to permit proper functionality of the apparatus. Rather, the vent apertures 2241 of the hub component 2240 and the vent apertures 2233 of the vent tube 2230 need only be aligned with the manifold chamber 2265.

As discussed in greater detail below with reference to FIGS. 18A-18D, the vents 2290, 2233, 2137, 2138 are positioned in such a manner that there are no pockets of trapped air within the storage cavity 2211, regardless of orientation of the housing 2210, that can expand due to increases in temperature or decreases in pressure (both of which would exert pressure on the liquid in the storage cavity 2211 and cause it to be expelled in an uncontrolled manner). Rather, any air pockets are always spatially/fluidly coupled to the exterior atmosphere (via the vents 2290, 2233, 2137, 2138, the primary vent passageway 2150, and the handle vent apertures 2118, 2119) so that as a result of any increases in temperature or decreases in pressure (i.e., expansion of the air/gas), the air/gas in the air pockets will exit the storage cavity 2211 rather than exert pressure on the liquid and cause it to leak out of the storage cavity 2211. In order to achieve this, at least one of the radial vent passageways 2290 may be positioned along the housing 2210 at a location that is aligned with a maximum internal diameter of the storage cavity 2211.

In the exemplified embodiment, the hub component 2240 is located in a middle axial section of the storage cavity 2211 between the first and second ends 2205, 2206 thereof. However, the invention is not to be so limited in all embodiments and in certain embodiments, depending on the locations of the maximum diameter of the storage cavity 2211, the hub component 2240 may be positioned at other locations. Specifically, the maximum diameter region of the storage cavity 2211 could be closer to the first or second ends 2205, 2206 of the storage cavity 2211, and in such embodiments the location of the hub component 2240 within the storage cavity 2211 may change as well. As the orientation of the housing 2210 changes, the liquid in the storage cavity 2211 will move around and the location of the air pockets will change. However, air pockets that form will be located in the regions of the storage cavity 2211 that has the maximum internal diameter. Thus, keeping the hub component 2240 in alignment with the maximum internal diameter portion of the storage cavity 2211 ensures that one of the radial vent passageways 2290 is in spatial communication with gas/air pockets of the storage cavity 2211.

The vents, which includes the radial vent passageways 2290 (specifically the vent apertures 2241 of the hub component 2240 of the radial vent passageways 2290), the vent apertures 2233, 2233*a*, 2233*b* of the vent tube 2230, and the additional vent apertures 2137, 2138, may be configured to prevent the liquid stored within the storage cavity 2211 from passing therethrough at ambient temperature and with a pressure equilibrium existing between the storage cavity 2211 and the external atmosphere while permitting air/gas within the storage cavity 2211 to pass therethrough. Specifically, the vent apertures 2241, 2233, 2233*a*, 2233*b*, 2137, 2138 permit air/gas to pass therethrough to vent the storage cavity 2211 so that as air expands it passes to the exterior atmosphere rather than putting pressure on the liquid in the storage cavity 2211 which could create a leak. Specifically, as long as the vent apertures 2241, 2233, 2233*a*, 2233*b*, 2137, 2138 are not clogged, the gas/air will be capable of freely passing through the vent apertures 2241, 2233, 2137,

2138 both into and out of the storage cavity 2211 as needed (during periods of compression and expansion or the gas) to provide proper air intake and venting to ensure proper operation of the device (i.e., consistent liquid flow during use) without leakage. At the same time, the vent apertures 2241, 2233, 2233*a*, 2233*b*, 2137, 2138 are designed to prevent the liquid from passing therethrough because this could create a leak situation.

There are several ways that the vent apertures 2241, 2233, 2233*a*, 2233*b*, 2137, 2138 can be configured to achieve the functionality of permitting air/gas to pass therethrough while preventing liquid from passing therethrough. First, this may be accomplished by specifically selecting the dimensions of the vent apertures 2241, 2233, 2233*a*, 2233*b*, 2137, 2138, based on the viscosity and surface tension of the liquid, to ensure that the liquid cannot pass through the vent apertures 2241, 2233, 2233*a*, 2233*b*, 2137, 2138 under the conditions noted above. For example without limitation, in one embodiment the vent apertures 2241, 2233, 2233*a*, 2233*b*, 2137, 2138 may have a diameter in a range of 0.05 mm and 0.5 mm, and more specifically in a range of 0.1 mm and 0.3 mm. Alternatively, the vent apertures 2241, 2233, 2233*a*, 2233*b*, 2137, 2138 may be covered with a selective membrane that permits gas/air to pass therethrough in both directions while preventing the liquid from passing therethrough. In other embodiments, the material of the structure that forms the vent apertures 2241, 2233, 2233*a*, 2233*b*, 2137, 2138 may be selected to prevent the liquid from passing therethrough while permitting gas/air to pass therethrough (hydrophobic versus hydrophilic). Still further, the walls that define/surround the vent apertures 2241, 2233, 2233*a*, 2233*b*, 2137, 2138 may have a jagged shape or the like that prevents liquid from passing therethrough under the conditions identified above. Thus, there are many different ways that the vent apertures 2241, 2233, 2233*a*, 2233*b*, 2137, 2138 can be configured to permit air to flow therethrough while preventing liquid from passing therethrough at ambient temperature and with a pressure equilibrium existing as noted above.

The hub component 2240 and its vent apertures 2241 along with the vent apertures 2233 of the vent tube 2230 and the additional vent apertures 2137, 2138 described herein operates as an air intake and venting system to allow air to replace the liquid that is dispensed from the storage cavity 2211 over time during use. Specifically, each of the radial vent passageways 2290 forms a pathway from the storage cavity 2211 to the primary vent passageway 2250 of the vent tube 2230, and the primary vent passageway 2250 forms a pathway from each of the radial vent passageways 2290 to the external atmosphere as described in more detail below. Similarly, the vent apertures 2233*a*, 2233*b* that are not aligned with the hub component 2240 form a pathway from the storage cavity 2211 to the primary vent passageway 2250. Furthermore, the vent aperture 2137 forms a pathway from the storage cavity 2211 to the external atmosphere via a handle vent aperture 2118 and the vent aperture 2138 forms a pathway from the storage cavity 2211 to the venting cavity 2212 and the handle vent aperture 2119 forms a pathway from the venting cavity 2212 to the external passageway. The shape of the hub component 2240, and specifically the fact that it has apexes 2249 on which the vent openings 2244 of the vent apertures 2241 are located in a closely spaced manner relative to the inner surface 2209 of the housing 2210, ensures that the air pockets in the storage cavity 2211 are always vented to the external atmosphere regardless of the orientation (inclination and rotational) of the housing 2210. This helps to ensure consistent flow of the liquid during use and prevents uncontrolled liquid leakage regardless of the orientation at which the housing 2210 is positioned and regardless of changes in temperature and pressure.

In some embodiments, the upper vent aperture 2233*b* and the vent aperture 2138 permit proper venting of the storage cavity 2211 when the housing 2210 is in an upright orientation and the vent openings 2244, the lower vent aperture 2233*a*, and the vent aperture 2137 are submerged by the liquid in the storage cavity 2211. The lower vent aperture 2137 permits proper venting of the storage cavity 2211 when the housing 2210 is in a vertical but inverted orientation and the vent openings 2244, the upper/lower vent aperture 2233*a*, 2233*b*, and the vent aperture 2138 are submerged by the liquid in the storage cavity 2211. The plurality of radial vent passageways 2290 permit proper venting of the storage cavity 2211 when all of the other vent apertures are submerged by the liquid in the storage cavity 2211 but at least one of the plurality of vent apertures 2241, and specifically its associated vent opening 2244, remains outside of the liquid in the storage cavity 2211. In every instance that the vent apertures 2137, 2138 are covered by the liquid in the storage cavity 2211, regardless of the specific orientation of the housing 2210, at least one of the vent openings 2244 of the vent apertures 2241 will be located outside of the liquid so that it is spatially coupled to the gas within the storage cavity 2211. Thus, in certain embodiments, regardless of the orientation of the housing 2210 there remains one vent available for venting the storage cavity 2211 which assists in preventing liquid leaks.

In the exemplified embodiment, a passageway exists from the storage cavity 2211 to the external atmosphere as follows: (1) from the storage cavity 2211 through the vent aperture 2137 and then through the handle vent aperture 2118 to the external atmosphere; (2) from the storage cavity 2211 through the vent aperture 2138 to the venting cavity 2212, and from the venting cavity 2212 to the external atmosphere via the handle vent aperture 2119; (3) from the storage cavity 2211 through one of the vent apertures 2233*a*, 2233*b* in the vent tube 2230 to the primary vent passageway 2250, from the primary vent passageway 2250 to the venting cavity 2212, and from the venting cavity 2212 to the external atmosphere via the handle vent aperture 2119; and (4) from the storage cavity 2211 through one of the radial vent passageways 2290 (i.e., through one of the vent openings 2244 into one of the vent apertures 2241, from the vent aperture 2241 into the manifold chamber 2265 and then into one of the vent apertures 2233 in the vent tube 2230 to the primary vent passageway 2250), and from there to the venting cavity 2212 and to the external atmosphere via the handle vent aperture 2119.

Referring now to FIGS. 18A-18D, operation of the liquid supply apparatus 2200 of the personal care implement 2100 will be described. It should be appreciated that the functionality described herein can be utilized with a stand-alone cartridge that operates independently or upon insertion into the handle cavity 2170 of a personal care implement 2100 as described above. In certain embodiments, the vents are located and arranged such that irrespective of the vertical and angular orientation of the housing 2210 relative to a gravitational vector GV, at least one of the vents is in spatial communication with a gas 2109 located within the storage cavity 2211 of the housing 2210 rather than with a liquid 2108 located within the storage cavity 2211 of the housing 2210. As used herein, the gravitational vector GV is a vector illustrating the direction of the force of gravity applied to the housing 2210 at a given orientation of the housing 2210.

Figure 18A:
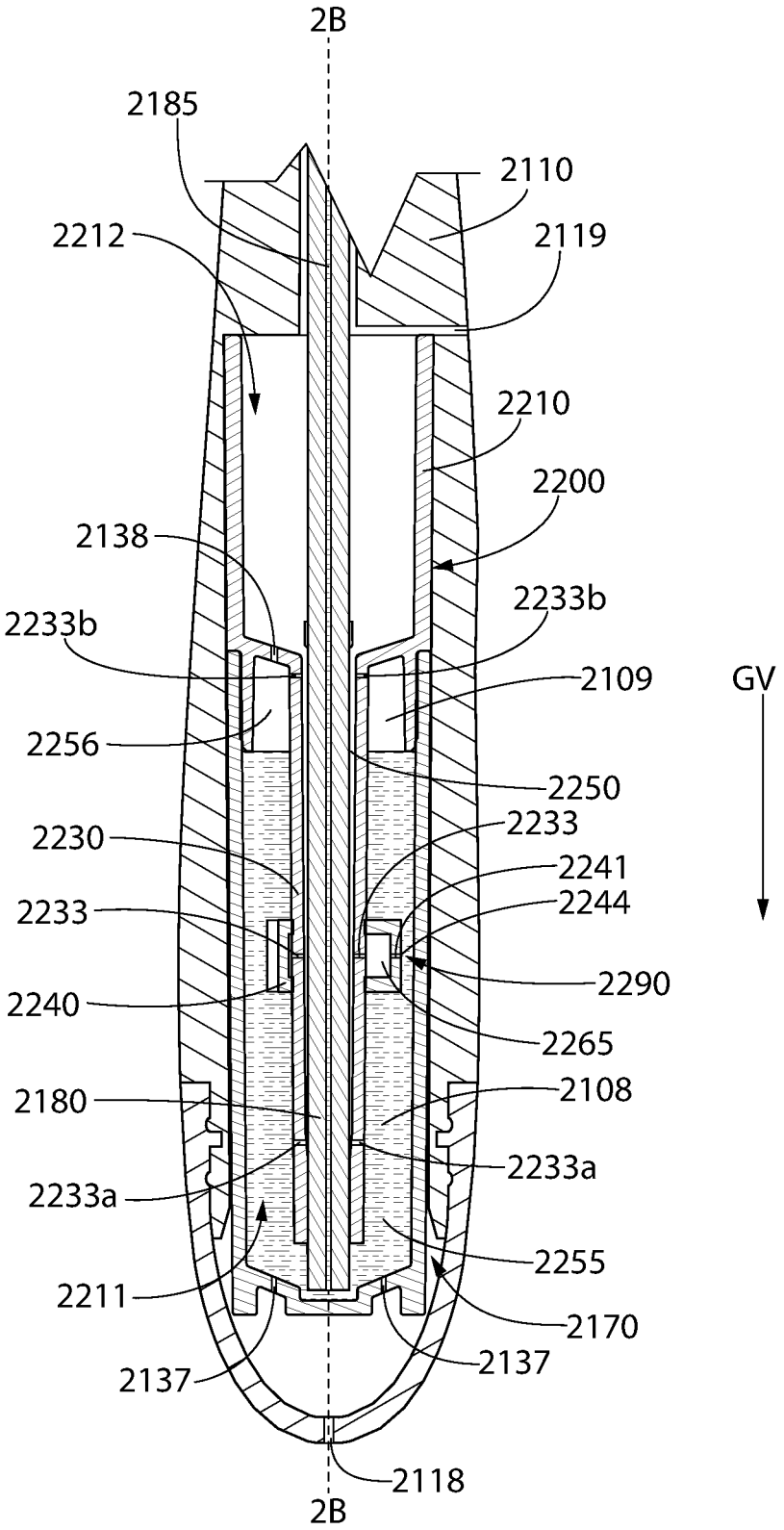
FIG. 18A is a close-up view of area XVIII of FIG. 13 with liquid in a storage cavity of the liquid supply apparatus and with the personal care implement in a first orientation.

FIG. 18A illustrates the housing 2210 positioned in an upright orientation. As shown here, the storage cavity 2211 of the housing 2210 has a total volume that is occupied by the liquid 2108 and the gas 2109. Thus, the total volume of the storage cavity 2211 is occupied collectively by the liquid 2108 and the gas 2109.

In the exemplified embodiment, a first portion of the total volume of the storage cavity 2211 of the housing 2210 is occupied by the liquid 2108 and a second portion of the total volume of the storage cavity 2211 of the housing 2210 is occupied by the gas 2109. In the exemplified embodiment, the first portion of the total volume of the storage cavity 2211 that is occupied by the liquid 2108 is a majority of the total volume such that the liquid occupies a majority of the total volume of the storage cavity 2211. In one embodiment, the liquid 2108 occupies at least eighty percent (80%) of the total volume of the storage cavity 2211. In another embodiment, the liquid 2108 occupies at least eight-five percent (85%), or at least ninety percent (90%) or at least ninety-five percent (95%) of the total volume of the storage cavity 2211. Of course, as the liquid 2108 is dispensed during use of the device, the liquid 2108 contained within the storage cavity 2211 becomes depleted and the percentage of the total volume that is taken up by the liquid 2108 decreases while the percentage of the total volume that is taken up by the gas 2109 increases. This results in increased venting because more of the vents are in spatial communication with the gas 2109 than the liquid 2108 as the liquid 2108 becomes depleted and takes up less of the total volume of the storage cavity 2211.

In one specific embodiment, the total volume of the storage cavity 2211 may be between 5 ml and 10 ml, more specifically between 6 ml and 8 ml, and still more specifically approximately 7 ml. Furthermore, in certain embodiments prior to use the liquid 2108 will encompass approximately 95% (about 6.7 ml when the total volume is 7 ml) of the total volume. Of that 6.7 ml of the liquid 2108, a portion will prime the capillary member 2180 and the applicator 2150, leaving approximately 6 ml of the liquid 2108 within the storage cavity 2211 (based on the storage cavity 2211 having a total volume of 7 ml, the exact numbers may change while the percentages may remain the same). Thus, after priming and at or before first use by an end user, between 80%-90%, and more specifically approximately 85% of the total volume of the storage cavity 2211 will be taken up by the liquid 2108, the remaining 10%-20%, and more specifically 15%, being taken up by the gas/air 2109.

With the housing 2210 positioned in the upright orientation such that the gravitational vector GV is parallel to the cavity axis 2B-2B, the liquid 2108 in the storage cavity 2211 is located in a bottom portion 2255 of the storage cavity 2211 and the gas 2109 is located in a top portion 2256 of the storage cavity 2211 above the free surface of the liquid 2108. In this example and orientation of the housing 2210, the upper vent apertures 2233*b* of the vent tube 2200 and the vent opening 2138 are in spatial communication with the gas 2109 in the storage cavity 2211 while the lower vent apertures 2233*a*, the vent aperture 2137, and the vent apertures 2241 of the hub component 2240 of the radial vent passageways 2290 are submerged in the liquid 2108. Thus, if there were an increase in temperature or a decrease in pressure, the gas 2109 will flow out of the storage cavity 2211 in at least one of the following manners: (1) through the vent aperture 2138 to the venting cavity 2212, and from the venting cavity 2212 to the external environment via the handle vent aperture 2119; and (2) through the upper vent apertures 2233*b* of the vent tube 2200 to the primary vent passageway 2250, from the primary vent passageway 2250 to the venting cavity 2212, and from the venting cavity 2212 to the external environment via the handle vent aperture 2119. Thus, because the upper vent apertures 2233*b* of the vent tube 2230 and/or the vent opening 2138 are in spatial communication with the gas 2109 (i.e., air pocket) within the storage cavity 2211, the gas 2109 is permitted to pass to the external atmosphere rather than having it exert a pressure on the liquid 2108 which could create a leak situation.

In certain embodiments, either the upper vent apertures 2233*b* of the vent tube 2230 or the vent opening 2138 could be omitted. Thus, in some embodiments there may only be one vent aperture available for the gas 2109 to vent through when the housing 2210 is in the upright vertical orientation illustrated in FIG. 18A. However, including both the upper vent apertures 2233*b* of the vent tube 2230 and the vent opening 2138 may be preferable in some embodiments for redundancy and may be beneficial because even if one of them becomes clogged operation will not be affected.

In certain embodiments, the gas 2109 in the storage cavity 2211 is air (i.e., oxygen, a mixture of oxygen, nitrogen, and small amounts of other gases, or the like). Furthermore, the liquid 2109 can be any liquid that is desired to be dispensed for application to a surface (such as a biological surface) depending on the end use. For example, when the desired application site is a user's oral cavity, the liquid 2108 may be one that provides a benefit to a user's oral surfaces (i.e., a benefit agent) such as a sensorial or therapeutic benefit. For example without limitation, the liquid 2108 may be a mouthwash, a dentifrice, a tooth whitening agent such as peroxide containing tooth whitening compositions, or the like. Other contemplated liquids that can be stored in the storage cavity 2211 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the first liquid 2103 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

Thus, when the liquid 2108 is stored in an oral care implement or toothbrush, any of the above liquids may be desirable for use as the liquid 2108. In other embodiments the personal care implement 2100 may not be a toothbrush. Thus, the liquid 2108 can be any other type of liquid that has beneficial results when dispensed in accordance with its end use or the end use of the product/implement with which it is associated. For example, the liquid 2108 may be hair gel when the implement is a hairbrush, make-up (i.e., mascara or the like) when the implement is a make-up applicator, shaving cream when the implement is a razor, anti-acne cream when the implement is a skin or face scrubber, or the like. Furthermore, as described herein in some embodiments the liquid supply apparatus 21000 may not be associated with a personal care implement at all. Thus, the liquid 2108 may be modified to be any type of liquid that is desired to be dispensed in accordance with the teachings set forth herein even if it is dispensed directly from the liquid supply apparatus 21000 rather than through a personal care implement 2100.

Figure 18B:
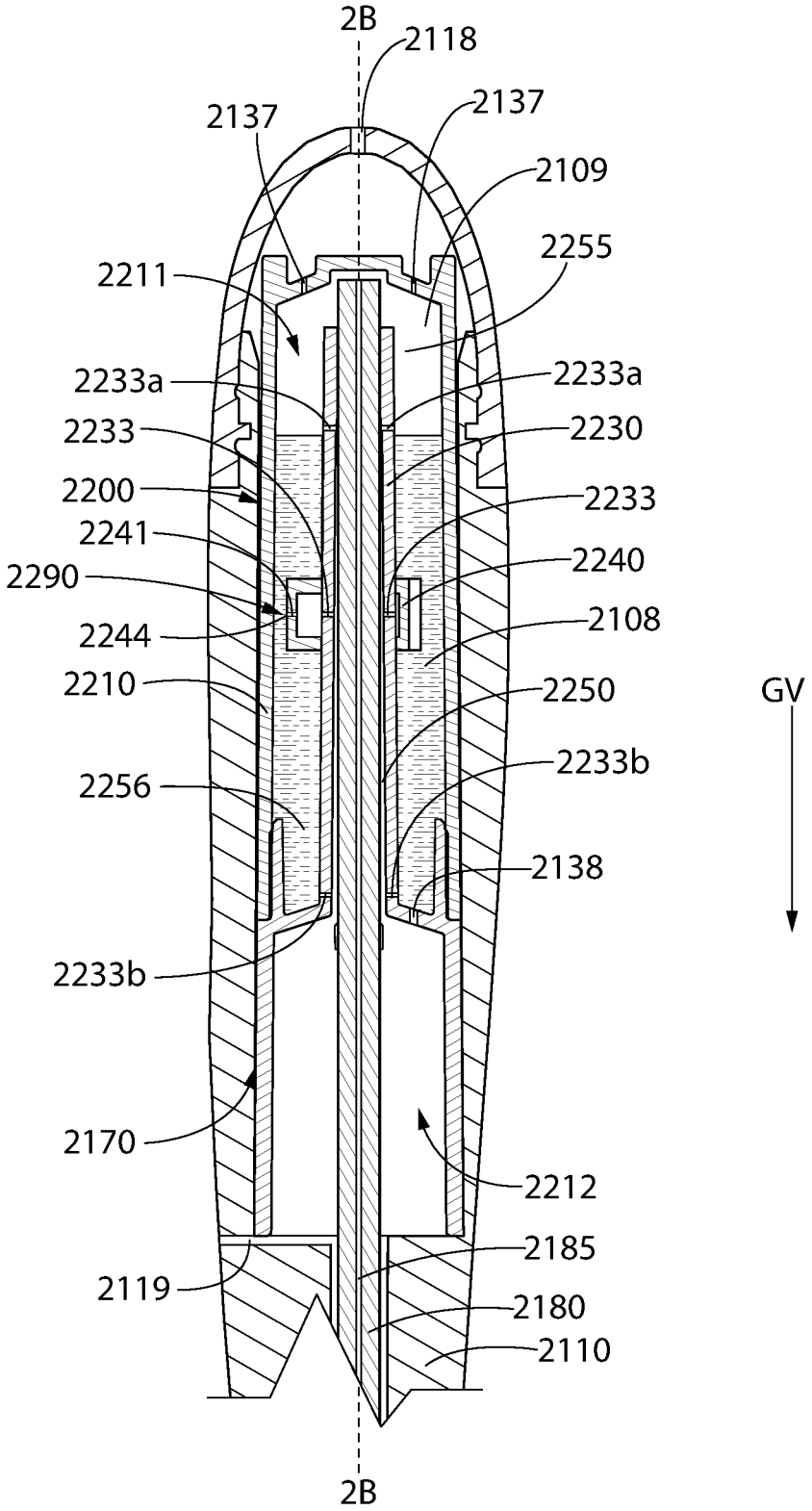
FIG. 18B is a close-up view of area XVIII of FIG. 13 with liquid in the storage cavity of the liquid supply apparatus and with the personal care implement in a second orientation.

FIG. 18B illustrates the same thing as FIG. 18A except the housing 2210 has been flipped 180° so that it is upside-down relative to FIG. 18A. Thus, in this embodiment the cavity axis 2B-2B remains parallel to the gravitational vector GV, except here the housing 2210 is in an upside-down vertical orientation such that the top portion 2256 of the storage cavity 2211 is facing downward and the bottom portion 2255 of the storage cavity is facing upward. In this embodiment, the same amount of the total volume of the storage cavity 2211 is occupied by the liquid 2108 and the gas 2109 as with the embodiment of FIG. 18A (i.e., a majority of the total volume is occupied by the liquid 2108 and the remainder by the gas 2109).

With the housing 2210 positioned in the upside-down vertical orientation, the liquid 2108 in the storage cavity 2211 is located in the top portion 2256 of the storage cavity 2211 (which faces downward) and the gas 2109 is located in the bottom portion 2255 of the storage cavity 2211 (which is above the free surface of the liquid 2108 due to the upside-down orientation). In this example and orientation of the housing 2210, the vent aperture 2137 is in spatial communication (i.e., fluidly coupled) with the gas 2109 in the storage cavity 2211 while the vent apertures 2233 of the vent tube 2230, the vent apertures 2241 of the hub component 2240 of the radial vent passageways 2290, and the vent aperture 2138 are submerged in the liquid 2108. Thus, if there were an increase in temperature or a decrease in pressure, the gas 2109 will flow out of the storage cavity 2211 through the vent aperture 2137 and then through the handle vent aperture 2118. Thus, because the vent aperture 2137 is in spatial communication with the gas 2109 (i.e., air pocket) within the storage cavity 2211, the gas 2109 is permitted to pass to the external atmosphere rather than having it exert a pressure on the liquid 2108 which could create a leak situation.

Furthermore, in this orientation the lower vent aperture 2233*a* is also in spatial communication with the gas 2109 in the storage cavity 2211. Thus, if there were an increase in temperature or a decrease in pressure, the gas 2109 can also flow out of the storage cavity 2211 through the lower vent aperture 2233*a* and into the primary vent passageway 2250 of the vent tube 2230, from the primary vent passageway 2250 to the venting cavity 2212, and from the venting cavity 2212 to the external atmosphere via the handle vent aperture 2119.

In certain embodiments, either the vent aperture 2137 or the lower vent aperture 2233*a* of the vent tube 2230 could be omitted. Thus, there only needs to be one vent aperture available for the gas 2109 to vent through when the housing 2210 is in the upside-down vertical orientation illustrated in FIG. 18B. However, including both the vent aperture 2137 and the lower vent aperture 2233*a* of the vent tube 2230 may be preferable in some embodiments for redundancy and may be beneficial because even if one of them becomes clogged operation will not be affected.

Figure 18C:
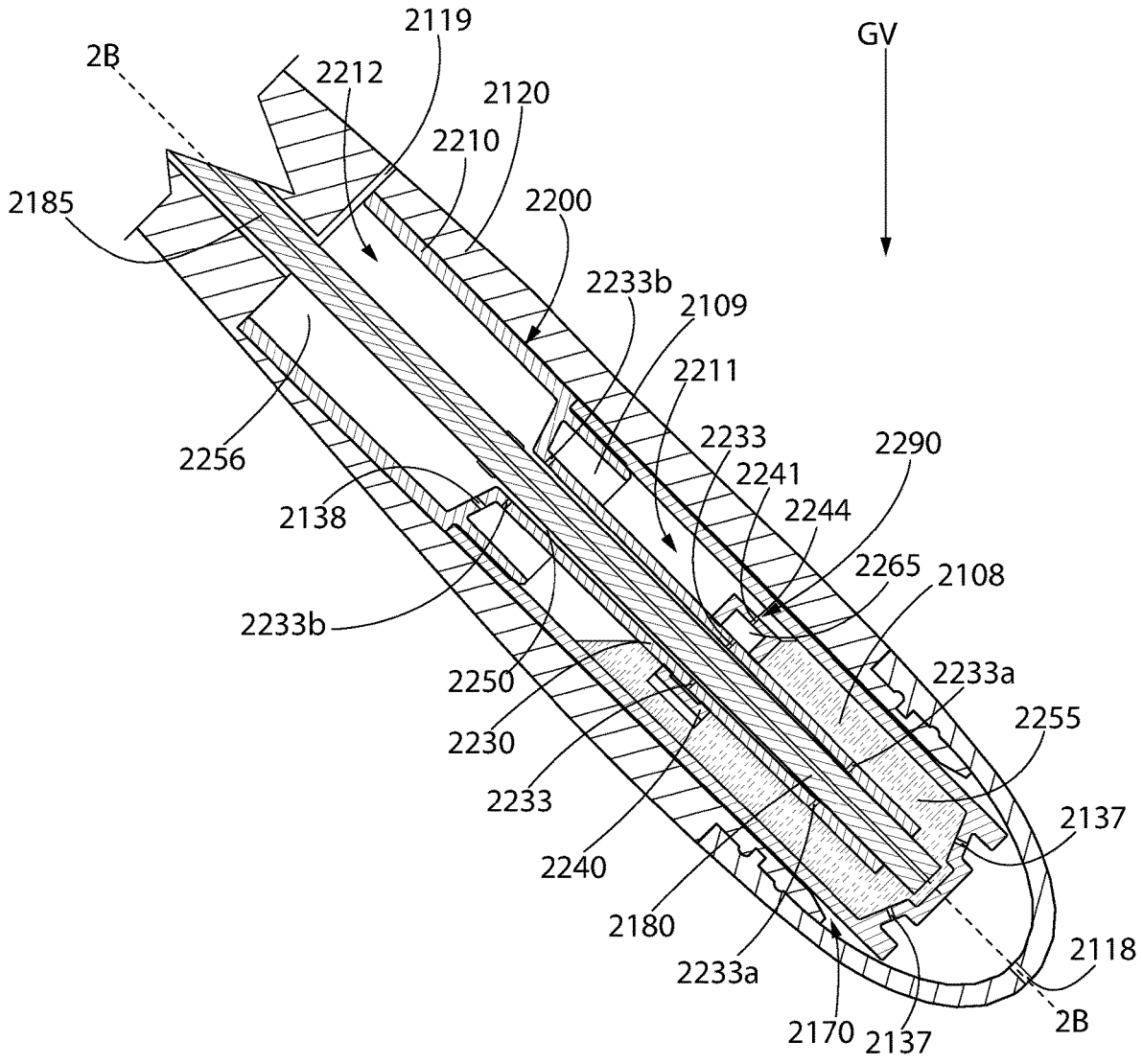
FIG. 18C is a close-up view of area XVIII of FIG. 13 with liquid in the storage cavity of the liquid supply apparatus and with the personal care implement in a third orientation.

FIG. 18C illustrates the same thing as FIGS. 18A and 18B except the housing 2210 has been tilted so that the cavity axis 2B-2B is oriented obliquely to the gravitational vector GV. Although one specific tilt orientation is illustrated in FIG. 18C, the device will operate similarly in any of the infinite tilt orientations or inclinations at which the cavity axis 2B-2B is oblique to the gravitational vector GV. Furthermore, at any orientation shown (including those shown in any of FIGS. 18A-18D and any of the other infinite orientations), the housing 2210 can be rotated (with the cavity axis 2B-2B as the rotational axis) 360° with the device still properly functioning to prevent a leak situation. In the embodiment of FIG. 18C, there is less of the liquid 2108 in the storage cavity 2211 than in the embodiments of FIGS. 18A and 18B to illustrate the vent apertures 2241 of the hub component 2240 (i.e, the radial vent passageways 2290) being in spatial communication with the gas 2109 in the storage cavity 2211 as discussed below.

With the housing 2210 positioned in this tilted orientation and the liquid level as shown, the gas 2109 in the storage cavity 2211 is located in the top portion 2256 of the storage cavity 2211. In this example and orientation of the housing 2210, in addition to the upper vent aperture 2233*b* of the vent tube 2230 and the vent opening 2138 being in spatial communication with the gas 2109 in the storage cavity 2211 (which was discussed above with reference to FIG. 18A), at least one of the vent apertures 2241 (and its corresponding vent opening 2244) of one of the radial vent passageways 2290 is also in spatial communication with the gas 2109 in the storage cavity 2211. Thus, if there were an increase in temperature or a decrease in pressure, in addition to being able to flow out of the storage cavity 2211 to the external atmosphere through the upper vent aperture 2233*b* and/or the vent opening 2138 as discussed above with reference to FIG. 18A, the gas 2109 will also be able to flow out of the storage cavity 2211 through one of the radial vent passageways 2290 via its corresponding vent aperture 2241. Specifically, as an additional route, the gas 2109 could flow from the storage cavity 2211 through one or more of the vent apertures 2241 (via its respective vent opening 2244) into the manifold chamber 2265, from the manifold chamber 2265 to the primary vent passageway 2250 via one of the vent apertures 2233 of the vent tube 2230 (the above being equivalent to flowing form the storage cavity 2211 through one of the radial vent passageways 2290 to the primary vent passageway 2250), from primary vent passageway 2250 of the vent tube 2230 into the venting cavity 2212, and then from the venting cavity 2212 to the external atmosphere via the handle vent aperture 2119.

Figure 18D:
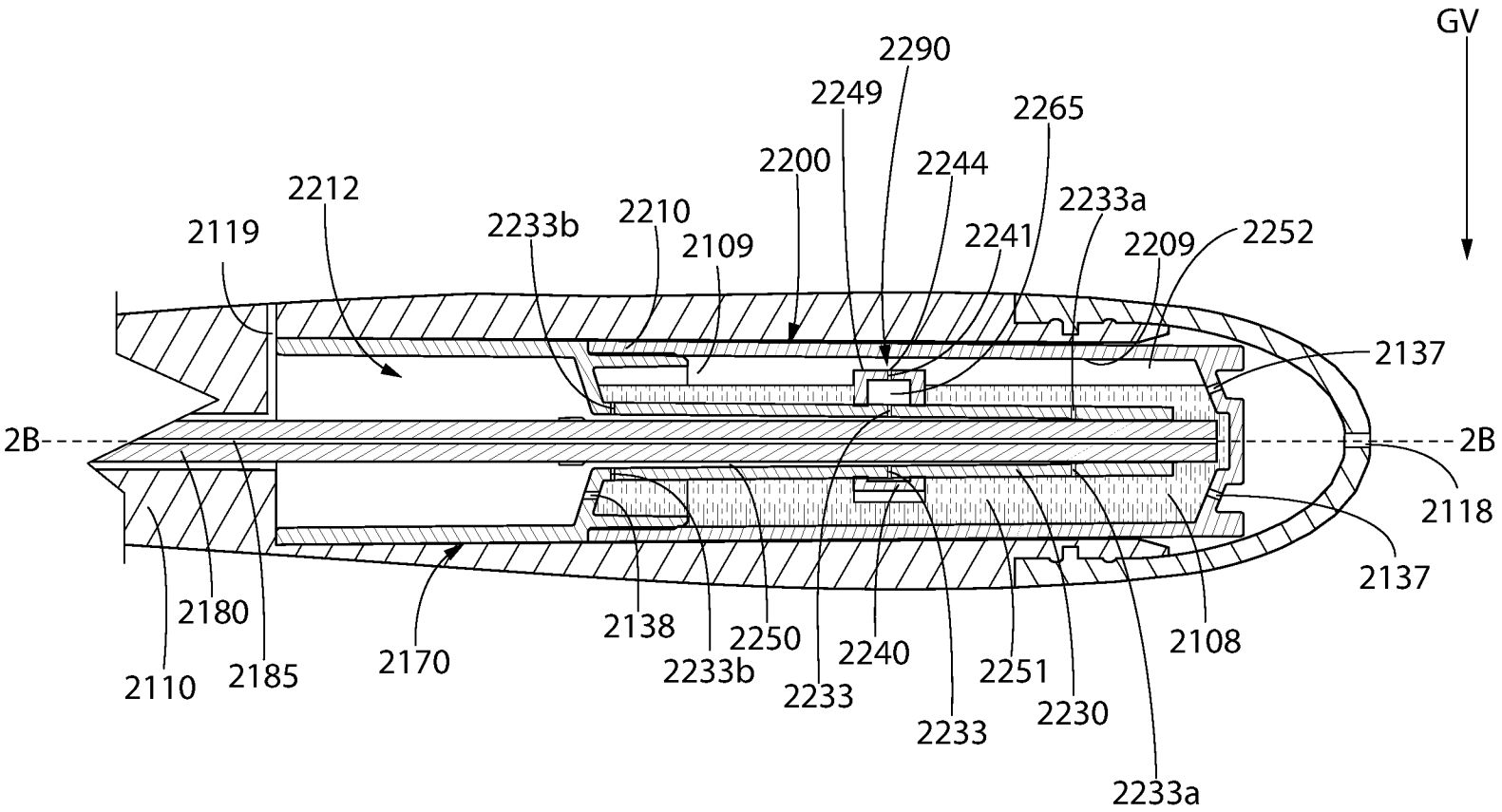
FIG. 18D is a close-up view of area XVIII of FIG. 13 with liquid in the storage cavity of the liquid supply apparatus and with the personal care implement in a fourth orientation.
Figure 19:
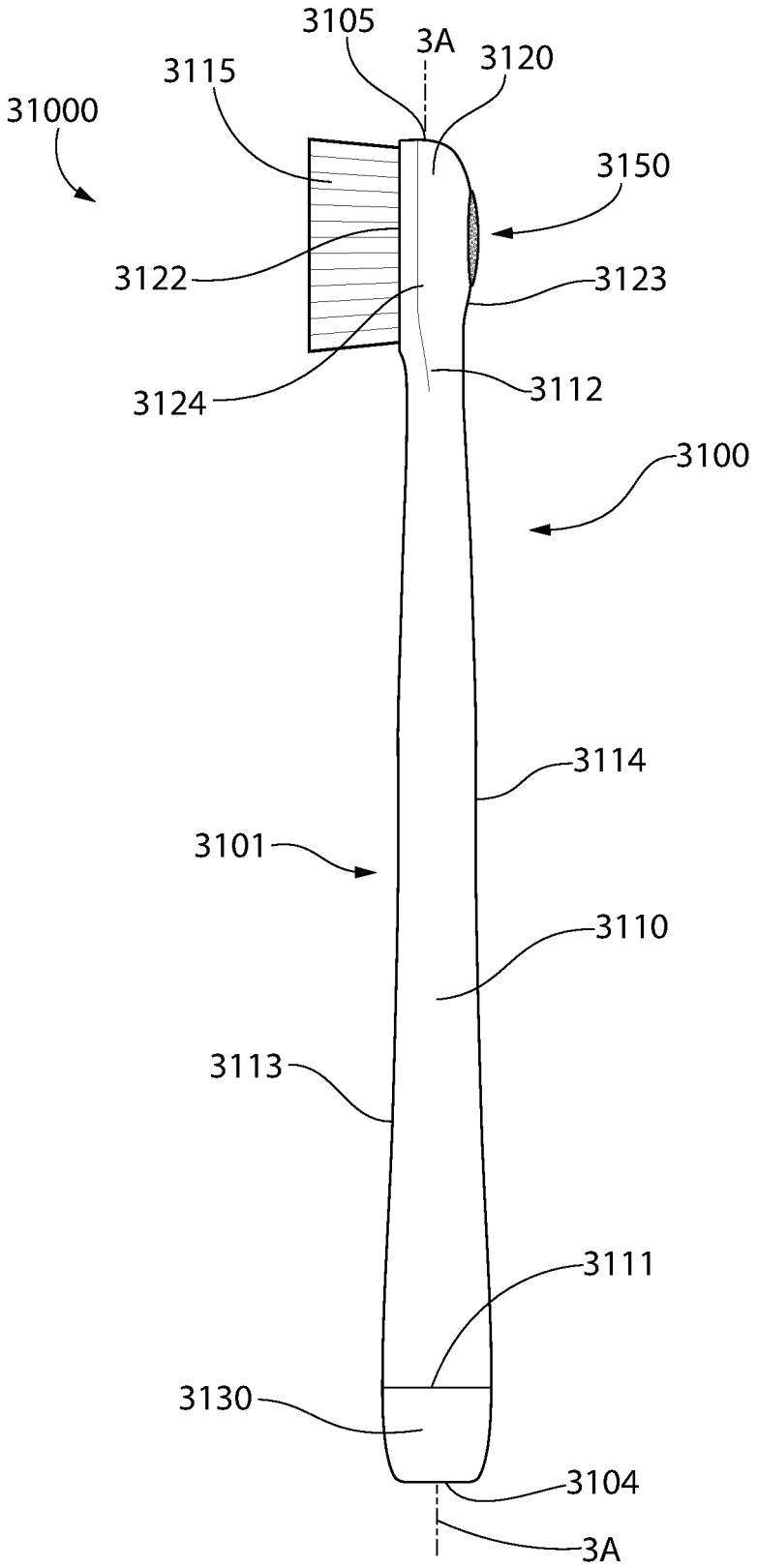
FIG. 19 is side view of a personal care implement in accordance with an embodiment of the present invention.

FIG. 18D illustrates the same thing as FIGS. 18A-18C except the housing 2210 has been tilted so that the cavity axis 2B-2B is oriented orthogonal to the gravitational vector GV. With the housing 2210 positioned in this orientation, the liquid 2108 in the storage cavity 2211 falls by gravity to the left-side portion 2251 of the storage cavity 2211 (illustrated as the bottom due to the orientation of the housing 2210 in FIG. 18D) and the right-side portion 2252 of the storage cavity 2211 (illustrated as the top due to the orientation of the housing in FIG. 18D) is filled with the gas 2109. In this example and orientation of the housing 2210, the vent apertures 2233*a*, 2233*b*, of the vent tube 2230 and the vent apertures 2137, and 2138 are all submerged in the liquid 2108 and thus are not in spatial communication with the gas 2109 in the storage cavity 2211.

However, in this orientation of the housing 2210, at least one of the radial vent passageways 2290, via its corresponding vent aperture 2241 (and its respective vent opening 2244) is in spatial communication with the gas 2109 in the storage cavity 2211. This occurs due to the fact that the vent openings 2244 of the vent apertures 2241 are located at the apex 2249 of the hub component 2240. Thus, the vent openings 2244 are located adjacent and near to the inner surface 2209 of the housing 2210 to ensure that at least one of the vent openings 2244 and its associated vent aperture 2241 is in spatial communication with the gas 2109 in the storage cavity 2211.

Thus, with the housing 2210 in the horizontal orientation of FIG. 18D, if there were an increase in temperature or a decrease in pressure, the gas 2109 will expand and flow out of the storage cavity 2211 into the vent aperture 2241 via the vent opening 2244, from the vent aperture 2241 to the manifold chamber 2265, from the manifold chamber 2265 into the primary vent passageway 2250 of the vent tube 2230 via the vent aperture 2233 of the vent tube 2230 (the above being equivalent to flowing form the storage cavity 2211 through one of the radial vent passageways 2290 to the primary vent passageway 2250), from the primary vent passageway 2250 to the venting cavity 2212, and from the venting cavity 2212 to the external atmosphere via the handle vent aperture 2119. Thus, because one of the vent apertures 2241 is in spatial communication with the gas 2109 (i.e., air pocket) within the storage cavity 2211, the gas 2109 is permitted to pass to the external atmosphere rather than having it exert a pressure on the liquid 2108 which could create a leak situation.

Referring first to FIGS. 19-22, a fluid supply system 31000 is illustrated in accordance with an embodiment of the present invention. The fluid supply system 31000 generally comprises a personal care implement 3100 and a fluid supply apparatus 3200. In certain embodiments the fluid supply apparatus 3200 is stored within a handle cavity 3170 of a handle 3120 of the personal care implement 3100. The fluid supply apparatus 3200 may include a housing 3210 that defines a storage cavity 3211 for storing a fluid. The fluid supply apparatus 3200 also includes mechanisms for flowing the fluid from its stored location within the storage cavity 3211 to another location at which the fluid is dispensed in a desired manner. In the exemplified embodiment, the fluid supply apparatus 3200 permits flow of the fluid from the storage cavity 3211 to an applicator 3150 that is located on a rear surface 3123 of a head 3120 of the personal care implement 3100, but the invention is not to be so limited in all embodiments. The fluid supply apparatus 3200 is specifically configured to prevent fluid leakage regardless of the orientation at which the housing 3210 is held under any normal usage and storage conditions including through changes in temperature and pressure. In some embodiments, the invention described herein relates to the fluid supply apparatus 3200 by itself, and in other embodiments the invention relates to the entire system 31000 including the personal care implement 3100 and the fluid supply apparatus 3200 stored therein.

In the exemplified embodiment, the personal care implement 3100 is an oral care implement, and more specifically a manual toothbrush. Thus, the invention will be described herein with the details predominately directed to a toothbrush. However, in certain other embodiments the personal care implement 3100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 3100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims. Furthermore, in some embodiments the invention is directed solely to the fluid supply apparatus 3200. Thus, the fluid supply apparatus 3200 may be included in the personal care implement 3100 or it may be a separate, stand-alone device. When a stand-alone device, the fluid supply apparatus 3200 may include some type of applicator so that the fluid dispensed from the fluid supply apparatus 3200 can be properly applied to a desired surface.

In the exemplified embodiment, the personal care implement 3100 generally includes a body 3101 comprising a handle 3110 and a head 3120 and an end cap 3130 that is detachably coupled to the handle 3110. The body 3101 generally extends along a longitudinal axis 3A-3A from a proximal end 3104 to a distal end 3105. Conceptually, the longitudinal axis 3A-3A is a reference line that is generally coextensive with the three-dimensional center line of the body 3101. Because the body 3101 may, in certain embodiments, be a non-linear structure, the longitudinal axis 3A-3A of the body 3101 may also be non-linear in certain embodiments. However, the invention is not to be so limited in all embodiments and in certain other embodiments the body 3101 may have a simple linear arrangement and thus a substantially linear longitudinal axis 3A-3A.

The handle 3110 extends from a proximal end 3111 to a distal end 3112 and the head 3120 is coupled to the distal end 3112 of the handle 3110. In the exemplified embodiment, the end cap 3130 is detachably coupled to the proximal end 3111 of the handle 3120. Specifically, the handle 3120 has an opening 3116 at the proximal end 3111 thereof and the end cap 3130 is coupled to the proximal end 3111 of the handle 3120 and closes the opening 3116. The end cap 3130 may be detachable from the handle 3120 so that a fluid or oral care material can be stored within the body 3101 and can be refilled by detaching the end cap 3130 from the handle 3110 to provide access, via the opening 3116, to a cavity/reservoir within the body 3101 within which the fluid may be stored. Furthermore, in certain embodiments the end cap 3130 may be altogether omitted and the proximal end 3111 of the body 3101 may form a closed bottom end of the personal care implement 3100. In such embodiments, refill of the reservoir may not be possible or may occur through other mechanisms/structures as would be understood to persons skilled in the art.

The handle 3110 is an elongated structure that provides the mechanism by which the user can hold and manipulate the personal care implement 3100 during use. The handle 3110 comprises a front surface 3113 and an opposing rear surface 3114. In the exemplified embodiment, the handle 3110 is generically depicted having various contours for user comfort. Of course, the invention is not to be so limited in all embodiments and in certain other embodiments the handle 3110 can take on a wide variety of shapes, contours and configurations, none of which are limiting of the present invention unless so specified in the claims.

In the exemplified embodiment, the handle 3110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 3110 may include a resilient material, such as a thermoplastic elastomer, as a grip cover that is molded over portions of or the entirety of the handle 3110 to enhance the gripability of the handle 3110 during use. For example, portions of the handle 3110 that are typically gripped by a user's palm during use may be overmolded with a thermoplastic elastomer or other resilient material to further increase comfort to a user.

The head 3120 of the personal care implement 3100 is coupled to the handle 3110 and comprises a front surface 3122, an opposing rear surface 3123, and a peripheral surface 3124 extending between the front and rear surfaces 3122, 3123. In the exemplified embodiment, the head 3120 is formed integrally with the handle 3110 as a single unitary structure using a molding, milling, machining or other suitable process. However, in other embodiments the handle 3110 and the head 3120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 3120 may be detachable from the handle 3110. The head 3120 may be formed of any one of the materials discussed above with regard to the handle 3110.

In the exemplified embodiment, the head 3120 of the personal care implement 3100 is provided with a plurality of tooth cleaning elements 3115 extending from the front surface 3122. Of course, depending on the particular type of device selected for the personal care implement 3100, the tooth cleaning elements 3115 may be replaced with some other bristle-like elements (for example when the personal care implement 3100 is a hairbrush or a mascara applicator) or may be altogether omitted. Furthermore, in the exemplified embodiment the tooth cleaning elements 3115 are generically illustrated. In certain embodiments the exact structure, pattern, orientation and material of the tooth cleaning elements 3115 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styren3E-3Ethylene/butylene-styrene block copolymer (SEBS) manufactured by GLS Corporation. Nevertheless, SEBS material from other manufacturers or other materials within and outside the noted hardness range could be used.

Figure 20:
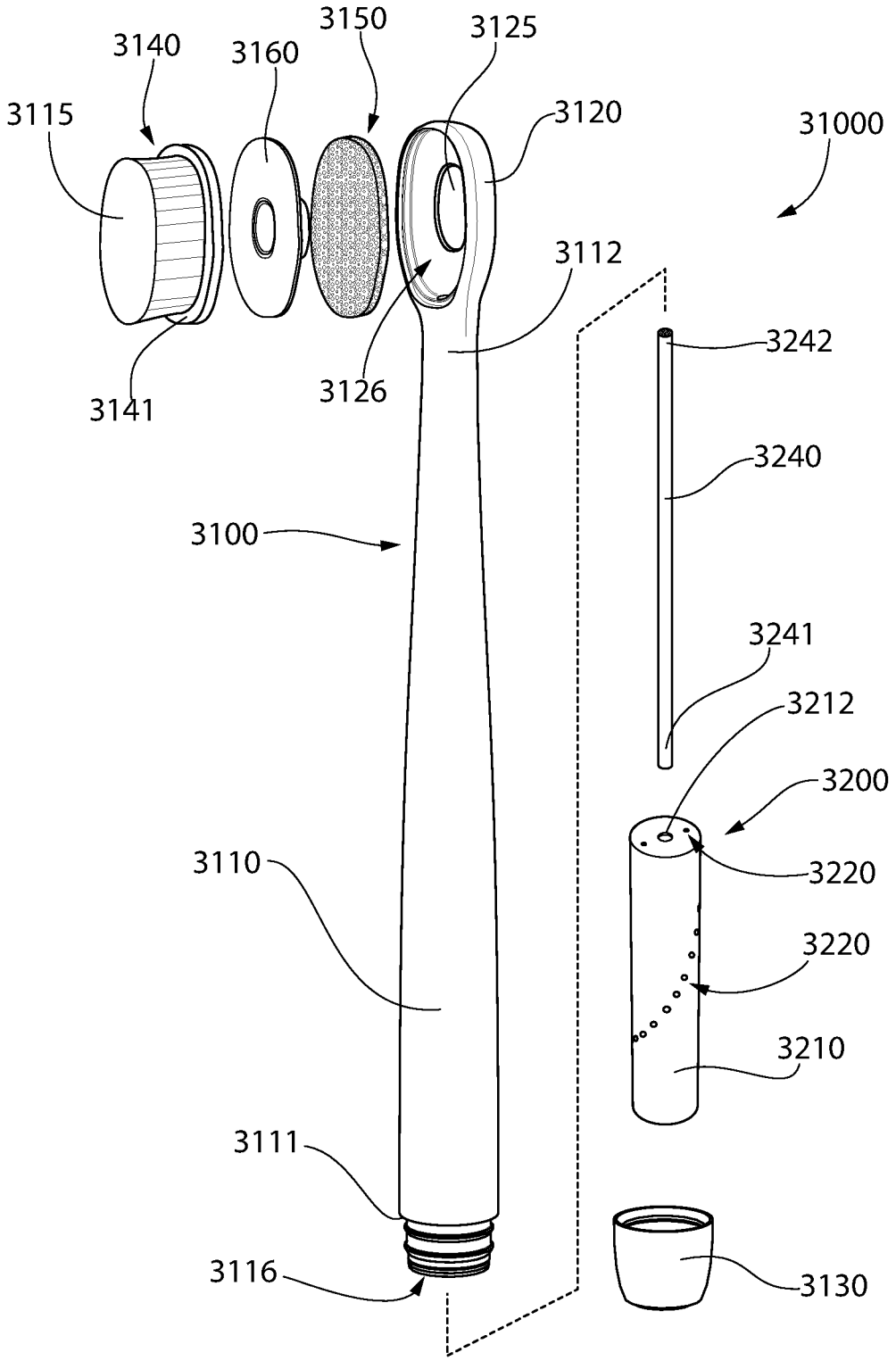
FIG. 20 is an exploded perspective view of the personal care implement of FIG. 19.
Figure 21:
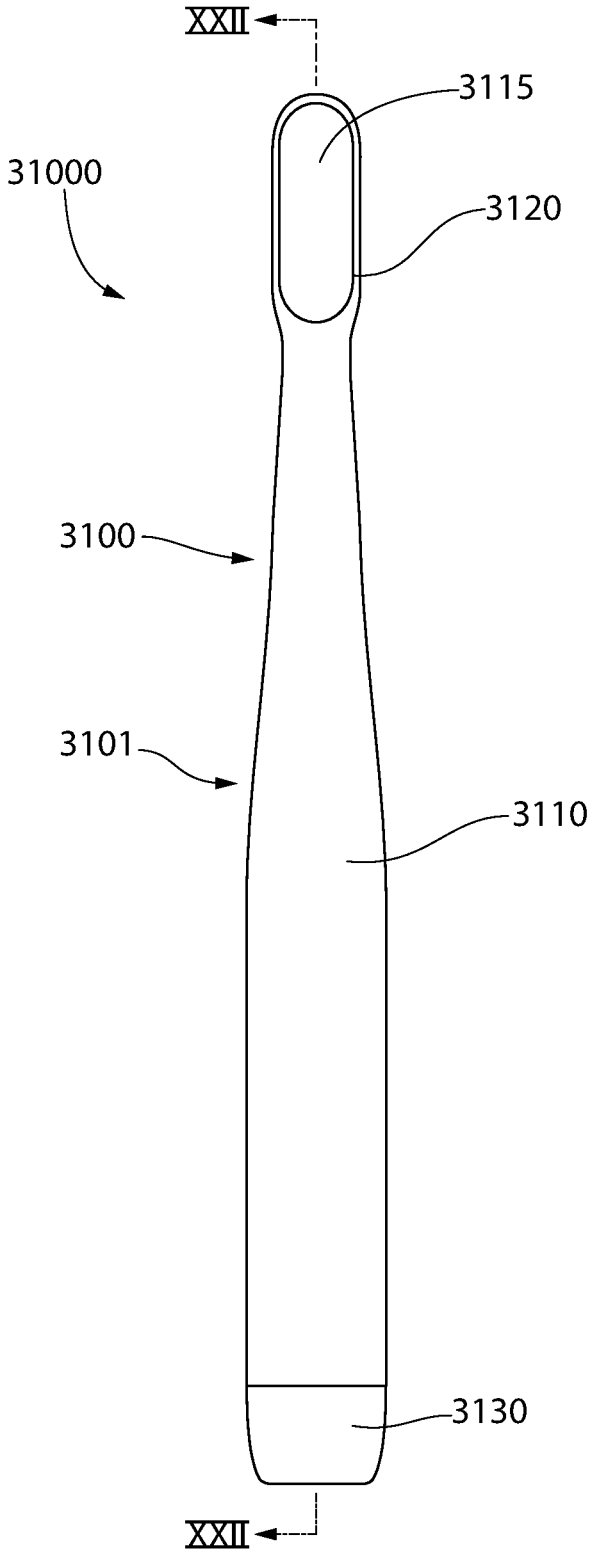
FIG. 21 is a front view of the personal care implement of FIG. 19.
Figure 22:
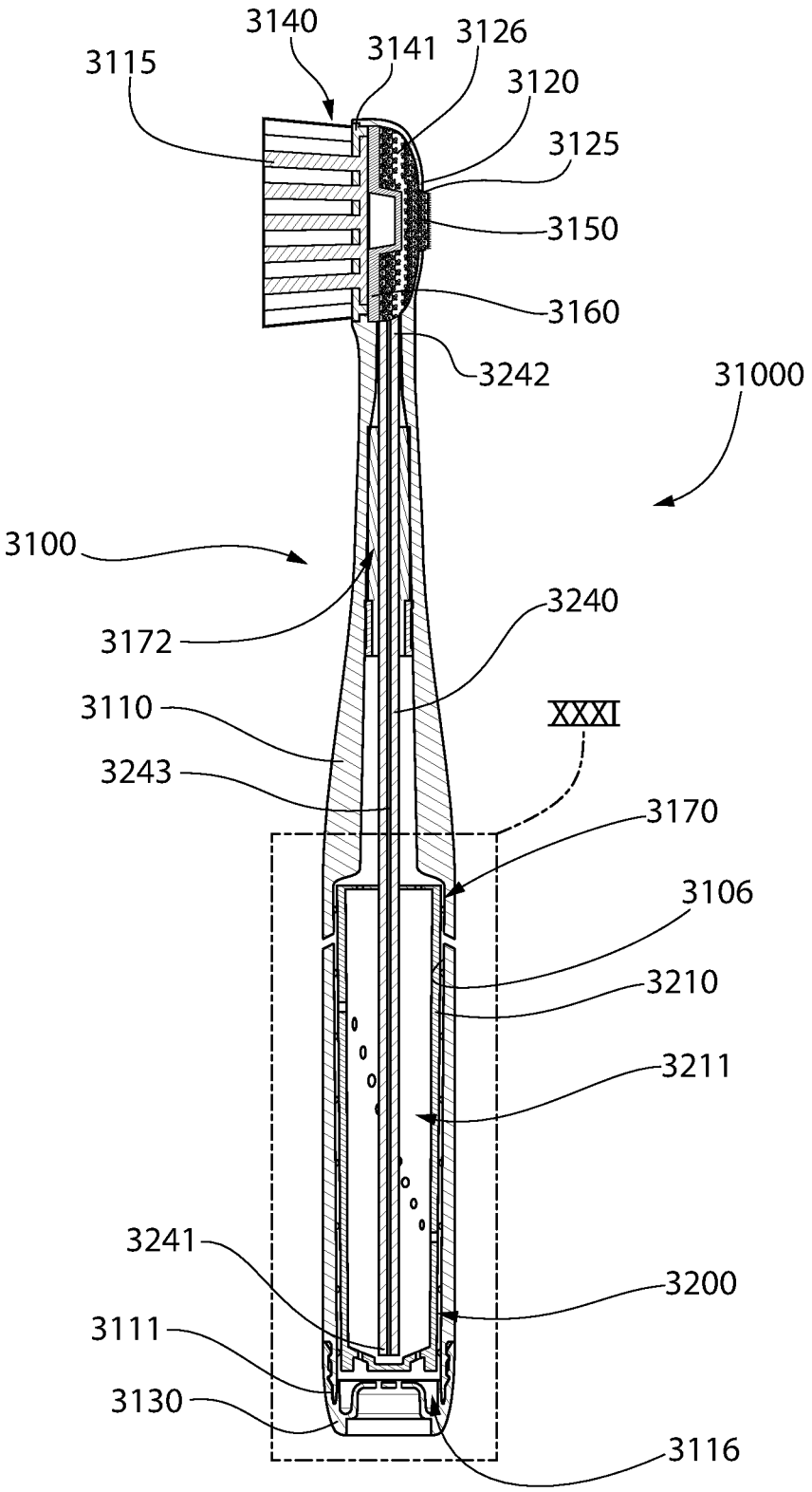
FIG. 22 is a cross-sectional view taken along line XXII-XXII of FIG. 21.
Figure 23:
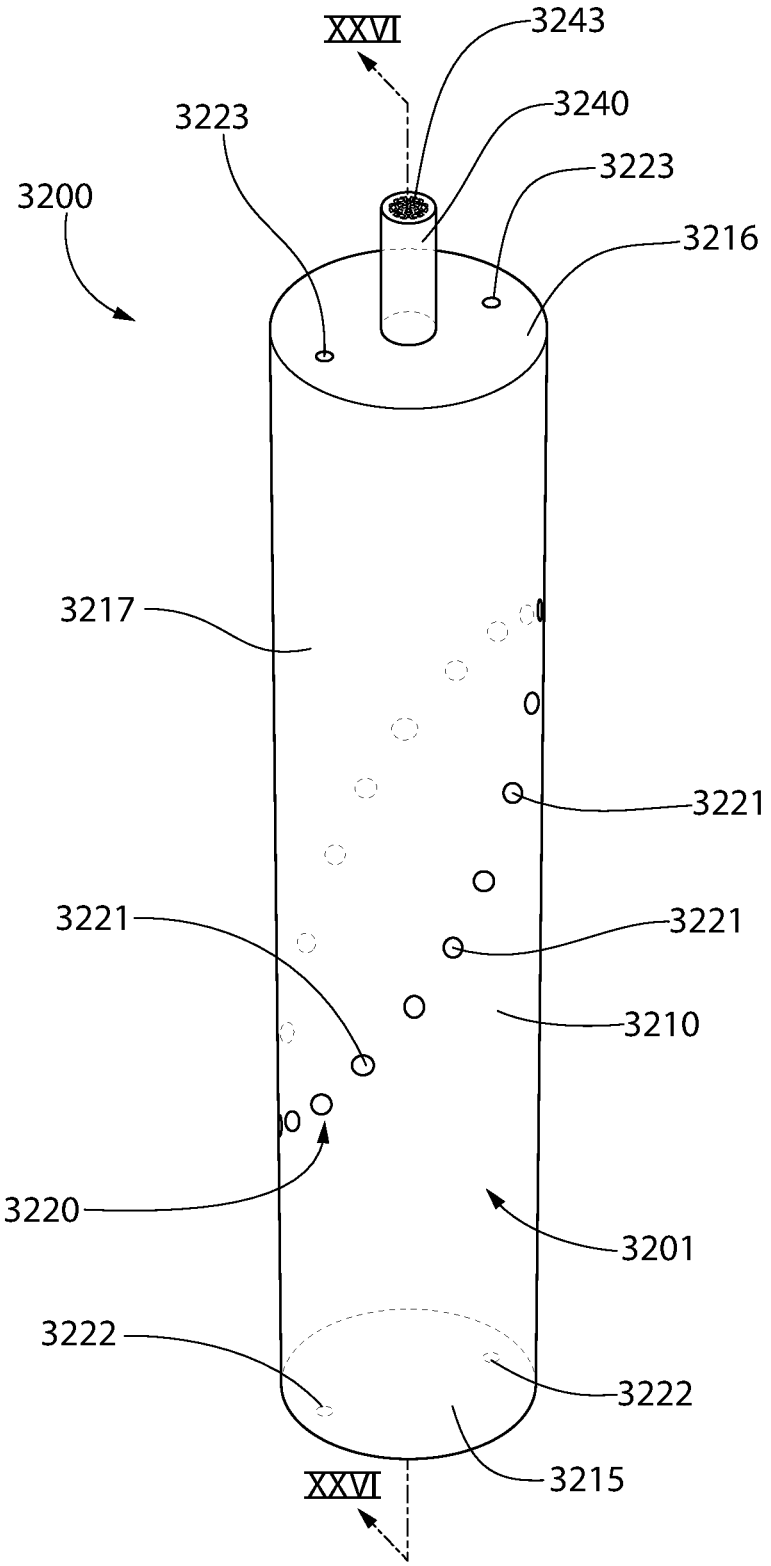
FIG. 23 is a perspective view of a fluid supply apparatus in accordance with an embodiment of the present invention.
Figure 24:
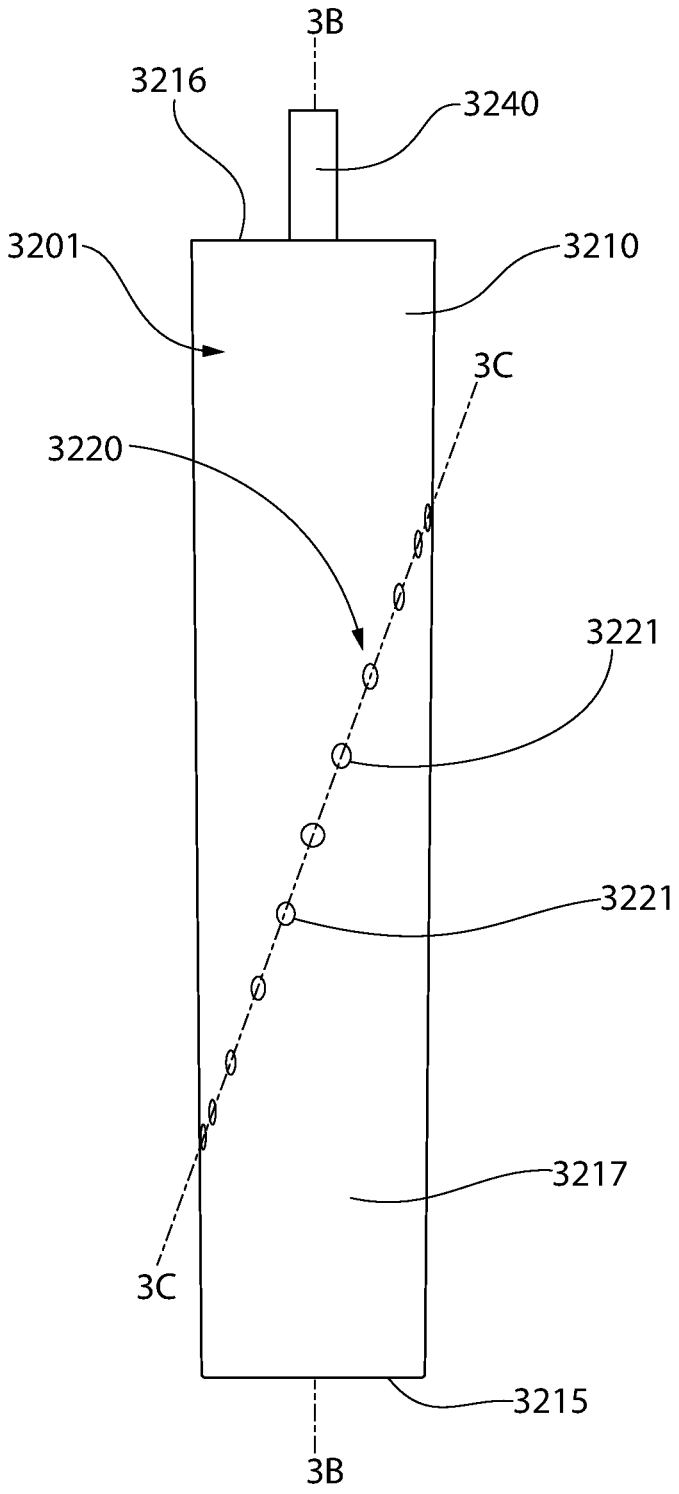
FIG. 24 is a front view of the fluid supply apparatus of FIG. 23.

Referring briefly to FIGS. 20 and 22, in the exemplified embodiment the tooth cleaning elements 3115 are formed on a cleaning element assembly 3140 that comprises a head plate 3141 and the tooth cleaning elements 3115 mounted thereon. In such an embodiment, the head plate 3141 is a separate and distinct component from the body 3101 of the personal care implement 3100. However, the head plate 3141 is connected to the body 3101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 3141 and the body 3101 are separately formed components that are secured together during manufacture of the personal care implement 3100. More specifically, the tooth cleaning elements 3115 are secured to the head plate 3141 in a manner known in the art (i.e., anchor free tufting or AFT) to form the cleaning element assembly 3140, and then the cleaning element assembly 3140 is coupled to the head 3120. Alternatively, the tooth cleaning elements 3115 may be connected to the head 3120 using AMR techniques, stapling, or the like. The invention is not to be particularly limited by the manner in which the tooth cleaning elements 3115 are coupled to the head 3120 in all embodiments.

Although not illustrated herein, in certain embodiments the head 3120 may also include a soft tissue cleanser coupled to or positioned on its rear surface 3123. An example of a suitable soft tissue cleanser that may be used with the present invention and positioned on the rear surface 3123 of the head 3120 is disclosed in U.S. Pat. No. 7,143,462, issued Dec. 5, 32006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 3100 may not include any soft tissue cleanser.

Referring back to FIGS. 19-22 concurrently, in the exemplified embodiment the personal care implement 3100 comprises an applicator 3150 protruding from the rear surface 3123 of the head 3120. More specifically, the head 3120 has an opening 3125 that extends from the rear surface 3123 of the head 3120 into a basin cavity 3126 of the head 3120. The applicator 3150 is inserted into the basin cavity 3126 of the head 3120 and extends through the opening 3125 and protrudes from the rear surface 3123 of the head 3120. Thus, during use of the personal care implement 3100 to brush teeth, the applicator 3150 will engage/contact the user's oral surfaces and dispense a fluid thereon as discussed in more detail below. The personal care implement 3100 may also include a divider member 3160 that divides the basin cavity 3126 into an upper chamber and a lower chamber such that the cleaning element assembly 3140 is located in the upper chamber and the applicator 3150 is located in the lower chamber. The divider member 3160 may seal the applicator 3150 within the lower chamber so that any fluid loaded on the applicator 3150 does not pass into the upper chamber.

The applicator 3150 may be formed of a capillary material that is capable of being loaded with a fluid that can then be dispensed when the applicator 3150 is compressed. For example, the applicator 3150 may be a porous foam such as including without limitation a polyurethane foam or other open cell porous material. Thus, in the exemplified embodiment the applicator 3150 can be formed of any type of material through which a liquid can travel via capillary action or capillary flow. Specifically, the capillary material can be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. Furthermore, although described herein as being formed of a capillary material, the invention is not to be so limited in all embodiments and some alternative embodiments will be described herein below. For example, in certain embodiments the applicator 3150 may be formed of a plastic material or a rubber material and may have an orifice formed therethrough to enable the fluid to flow through the applicator for application to a biological surface such as a user's oral cavity, facial surfaces, or the like.

The handle 3110 of the personal care implement 3100 comprises an inner surface 3106 that defines a handle cavity 3170. The handle cavity 3170 is closed at its bottom end via the end cap 3130 that closes the opening 3116 at the proximal end 3111 of the handle 3110. The handle cavity 3170 is open at its top end so as to be spatially coupled to the opening 3125. More specifically, the handle cavity 3170 is spatially coupled to the opening 3125 in the head 3120 via a passageway 3172 that extends through the neck region of the personal care implement 3100.

The fluid supply apparatus 3200 generally comprises a housing 3210 defining a storage cavity 3211 and a capillary member 3240. The storage cavity 3211 is designed to hold a store of a fluid as discussed in greater detail below with reference to FIGS. 32A-32D. The capillary member 3240 is at least partially located within the storage cavity 3211 so that the capillary member 3240 is fluidly coupled to the store of the fluid that is located within the storage cavity 3211. The housing 3210 has an opening 3212 in its top end through which the capillary member 3240 passes so that a portion of the capillary member 3240 extends external to the housing 3210. More specifically, the capillary member 3240 extends from the housing 3210 and through the passageway 3172 in the neck region of the personal care implement 3100 to the applicator 3150 so that the capillary member 3240 can draw fluid from the store of the fluid in the storage cavity 3211 and transport that fluid to the applicator 3150 where it can be dispensed at an appropriate time and location. The housing 3210 also comprises a plurality of vent apertures 3220 that facilitate venting of the storage cavity 3211 to prevent fluid leaks as discussed in much greater detail below. The vent apertures 3220 create an air intake/venting system that allows air to replace the fluid that is dispensed from the storage cavity 3211 over time during use and allows air to exit the storage cavity 3211 to prevent it from exerting pressure on any fluid in the storage cavity 3211.

Turning now to FIGS. 20 and 22, the relationship between the personal care implement 3100 and the fluid supply apparatus 3200 will be described in more detail. The housing 3210 of the fluid supply apparatus 3200 is positioned within the handle cavity 3170. Although the housing 3210 is illustrated as being wholly encased within the handle cavity 3170, the invention is not to be so limited in all embodiments and the housing 3210 may extend into the passageway 3172 or it may even protrude from the proximal end 3111 of the handle 3110 in some alternative embodiments. However, fully enclosing the housing 3210 within the handle cavity 3170 provides a more desirable aesthetic as the overall appearance of the personal care implement 3100 can be more similar to that of a traditional device of the same type. The capillary member 3240 extends from a first end 3241 that is located within the storage cavity 3211 and fluidly coupled to the fluid stored in the storage cavity 3211 to a second end 3242 that is fluidly coupled to the applicator 3150. Thus, the capillary member 3240 transports the fluid from the storage cavity 3211 of the housing 3210 to the applicator 3150 as described herein.

Figure 25:
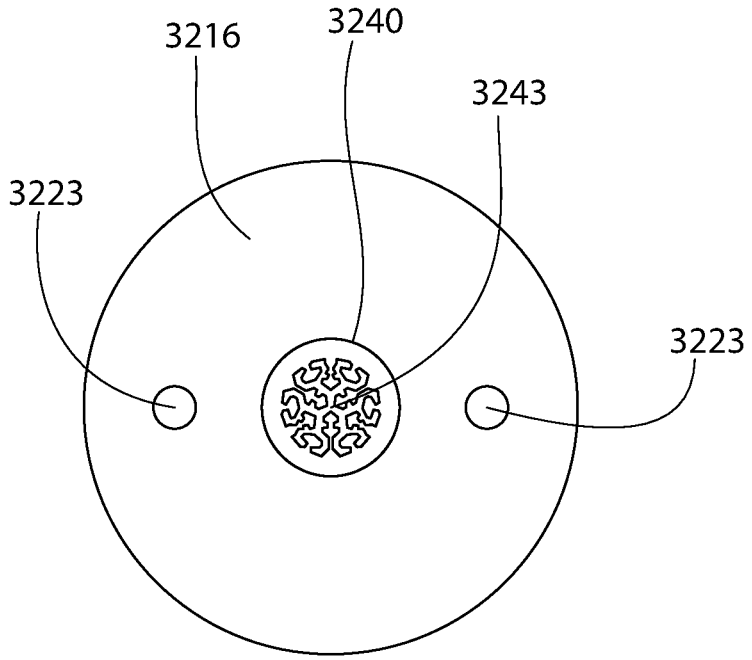
FIG. 25 is a top view of the fluid supply apparatus of FIG. 23.
Figure 26:
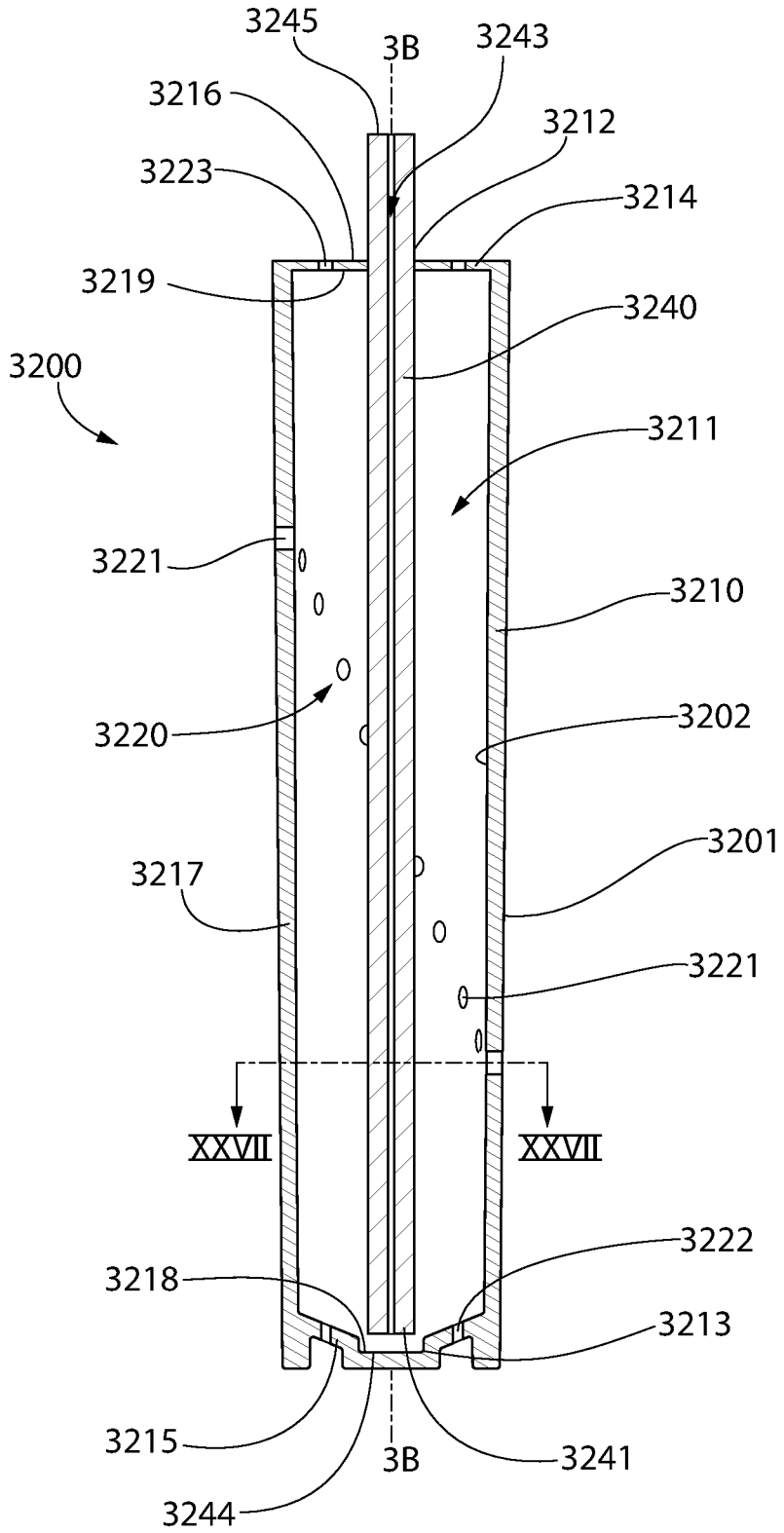
FIG. 26 is a cross-sectional view taken along line XXVI-XXVI of FIG. 23.
Figure 27:
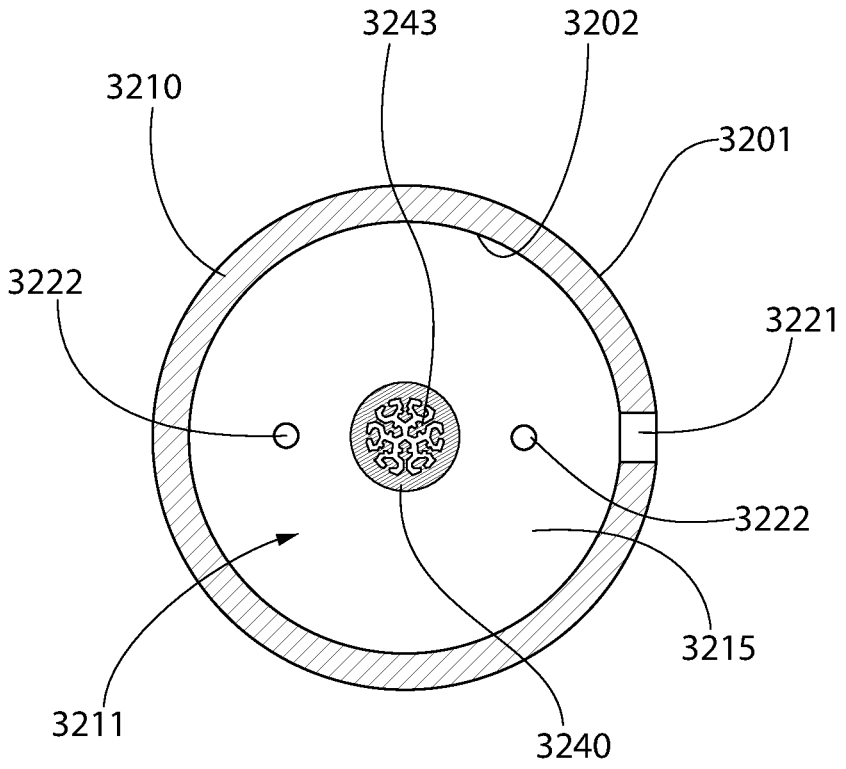
FIG. 27 is a cross-sectional view taken along line XXVII-XXVII of FIG. 26.

In the exemplified embodiment, the capillary member 3240 is a capillary tube having a capillary passageway 3243 extending entirely through the capillary member 3240 from the first end 3241 to the second end 3242 that permits the fluid to flow within the capillary member 3240 from the first end 3241 to the second end 3242 via a wicking action. Thus, in this manner the fluid is able to flow from its storage location within the storage cavity 3211 of the housing 3210 to the applicator 3150 so that the applicator 3150 can be loaded with the fluid. Specifically, the passageway 3243 may have a cross-sectional size and shape that permits flow of the fluid all the way from the storage cavity 3211 to the applicator 3150 to ensure that the applicator 3150 remains loaded with the fluid (see, e.g., FIG. 25). In other embodiments, the capillary member 3240 may be formed of a porous material, such as any of the materials described above with reference to the applicator 3150. In such embodiments the fluid may flow up the capillary member 3240 via a wicking action (also referred to herein as capillary action) due to the material of the capillary member 3240. In either embodiment, the flow of the fluid occurs naturally via capillary action without the need for a separate pump.

In certain embodiments, the capillary member 3240 has a capillary structure which may be formed in numerous configurations and from numerous materials operable to produce fluid flow via capillary action. In one non-limiting embodiment, the capillary member 3240 may be configured as a tube or lumen having an internal open capillary passageway extending between ends of the capillary member which is configured and dimensioned in cross section to produce capillary flow. The lumen or open capillary passageway may have any suitable cross sectional shape and configuration. In such embodiments the capillary member 3240 may be formed of a porous material as described below or a non-porous material (e.g., plastics such as polypropylene, metal, rubber, or the like). In other non-limiting embodiments, capillary member 3240 may be formed of a porous and/or fibrous material of any suitable type through which a fluid can travel via capillary action or flow. Examples of suitable materials include without limitation fibrous felt materials, ceramics, and porous plastics with open cells (e.g. polyurethane, polyester, polypropylene, or combinations thereof) including such materials as those available from Porex Technologies, Atlanta, Ga. The capillary member material may therefore be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. A mixture of porous and/or fibrous materials may be provided which have a distribution of larger and smaller capillaries. The capillary member 3240 can be formed from a number of small capillaries that are connected to one another, or as a larger single capillary rod. The capillary member whether formed as a lumen or of porous or fibrous materials may have any suitable polygonal or non-polygonal cross sectional shape including for example without limitation circular, elliptical, square, triangular, hexagonal, star-shaped, etc. The invention is not limited by the construction, material, or shape of the capillary member.

Referring to FIGS. 23-27 concurrently, the fluid supply apparatus 3200 will be described in greater detail. The housing 3210 of the fluid supply apparatus 3200 has an outer surface 3201 and an opposite inner surface 3202. The inner surface 3202 of the housing 3210 defines the storage cavity 3211 that is configured to store the fluid therein. The storage cavity 3211 extends from a first end 3213 to a second end 3214 along a cavity axis 3B-3B. More specifically, the housing 3210 comprises a first end wall 3215 that bounds the first end 3213 of the storage cavity 3211 and a second end wall 3216 that bounds the second end 3214 of the storage cavity 3211. Furthermore, the housing 3210 comprises a sidewall 3217 extending between the first and second end walls 3215, 3216. In the exemplified embodiment, the housing 3210 has a round or circular cross-sectional shape, but it may have other shapes in other embodiments (i.e., square, triangular, hexagonal, etc.) and the invention is not to be limited by the exemplified shape in all embodiments. In certain embodiments the shape of the housing 3210 may be dictated by the shape of the handle cavity 3170.

The storage cavity 3211 has a floor 3218 formed by the first end wall 3215 of the housing 3210 and a roof 3219 formed by the second end wall 3216 of the housing 3210. The terms "floor" and "roof" could be interchangeable depending on the orientation of the housing 3210 at any given time. Specifically, the terms "floor" and "roof" are merely intended to denote the lower and upper boundaries of the storage cavity 3211. The remaining boundary of the storage cavity 3211 is formed by the inner surface 3202 of the housing 3210 along the entirety of the sidewall 3217. The capillary member 3240 is partially located within the storage cavity 3211 and extends from a location adjacent to the floor 3218 through the entire length of the storage cavity 3211 and through the opening 3212 that is formed into the second end wall 3216 of the housing 3210. In the exemplified embodiment, the capillary member 3240 has openings into the passageway 3243 at the lower-most end 3244 thereof and at the upper-most end 3245 thereof. Thus, the fluid within the storage cavity 3211 can only enter into the passageway 3243 of the capillary member 3240 through the opening in the lower-most end 3244 of the capillary member 3240. There are no other openings along the length of the capillary member 3240 that permit the fluid to enter into the passageway 3243 of the capillary member 3240. As a result, in the exemplified embodiment fluid can only enter into the passageway 3243 of the capillary member 3240 when the fluid is in contact with the lower-most end 3244 of the capillary member 3240. Thus, in certain orientations of the housing 3210 and certain fluid levels within the storage cavity 3211, the fluid is unable to enter into the passageway 3243 of the capillary member 3240 because it is not in contact with the opening in the lower-most end 3244 of the capillary member 3240. Of course, in other embodiments additional openings into the passageway 3243 of the capillary member 3250 may be provided.

The fluid supply apparatus 3200 requires an air intake and venting system to allow air to replace the fluid that is dispensed from the storage cavity 3211 over time during use. This helps to ensure consistent flow of the fluid during use but must be designed correctly to ensure that uncontrolled fluid leakage is prevented regardless of the orientation at which the housing 3210 is positioned and regardless of changes in temperature and pressure. As mentioned briefly above, in the exemplified embodiment the fluid supply apparatus 3200 comprises the plurality of vent apertures 3220 in the housing 3210 that operate as the air intake and venting system of the device. More specifically, each of the vent apertures 3220 forms a passageway from the storage cavity 3211 to the external atmosphere (i.e., the atmosphere external to the storage cavity 3211). Thus, each of the vent apertures 3220 extends entirely through the housing 3210 from the inner surface 3202 thereof to the outer surface 3201 thereof.

In certain embodiments, each of the vent apertures 3220 is designed with a specific dimension/size tailored to the physical properties (e.g., viscosity and surface tension) of the fluid stored within the storage cavity 3211 such that once system equilibrium is reached, the fluid cannot pass through the vent apertures 3220 under normal usage conditions. Stated another way, each of the vent apertures 3220 is configured such that a fluid within the storage cavity 3211 cannot flow through the vent apertures 3220 at ambient temperature and with a pressure equilibrium existing between the storage cavity and the external atmosphere. However, at the same time the vent apertures 3220 are designed to permit gas, such as air, within the storage cavity 3211 to pass through the vent apertures 3220. Specifically, as long as the vent apertures 3220 are not clogged, the gas/air will be capable of freely passing through the vent apertures 3220 both into and out of the storage cavity 3211 as needed to provide proper air intake and venting to ensure proper operation of the device (i.e., consistent fluid flow during use) without leakage. In certain embodiments, the vent apertures 3220 may have a diameter in a range of 0.05 mm to 0.5 mm, and more specifically between 0.1 mm and 0.3 mm.

As discussed in greater detail below with reference to FIGS. 32A-32D, the vent apertures 3220 are positioned along the housing 3210 in such a manner that there are no pockets of trapped air within the storage cavity 3211, regardless of orientation of the housing 3210, that can expand due to increases in temperature or decreases in pressure (both of which would exert pressure on the fluid in the storage cavity 3211 and cause it to be expelled in an uncontrolled manner). Rather, any air pockets are always spatially coupled to the exterior atmosphere so that as a result of any increases in temperature or decreases in pressure the air/gas in the air pockets will exit the storage cavity 3211 rather than exert pressure on the fluid and cause it to leak out of the storage cavity 3211. In order to achieve this, at least one of the vent openings 3220 is positioned along the housing 3210 at a location that is aligned with a maximum internal diameter of the storage cavity 3211.

In the exemplified embodiment, the plurality of vent apertures 3220 comprise a plurality of first vent apertures 3221 formed into the sidewall 3217 of the housing 3210, at least one second vent aperture 3222 located adjacent the first end 3213 of the storage cavity 3211, and at least one third vent aperture 3223 located adjacent the second end 3214 of the storage cavity 3211. In the exemplified embodiment, the second vent aperture 3222 is formed into the first end wall 3215 of the housing 3210 and the third vent aperture 3223 is formed into the second end wall 3216 of the housing 3210. Furthermore, in the exemplified embodiment there are two of the second vent apertures 3222 and two of the third vent apertures 3223, although a single one of the second and third vent apertures 3222, 3223 or more than two of the second and third vent apertures 3222, 3223 could be used in other embodiments.

The second vent apertures 3222 permit proper venting of the storage cavity 3211 when the housing 3210 is in an upright orientation and the plurality of first vent apertures 3221 and the third vent apertures 3223 are covered by the fluid in the storage cavity 3211. The third vent apertures 3223 permit proper venting of the storage cavity 3211 when the housing 3211 is in an inverted orientation and the plurality of first vent apertures 3221 and the second vent apertures 3222 are covered by the fluid in the storage cavity 3211. The plurality of first vent apertures 3221 permit proper venting of the storage cavity 3211 when the second and third vent apertures 3222, 3223 are covered by the fluid in the storage cavity 3211 but at least one of the plurality of first vent apertures 3221 remains outside of the fluid in the storage cavity 3211. In every instance that the second and third vent apertures 3222, 3223 are covered by the fluid in the storage cavity 3211, regardless of the specific orientation of the housing 3210, at least one of the first vent apertures 3221 will be located outside of the fluid so that it is spatially coupled to the gas within the storage cavity 3211. Thus, regardless of the orientation of the housing 3210, there is always one vent aperture 3221, 3222, 3223 available for venting the storage cavity 3211 which assists in preventing fluid leaks. This will be described in greater detail below with specific reference to FIGS. 32A-32D.

In the exemplified embodiment, the plurality of first vent apertures 3221 are located in a middle portion of the housing 3210 between the first and second end walls 3215, 3216. Although in the exemplified embodiment the plurality of first vent apertures 3221 do not extend all the way to the first and second end walls 3215, 3216, in other embodiments they could. The plurality of first vent apertures 3221 are arranged in a spaced apart manner along the sidewall 3217. In the exemplified embodiment, the first vent apertures 3221 are both axially and angularly equi-spaced from one another. More specifically, in the exemplified embodiment adjacent ones of the first vent apertures 3221 are separated by an angle that is less than or equal to 60 degrees, more specifically less than or equal to 50 degrees, more specifically less than or equal to 40 degrees, more specifically less than or equal to 30 degrees, more specifically less than or equal to 20 degrees, and more specifically less than or equal to 10 degrees. However, the first vent apertures 3221 need not be equi-spaced in all embodiments and adjacent first vent apertures 3221 may have variations in spacing in alternative embodiments (i.e., a first of the first vent aperture 3221 that is adjacent to a second and a third of the first vent apertures 3221 may be in closer to proximity the second of the first vent apertures 3221 than to the third of the first vent apertures 3221).

In the exemplified embodiment, the first vent apertures 3221 circumferentially surround the cavity axis 3B-3B of the storage cavity 3211 of the housing 3210. Thus, the first vent apertures 3221 collectively define a reference ring (if a reference line were added to connect each of the first vent apertures 3221 to those adjacent to it a ring would be created) that circumferentially surrounds the cavity axis 3B-3B. This reference ring is oblique to the cavity axis 3B-3B. State another way, in the exemplified embodiment the plurality of first vent apertures 3221 lie in a reference plane 3C-3C that is oblique to the cavity axis 3B-3B. However, the invention is not to be so limited in all embodiments and an alternative arrangement will be described with reference to FIGS. 28 and 29 with other alternative arrangements not illustrated herein also being possible and within the scope of the present invention.

Figure 28:
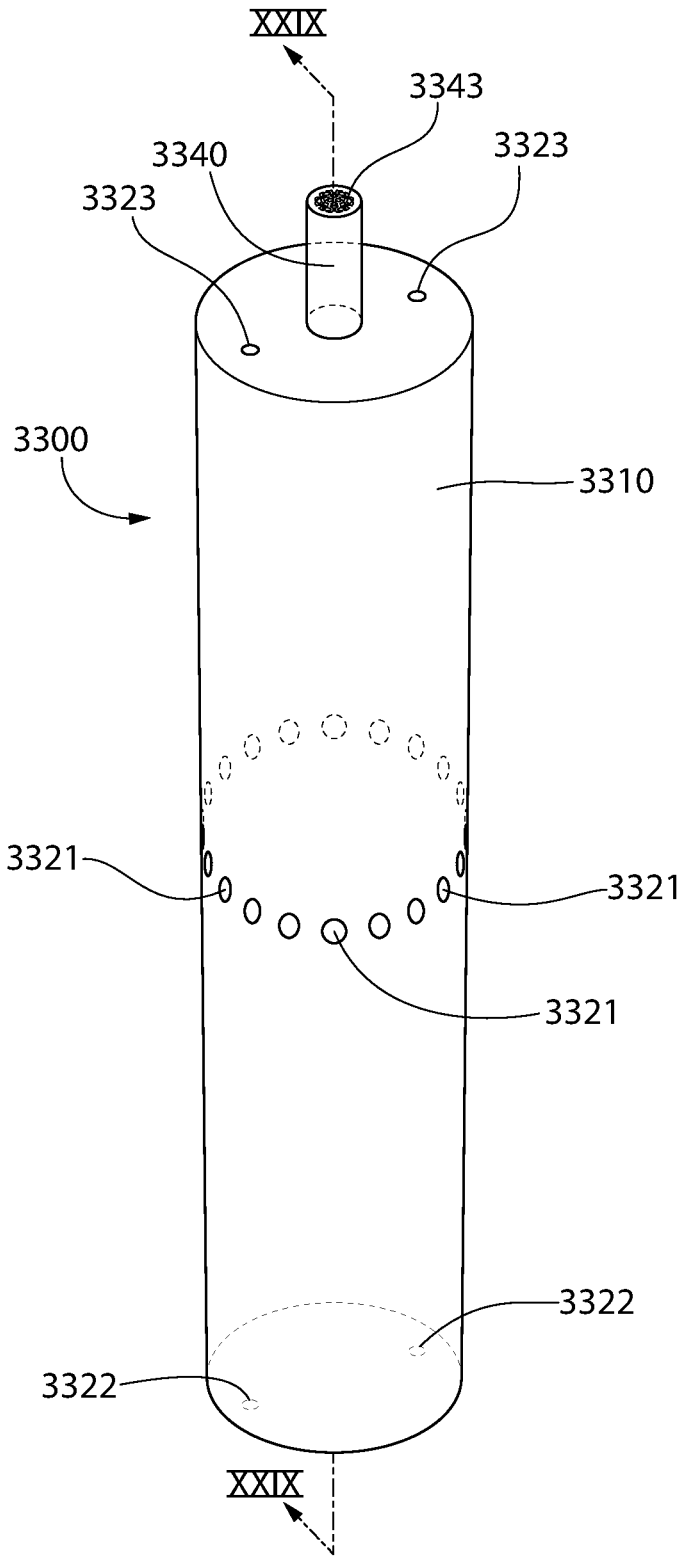
FIG. 28 is a perspective view of a fluid supply apparatus in accordance with an alternative embodiment of the present invention.
Figure 29:
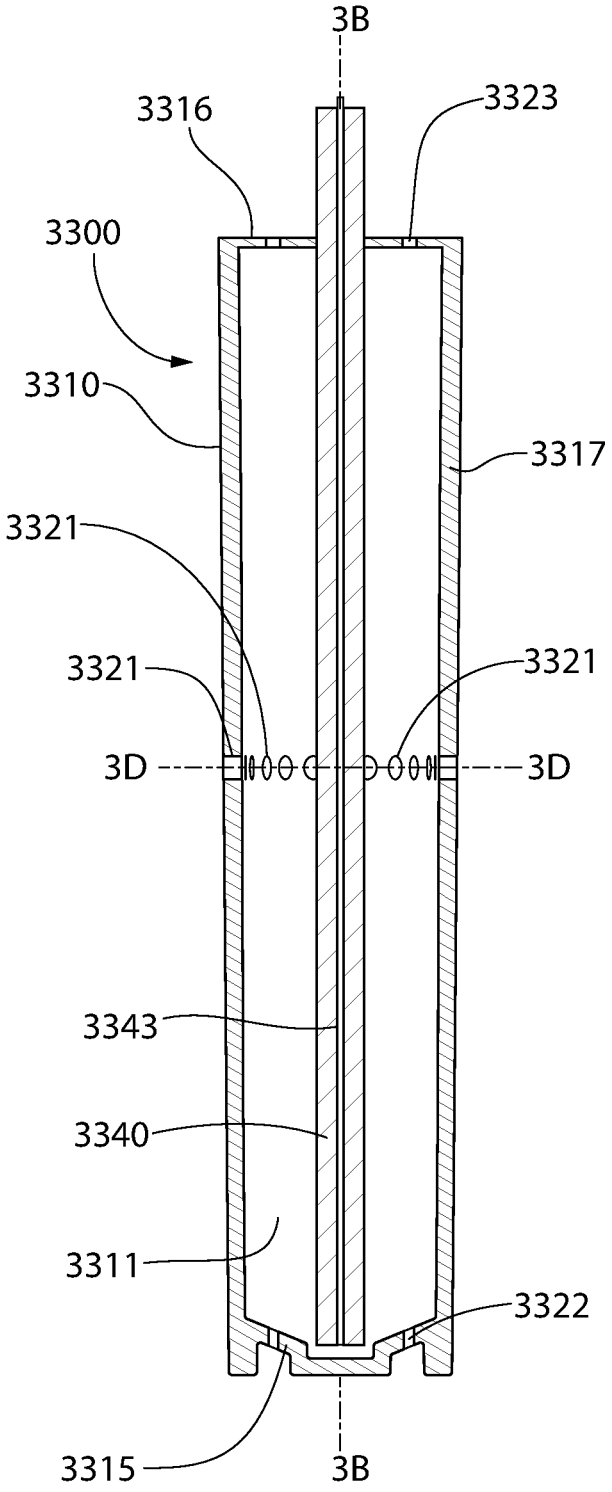
FIG. 29 is a cross-sectional view taken along line XXVIIII-XXVIIII of FIG. 28.

Referring to FIGS. 28 and 29, an alternative fluid supply apparatus 3300 is illustrated in accordance with an embodiment of the present invention. Similar reference numerals will be used to describe the features of the fluid supply apparatus 3300 as were used to describe the features of the fluid supply apparatus 3200 except the 3300-series of numbers will be used. Certain reference numerals are illustrated in FIGS. 28 and 29 and not specifically described herein, it being understood that the description of the similar feature with reference to the fluid supply apparatus 3200 is applicable.

The fluid supply apparatus 3300 is identical to the fluid supply apparatus 3200 except with regard to the location of the first vent apertures 3321. Specifically, in this embodiment the first vent apertures 3321 are located centrally along the length of the housing 3310 between the first and second end walls 3315, 3316 such that they lie in a reference plane 3D-3D that is orthogonal to the cavity axis 3B-3B. Of course, the first vent apertures 3321 could be located closer to the first end wall 3315 or closer to the second end wall 3316 of the housing 3310 in other embodiments while still lying in a reference plane 3D-3D that is orthogonal to the cavity axis 3B-3B. In this embodiment, the first vent apertures 3321 still circumferentially surround the cavity axis 3B-3B in a spaced apart manner, but they are all located at the same axial height along the length of the housing 3310. In any of the embodiments described herein, there could be multiple loops/rings of the first vent apertures 3221, 3321. In still other embodiments, the first vent apertures 3321 could be arranged in a helical pattern about the cavity axis 3B-3B.

Figure 30:
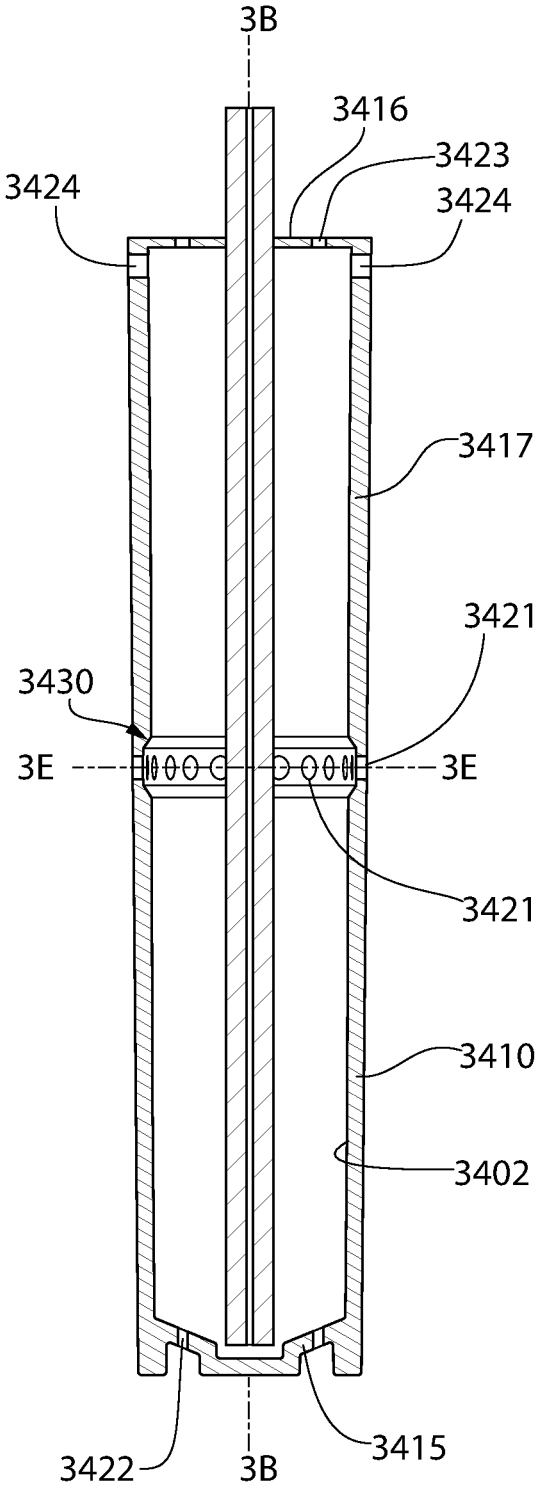
FIG. 30 is a cross-sectional view taken along line XXVIIII-XXVIIII of FIG. 28 in accordance with an alternative embodiment of the present invention.

Referring briefly to FIG. 30, another alternative fluid supply apparatus 3400 is illustrated in accordance with an embodiment of the present invention. Similar reference numerals will be used to describe the features of the fluid supply apparatus 3400 as were used to describe the features of the fluid supply apparatus 3200 except the 3400-series of numbers will be used. Certain reference numerals are illustrated in FIG. 30 and not specifically described herein, it being understood that the description of the similar feature with reference to the fluid supply apparatus 3200 is applicable.

In this embodiment, the first vent apertures 3321 still lie in a reference plane 3E-3E that is orthogonal to the cavity axis 3B-3B just like with the fluid supply apparatus 3300. However, in this embodiment the storage cavity 3411 has a region 3430 with an increased diameter or transverse cross-sectional area. Specifically, within the region 3430 of the storage cavity 3411, the inner surface 3402 of the housing 3410 and more specifically of the sidewall 3417 is located radially furthest from the cavity axis 3B-3B. Thus, a distance measured from the cavity axis 3B-3B to the inner surface 3402 of the housing 3410 is greater at the region 3430 than at other locations along the storage cavity 3411. In this embodiment, the first vent apertures 3421 are located within the region 3430. Thus, the first vent apertures 3421 are formed into the housing 3410 along the portion of the inner surface 3402 of the housing 3410 that is located furthest from the cavity axis 3B-3B. Stated another way, the first vent apertures 3421 are located along the portion of the storage cavity 3411 that has a maximum internal diameter. Locating the first vent apertures 3421 in this manner ensures that the first vent apertures 3421 will be located within air pockets in the storage cavity 3411 regardless of the orientation at which the housing 3410 is positioned as discussed in more detail below with reference to FIGS. 32A-32D.

In this embodiment, the housing 3410 also includes additional vent apertures 3423, 3424 formed into the sidewall 3417 adjacent to the second end wall 3416. Furthermore, still more vent apertures could be included in the sidewall 3417 to further ensure that at any orientation of the housing 3410, at least one of the vent openings will be located within the air/gas in the storage cavity 3411 and outside of any fluid within the storage cavity 3411. These additional vent apertures 3423, 3424 (and any others not illustrated) can be used with any of the embodiments described herein.

In still other embodiments, the arrangement of the first vent apertures 3221 can be random or the first vent apertures 3221 could be arranged along the entirety of the housing 3210 in a spaced apart manner. In one embodiment the first vent apertures 3221 should be arranged around the entire circumference of the housing 3210 to surround the cavity axis 3B-3B, but these first vent apertures 3221 can be spaced apart, located at different axial locations along the housing 3210, or the like. So long as the functionality described herein is achieved so that one of the vent apertures 3221, 3222, 3223 is in spatial communication with the air/gas within the storage cavity 3211 regardless of the orientation of the storage cavity 3211, the exact locations of the plurality of first vent apertures 3221 is not to be limiting of the present invention.

Figure 31:
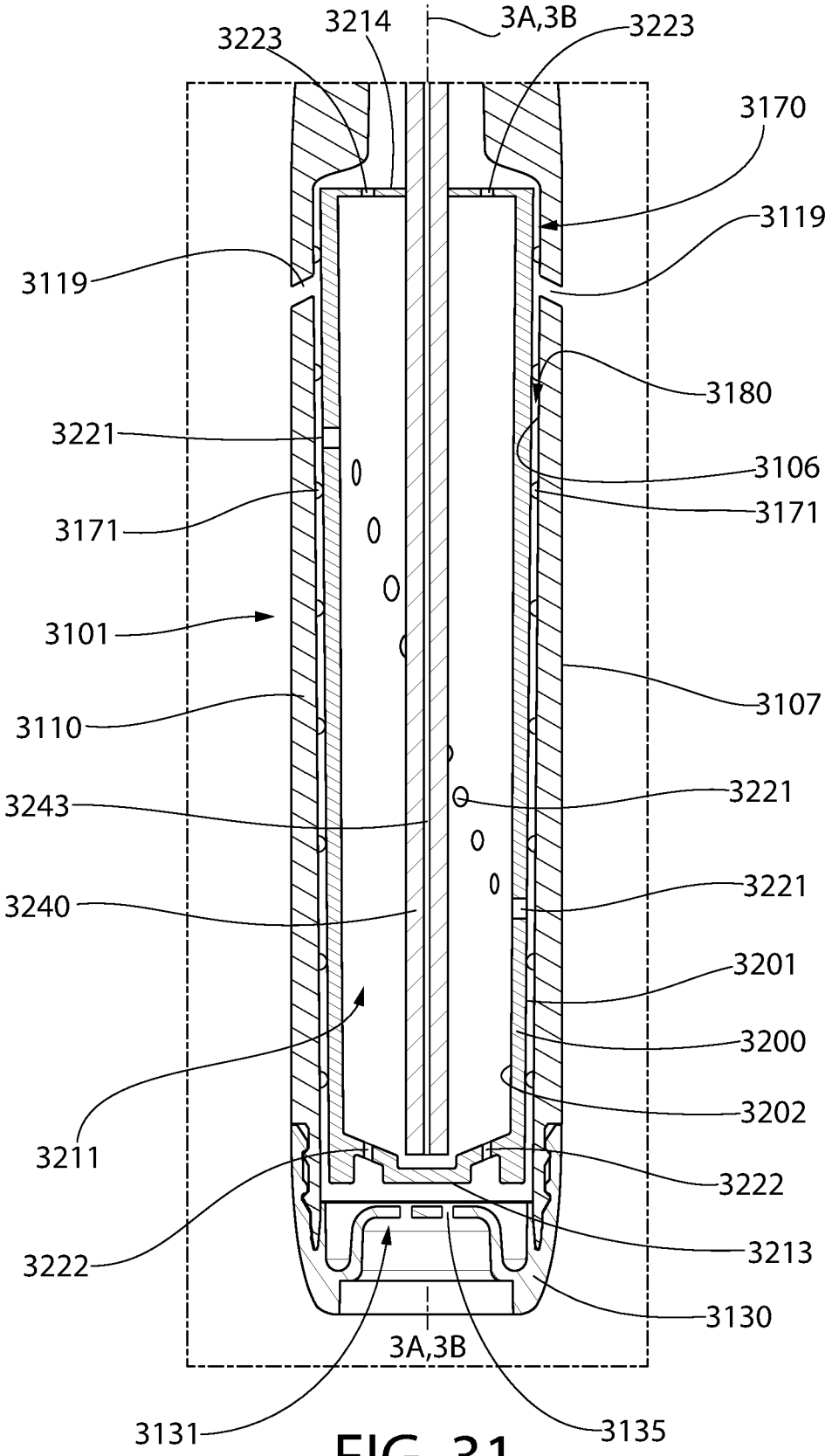
FIG. 31 is a close-up view of area XXXI of FIG. 22.

Referring to FIG. 31, a close-up view of a portion of FIG. 22 is provided to illustrate the fluid supply apparatus 3200 within the handle cavity 3170 of the personal care implement 3100. In the exemplified embodiment, a protuberance 3171 (either ring-like or a plurality of spaced apart protuberances arranged in a ring) extends from the inner surface 3106 of the handle 3110 into the handle cavity 3170. The protuberance 3171 abuts against the outer surface 3201 of the housing 3210 to secure the housing 3210 properly in position within the handle cavity 3170. Thus, the protuberance 3171 may ensure that the housing 3210 is secured in place within the handle cavity 3170 via an interference or friction fit. The protuberance 3171 may be formed of resilient elastomeric material so that the protuberance 3171 will compress as the housing 3210 is inserted into the handle cavity 3170 and exert pressure on the outer surface 3201 of the housing 3210 to secure it in place. In the exemplified embodiment, there are a plurality of protuberances 3171 arranged along the length of the storage cavity 3211 (each of which may represent a single protuberance in any shape including ring-like or a plurality of spaced-apart protuberances arranged in a ring). The housing 3210 may also include a detent or other recess in its outer surface 3201 that mates with the protuberance 3171 to further secure the housing 3210 in place. Other mechanical structures can be used to secure the housing 3210 within the handle cavity 3170 in other embodiments.

When the housing 3210 is located within the handle cavity 3170, the outer surface 3201 of the housing 3210 is spaced apart from the inner surface 3106 of the handle 3110 so that a gap 3180 exists therebetween. In certain embodiments, the gap 3180 is an annular gap that circumferentially surrounds the housing 3210 along the entire length of the housing 3210 between the first and second ends 3213, 3214 thereof. The gap 3180 may be a continuous gap in some embodiments or it may be segmented or partially segmented in others as long as each segment is vented to the external atmosphere as described herein.

In that regard, the body 3101, and more specifically the handle 3110 in the exemplified embodiment, has at least one vent opening 3119 extending from the inner surface 3106 of the handle 3110 to an outer surface 3107 of the handle 3110. Where the gap 3180 is segmented, there should be at least one vent opening 3119 formed into the handle 3110 within each segment of the gap 3180. The at least one vent opening 3119 forms a passageway from the gap 3180 to the exterior atmosphere. In the exemplified embodiment the vent opening 3119 is oriented oblique to the longitudinal axis 3A-3A of the personal care implement 3100. This may be desirable to limit blockage of the vent opening 3119 by preventing debris from entering into the vent opening 3119. Of course, the invention is not to be so limited in all embodiments and in other embodiments the vent opening 3119 may be orthogonal to the longitudinal axis 3A-3A of the personal care implement 3100 and/or to the cavity axis 3B-3B of the storage cavity 3210

Moreover, in the exemplified embodiment the cap 3130 also includes at least one vent opening 3135 that provides a passageway from the gap 3180 to the exterior atmosphere. In this embodiment, the cap 3130 includes a recessed portion 3131 such that if the personal care implement 3100 were positioned vertically with the cap 3130 resting on a horizontal surface, the recessed portion 3131 of the cap 3130 would be spaced from the horizontal surface. This maintains the vent opening 3135 in the cap 3130 spaced from such a horizontal surface, which may facilitate preventing debris from entering into and clogging the vent opening 3135.

Although the exemplified embodiment illustrates the vent openings 3119 in the handle 3110 and the vent openings 3135 in the cap 3130, in alternative embodiments only one of the vent opening 3119 in the handle 3110 and the vent opening 3135 in the cap 3130 may be needed to achieve the desired venting as described herein. However, at least one vent from the gap 3180 to the exterior atmosphere is needed to permit and facilitate air to flow from the storage cavity 3211 to the exterior atmosphere during periods of air expansion to prevent fluid leakage.

Thus, in the exemplified embodiment, a passageway exists from the storage cavity 3211 to the external atmosphere as follows: from the storage cavity 3211 through one of the first, second, and third vent openings 3221, 3222, 3223 and into the gap 3180, and then from the gap 3180 to the external atmosphere through one of the vent openings 3119, 3135. Thus, as long as at least one of the first, second, and third vent openings 3221, 3222, 3223 is located in spatial contact with air/gas within the storage cavity 3211 (as opposed to being in spatial contact with fluid in the storage cavity 3211), the storage cavity 3211 is properly vented to substantially prevent fluid leaks as has been described herein.

Although in the exemplified embodiment the fluid supply apparatus 3200 and the housing 3210 are separate components from the personal care implement 3100, in other embodiments the features of the housing 3210 may be wholly incorporated directly into the personal care implement 3100. For example, in one embodiment the inner surface 3106 of the handle 3110 may define the storage cavity for retaining the fluid that is intended to be dispensed via the applicator 3150. In such embodiment the handle 3110 may include an internal feature to operate as the roof or upper bounds of the storage cavity. In such embodiment, the vent openings 3221, 3222, 3223 may be formed directly into the handle 3110 of the personal care implement 3100 in the manner described herein above with regard to the housing 3210, 3310, 3410. Thus, in such an embodiment the handle 3110 can operate exactly in the same manner as the housing 3210 thus negating the need for the housing 3210 altogether.

Referring now to FIGS. 32A-32D, operation of the fluid supply apparatus 3200 within the personal care implement 3100 will be described. It should be appreciated that the fluid supply apparatus 3200 would operate in a similar manner on its own without being disposed within the personal care implement 3100. Thus, in certain embodiments the fluid supply apparatus 3200 may be coupled to an applicator, but not one that is a part of a personal care implement 3100. For example, the second end 3242 of the capillary member 3240 may be coupled to an applicator that can be used to apply a fluid to a desired surface.

Specifically, as will be better understood from the description of FIGS. 32A-32D that follows, the vent apertures 3221, 3222, 3223 are located and arranged on the housing 3210 such that irrespective of the vertical and angular orientation of the housing 3210 relative to a gravitational vector GV, at least one of the vent apertures 3221, 3222, 3223 is in spatial communication with a gas located within the storage cavity 3211 of the housing 3210 rather than with a fluid located within the storage cavity 3211 of the housing 3210.

Figure 32A:
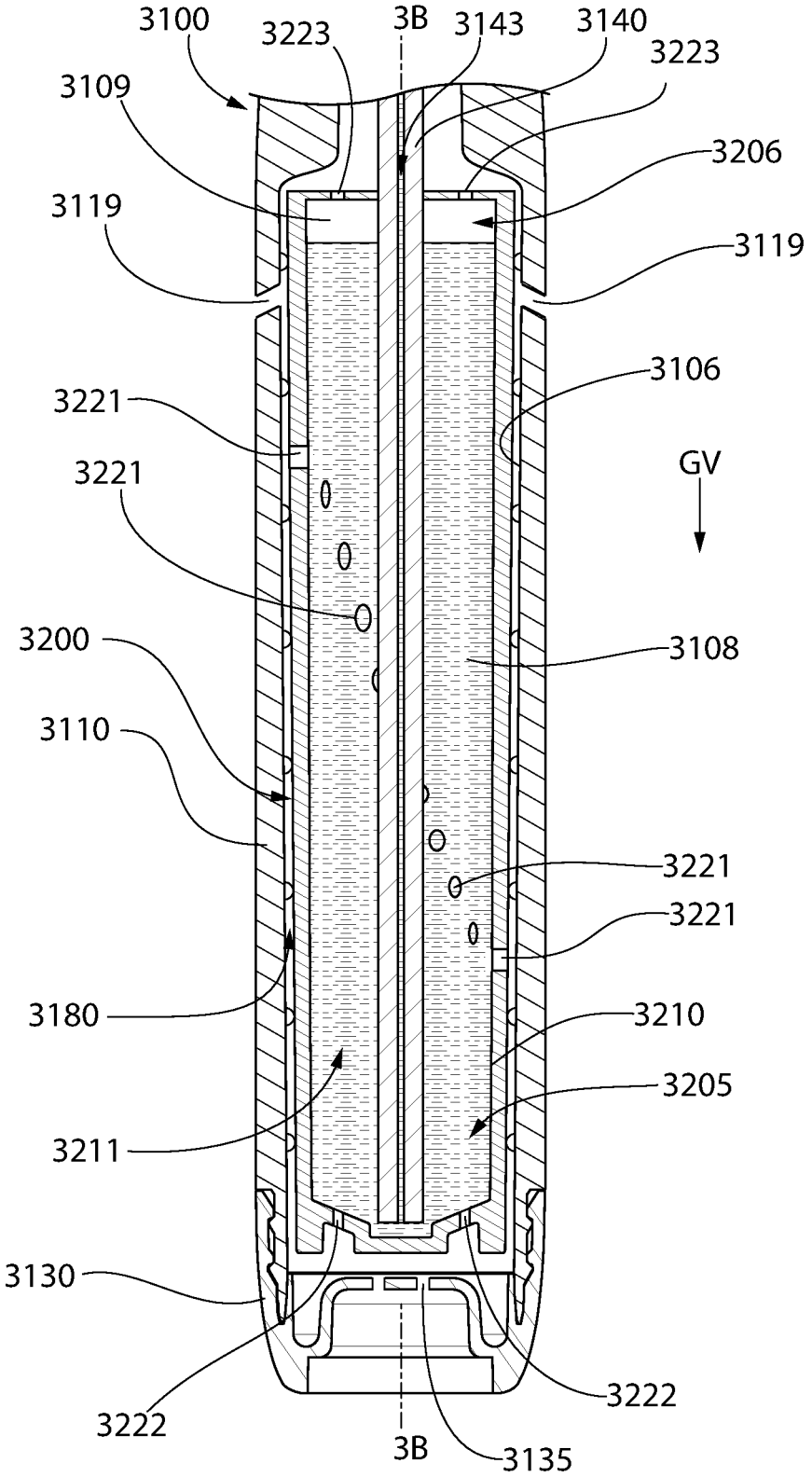
FIG. 32A is a close-up view of area XXXI of FIG. 22 in a first orientation.

FIG. 32A illustrates the fluid supply apparatus 3200 located within the personal care implement 3100 with the housing 3210 positioned in an upright orientation. As shown here, the storage cavity 3211 of the housing 3210 has a total volume that is occupied by a fluid 3108 and a gas 3109. Specifically, a first portion of the total volume of the storage cavity 3211 of the housing 3210 is occupied by the fluid 3108 and a second portion of the total volume of the storage cavity 3211 of the housing 3210 is occupied by the gas 3109. In the exemplified embodiment, the first portion of the total volume of the storage cavity 3211 that is occupied by the fluid 3108 is a majority of the total volume such that the fluid occupies a majority of the total volume of the storage cavity 3211. In one embodiment, the fluid 3109 occupies at least eighty percent (80%) of the total volume of the storage cavity 3211. In another embodiment, the fluid 3109 occupies at least eight-five percent (85%), or at least ninety percent (90%) or at least ninety-five percent (95%) of the total volume of the storage cavity 3211. Of course, as the fluid 3108 supply apparatus 3200 is used, the fluid 3109 contained within the storage cavity 3211 becomes depleted and the percentage of the total volume that is taken up by the fluid 3108 decreases while the percentage of the total volume that is taken up by the gas 3109 increases.

In one specific embodiment, the total volume of the storage cavity 3210 may be between 5 ml and 10 ml, more specifically between 6 ml and 8 ml, and still more specifically approximately 7 ml. Furthermore, in certain embodiments prior to use the fluid 3108 will encompass approximately 95% (about 6.7 ml when the total volume is 7 ml) of the total volume. Of that 6.7 ml of the fluid 3108, a portion will prime the capillary member 3240 and the applicator 3150, leaving approximately 6 ml of the fluid 3108 within the storage cavity 3210 (based on the storage cavity 3210 having a total volume of 7 ml, the exact numbers may change while the percentages may remain the same). Thus, after priming and at or before first use by an end user, between 80%-90%, and more specifically approximately 85% of the total volume of the storage cavity 3210 will be taken up by the fluid 3108, the remaining 10%-20%, and more specifically 15%, being taken up by the gas/air 3109.

With the housing 3210 positioned in the upright orientation such that the gravitational vector GV is parallel to the cavity axis 3B-3B, the fluid 3108 in the storage cavity 3211 is located in a bottom portion 3205 of the storage cavity 3211 and the gas 3109 is located in the top portion 3206 of the storage cavity 3211 above the free surface of the liquid 3108. In this example and orientation of the housing 3210, the vent apertures 3223 are in spatial communication with the gas 3109 in the storage cavity 3211. Thus, if there were an increase in temperature or a decrease in pressure, the gas 3109 will flow out through the vent apertures 3223 into the gap 3180 and then out through one of the vent openings 3119, 3135 to the external atmosphere. Thus, because one of the vent apertures 3223 is in spatial communication with the gas 3109 (i.e., air pocket) within the storage cavity 3211, the gas 3109 is permitted to pass to the external atmosphere rather than having it exert a pressure on the fluid 3108 which could create a leak situation.

In certain embodiments, the gas 3109 in the storage cavity 3211 is air (i.e., oxygen, a mixture of oxygen, nitrogen, and small amounts of other gases, or the like). Furthermore, the fluid 3109 can be any fluid that is desired to be dispensed for application to a surface (such as a biological surface) depending on the end use. For example, when the desired application site is a user's oral cavity, the fluid 3108 may be one that provides a benefit to a user's oral surfaces (i.e., a benefit agent) such as a sensorial or therapeutic benefit. For example without limitation, the fluid 3108 may be a mouthwash, a dentifrice, a tooth whitening agent such as peroxide containing tooth whitening compositions, or the like. Other contemplated fluids that can be stored in the storage cavity 3211 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the first fluid 3103 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

Thus, when the fluid supply apparatus 3200 is stored in an oral care implement or toothbrush, any of the above fluids may be desirable for use as the fluid 3108. In other embodiments the personal care implement 3100 may not be a toothbrush. Thus, the fluid 3108 can be any other type of fluid that has beneficial results when dispensed in accordance with its end use or the end use of the product/implement with which it is associated. For example, the fluid 3108 may be hair gel when the implement is a hairbrush, make-up (i.e., mascara or the like) when the implement is a make-up applicator, shaving cream when the implement is a razor, anti-acne cream when the implement is a skin or face scrubber, or the like. Furthermore, as described herein in some embodiments the fluid supply apparatus 3200 may not be associated with a personal care implement at all. Thus, the fluid 3108 may be modified as desired to be any type of fluid that is desired to be dispensed in accordance with the teachings set forth herein even if it is dispensed directly from the fluid supply apparatus 3200 rather than through a personal care implement 3100.

Figure 32B:
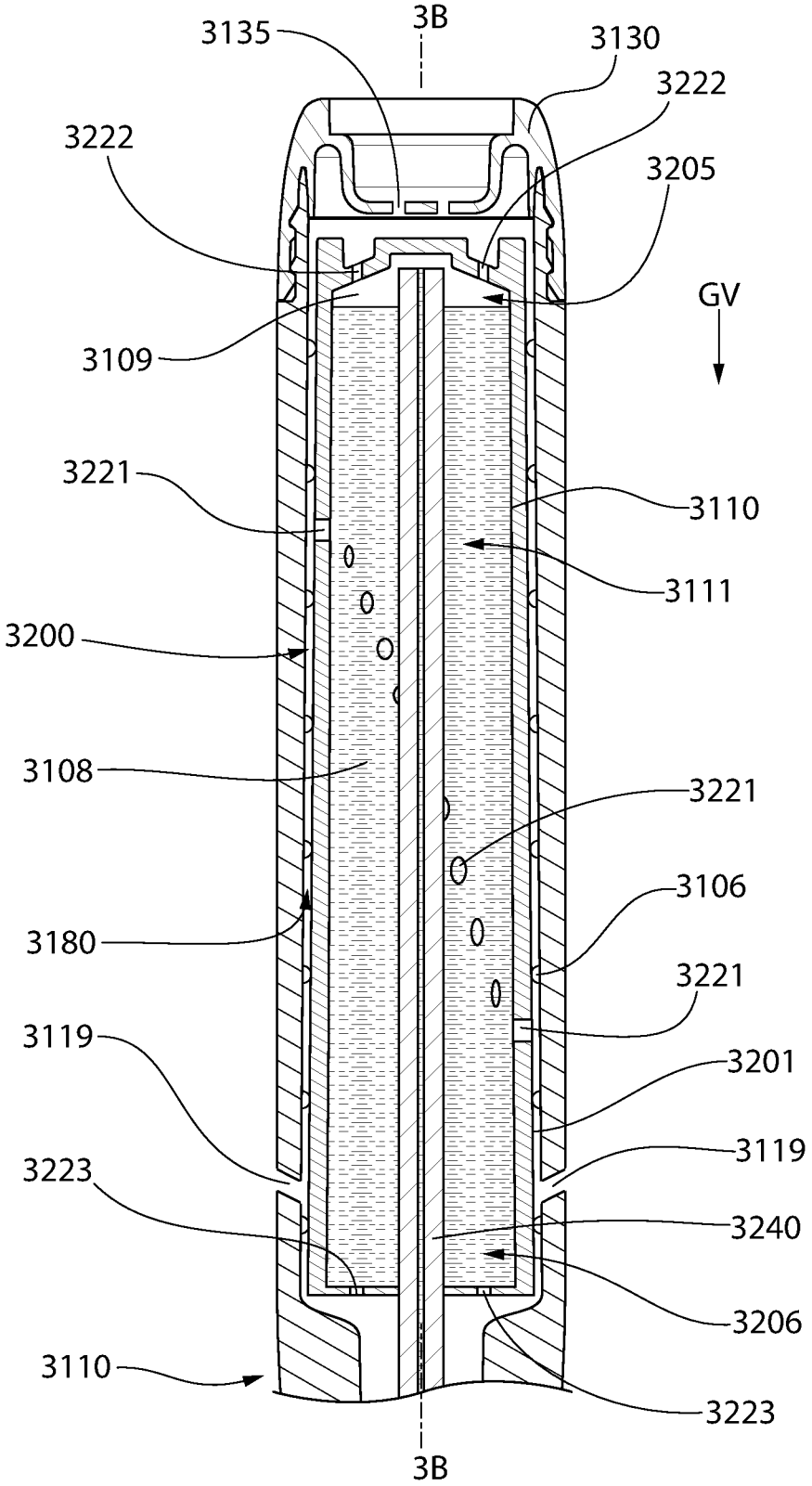
FIG. 32B is a close-up view of area XXXI of FIG. 22 in a second orientation.

FIG. 32B illustrates the same thing as FIG. 32A except the personal care implement 3100 and the fluid supply apparatus 3200 therein have been flipped 3180° so that they are upside-down relative to FIG. 32A. Thus, in this embodiment the cavity axis 3B-3B remains parallel to the gravitational vector GV, except here the housing 3210 is upside-down such that its top portion 3206 is facing downward and its bottom portion 3205 is facing upward. In this embodiment, the same amount of the total volume of the storage cavity 3211 is occupied by the fluid 3108 and the gas 3109 as with the embodiment of FIG. 32A (i.e., a majority of the total volume is occupied by the fluid 3108 and the remainder by the gas 3109).

With the housing 3210 positioned in the upside-down orientation, the fluid 3108 in the storage cavity 3211 is located in the top portion 3206 of the storage cavity 3211 and the gas 3109 is located in the bottom portion 3205 of the storage cavity 3211 (which is above the free surface of the liquid 3108 due to the upside-down orientation). In this example and orientation of the housing 3210, one of the second vent apertures 3222 is in spatial communication with the gas 3109 in the storage cavity 3211. Thus, if there were an increase in temperature or a decrease in pressure, the gas 3109 will flow out through the second vent aperture(s) 3222 into the gap 3180 and then out through one of the vent openings 3119, 3135 to the external atmosphere. Thus, because one of the second vent apertures 3222 is in spatial communication with the gas 3109 (i.e., air pocket) within the storage cavity 3211, the gas 3109 is permitted to pass to the external atmosphere rather than having it exert a pressure on the fluid 3108 which could create a leak situation.

Figure 32C:
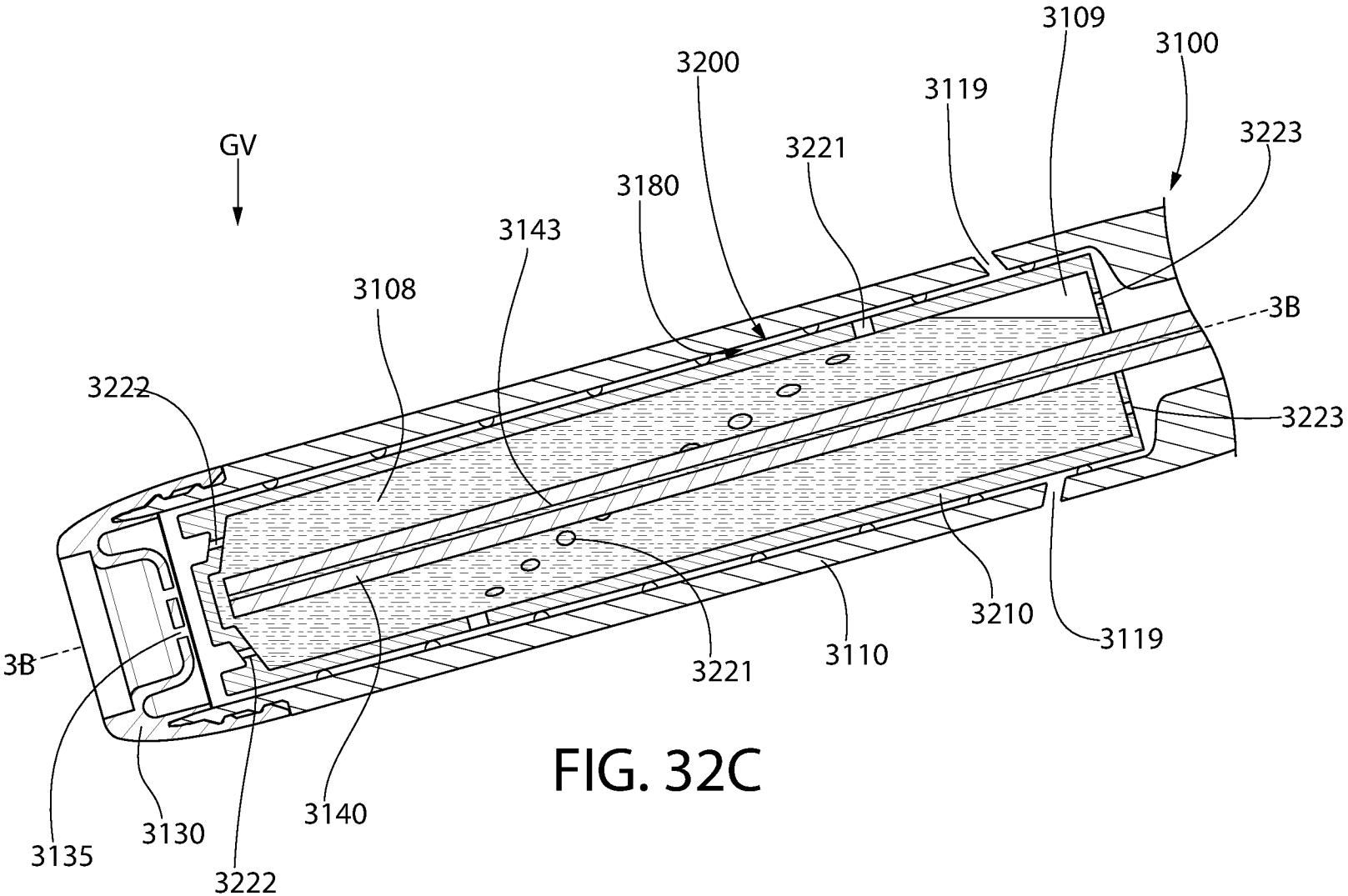
FIG. 32C is a close-up view of area XXXI of FIG. 22 in a third orientation.

FIG. 32C illustrates the same thing as FIGS. 32A and 32B except the personal care implement 3100 and the fluid supply apparatus 3200 have been tilted so that the cavity axis 3B-3B is oriented obliquely to the gravitational vector GV. Although one tilt position is illustrated in FIG. 32C, the device will operate similarly in any of the infinite tilt orientations at which the cavity axis 3B-3B is oblique to the gravitational vector GV. Furthermore, at any orientation shown, the personal care implement 3100 and the fluid supply apparatus 3200 can be rotated (with the cavity axis 3B-3B or the longitudinal axis 3A-3A as the rotational axis) 3360° with the device still properly functioning to prevent a leak situation. In the embodiment of FIG. 32C, the same amount of the total volume of the storage cavity 3211 is occupied by the fluid 3108 and the gas 3109 as with the embodiments of FIGS. 32A and 32B (i.e., a majority of the total volume is occupied by the fluid 3108 and the remainder by the gas 3109).

With the housing 3210 positioned in this tilted orientation, the fluid 3108 in the storage cavity 3211 is located in an upper corner of the storage cavity 3211 near the top end or second end wall 3216. In this example and orientation of the housing 3210, one of the third vent apertures 3223 is in spatial communication with the gas 3109 in the storage cavity 3211. Thus, if there were an increase in temperature or a decrease in pressure, the gas 3109 will flow out through the third vent aperture 3223 into the gap 3180 and then out through one of the vent openings 3119, 3135 to the external atmosphere. Thus, because one of the third vent apertures 3223 is in spatial communication with the gas (i.e., air pocket) within the storage cavity 3211, the gas 3109 is permitted to pass to the external atmosphere rather than having it exert a pressure on the fluid 3108 which could create a leak situation.

Figure 32D:
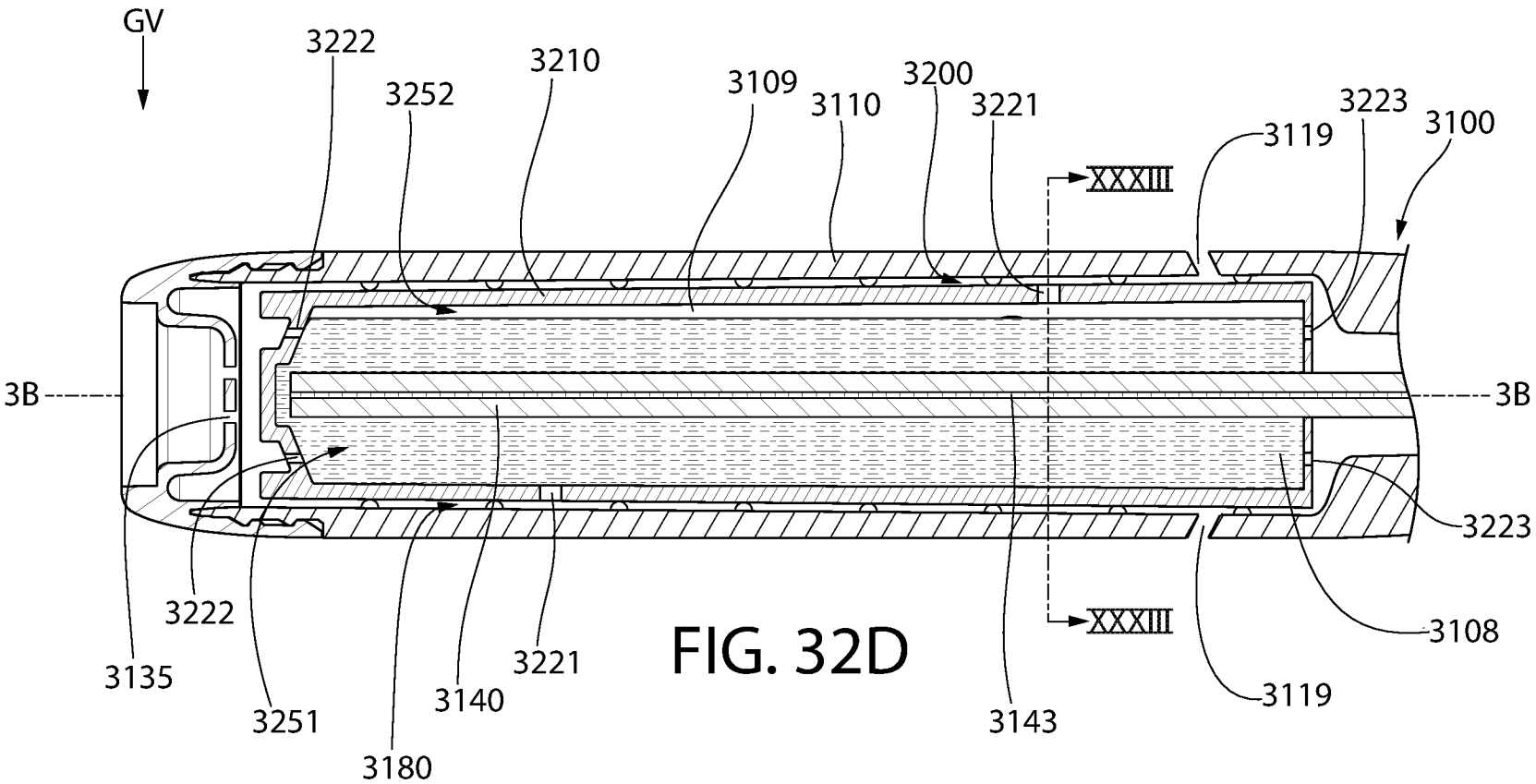
FIG. 32D is a close-up view of area XXXI of FIG. 22 in a fourth orientation.

FIG. 32D illustrates the same thing as FIGS. 32A-32C except the personal care implement 3100 and the fluid supply apparatus 3200 have been tilted so that the cavity axis 3B-3B is oriented orthogonal to the gravitational vector GV. In the embodiment of FIG. 32C, the same amount of the total volume of the storage cavity 3211 is occupied by the fluid 3108 and the gas 3109 as with the previously described embodiments.

Figure 33:
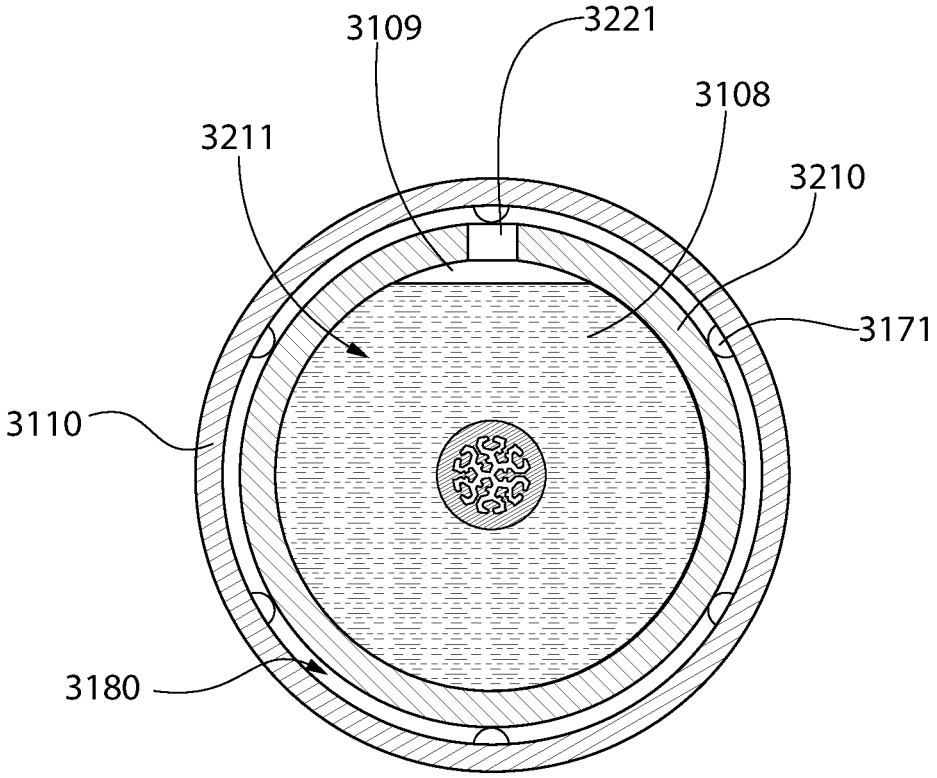
FIG. 33 is a cross-sectional view taken along line XXXIII of FIG. 32D.

With the housing 3210 positioned in this orientation, the fluid 3108 in the storage cavity 3211 falls by gravity to the right-side portion 3251 of the storage cavity 3211 and the left-most portion 3252 of the storage cavity 3211 is filled with the gas 3109. In this example and orientation of the housing 3210, at least one of the first vent apertures 3221 is in spatial communication with the gas 3109 in the storage cavity 3211. Thus, if there were an increase in temperature or a decrease in pressure, the gas 3109 will flow out through the first vent aperture 3221 into the gap 3180 and then out through one of the vent openings 3119, 3135 to the external atmosphere. Thus, because one of the first vent apertures 3221 is in spatial communication with the gas (i.e., air pocket) within the storage cavity 3211, the gas 3109 is permitted to pass to the external atmosphere rather than having it exert a pressure on the fluid 3108 which could create a leak situation. FIG. 33 further illustrates the spatial communication between the gas 3109 in the storage cavity 3211 and one of the first vent apertures 3221 with the housing 3210 in the orientation of FIG. 32D such that the cavity axis 3B-3B is perpendicular to the gravitational vector GV.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A fluid supply apparatus comprising:

a housing defining a storage cavity having a total volume, the storage cavity extending along a cavity axis and comprising a first end wall, a second end wall, and a sidewall that extends between the first and second end walls;

a store of a fluid in the storage cavity and occupying a portion of the total volume, a remaining portion of the total volume occupied by a gas;

a capillary member in fluid coupling with the store of the fluid, the capillary member extending through the housing;

a plurality of first vent apertures formed into the sidewall of the housing and arranged in a spaced apart manner, each of the vent apertures forming a passageway between the storage cavity and an external atmosphere; and wherein the plurality of first vent apertures collectively define a reference ring that circumferentially surrounds the cavity axis, the reference ring being either oblique or orthogonal to the cavity axis.

2. The fluid supply apparatus according to claim 1 wherein the store of the fluid occupies a majority of the total volume.

3. The fluid supply apparatus according to claim 2 wherein the store of the fluid occupies at least eighty-percent of the total volume.

4. The fluid supply apparatus according to claim 1 wherein the plurality of first vent apertures are angularly equispaced from one another.

5. The fluid supply apparatus according to claim 1 wherein adjacent ones of the first vent apertures are separated by an angle that is less than or equal to 60 degrees.

6. The fluid supply apparatus according to any one of claim 1 wherein the first vent apertures lie in a reference plane that is oblique to the cavity axis.

7. The fluid supply apparatus according to claim 1 wherein the first vent apertures lie in a reference plane that is orthogonal to the cavity axis.

8. The fluid supply apparatus according to claim 1 wherein the first vent apertures are arranged in a helical pattern about the cavity axis.

9. The fluid supply apparatus according to claim 1 wherein at least one of the first vent apertures is located along a portion of the sidewall that is radially-most from the cavity axis.

10. The fluid supply apparatus according to claim 1 wherein any axis that is parallel to the cavity axis intersects at most one of the first vent apertures.

11. The fluid supply apparatus according to claim 1 wherein each of the first vent apertures is vertically and horizontally offset from the two first vent apertures immediately adjacent thereto.

12. The fluid supply apparatus according to claim 1 wherein the first vent apertures are located on a middle portion of the housing.

13. The fluid supply apparatus according to claim 1 further comprising at least one second vent aperture formed into the first end wall of the housing and at least one third vent aperture formed into the second end wall of the housing.

14. The fluid supply apparatus according to claim 13 wherein each of the first, second, and third vent apertures is configured such that the fluid cannot flow through the first, second, and third vent apertures at ambient temperature and pressure equilibrium between the storage cavity and the external atmosphere.

15. An oral care implement comprising the fluid supply apparatus according to claim 1.

16. The oral care implement according to claim 15 further comprising:

a head;

a handle; and an applicator in fluid coupling with the capillary member.

17. The oral care implement according to claim 16 wherein the applicator is located on the head.

18. The oral care implement according to claim 17 further comprising:

the handle including a handle cavity;

the fluid supply apparatus positioned within the handle cavity so that a gap exists between the housing of the fluid supply apparatus and an inner surface of the handle;

the first vent apertures of the fluid supply apparatus in spatial communication with the gap; and at least one handle vent aperture forming a passageway between the storage cavity and an external atmosphere.

* * * * *